US010882333B2

(12) United States Patent
Osanai et al.

(10) Patent No.: US 10,882,333 B2
(45) Date of Patent: Jan. 5, 2021

(54) IMAGE FORMING APPARATUS AND IMAGE FORMING APPARATUS BODY

(71) Applicants: Yohei Osanai, Kanagawa (JP); Takayuki Andoh, Kanagawa (JP); Masatoshi Ishida, Kanagawa (JP); Satoshi Narai, Kanagawa (JP); Tomoya Fujii, Kanagawa (JP); Kunihiko Nishioka, Kanagawa (JP); Munekazu Hirata, Tokyo (JP); Masashi Ota, Kanagawa (JP)

(72) Inventors: Yohei Osanai, Kanagawa (JP); Takayuki Andoh, Kanagawa (JP); Masatoshi Ishida, Kanagawa (JP); Satoshi Narai, Kanagawa (JP); Tomoya Fujii, Kanagawa (JP); Kunihiko Nishioka, Kanagawa (JP); Munekazu Hirata, Tokyo (JP); Masashi Ota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/521,896

(22) Filed: Jul. 25, 2019

(65) Prior Publication Data

US 2020/0079112 A1 Mar. 12, 2020

(30) Foreign Application Priority Data

Sep. 10, 2018 (JP) ..... 2018-169131
Jul. 10, 2019 (JP) ..... 2019-128444

(51) Int. Cl.
*B41J 3/36* (2006.01)
*B41J 29/02* (2006.01)

(52) U.S. Cl.
CPC ..... *B41J 3/36* (2013.01); *B41J 29/023* (2013.01)

(58) Field of Classification Search
CPC ..... B41J 3/36; B41J 29/023; B41J 2/17513; B41J 29/38; B41J 2/17536; B41J 2/17553;
(Continued)

(56) References Cited

U.S. PATENT DOCUMENTS 10,427,426 B2 * 10/2019 Okeguchi ..... B41J 2/01
10,696,063 B2 * 6/2020 Nishii ..... B41J 3/36
(Continued)

FOREIGN PATENT DOCUMENTS

JP 201225512 * 8/2001 ..... B41J 3/36
JP 2001-315385 11/2001
JP 2019-038135 3/2019

OTHER PUBLICATIONS

Machine translation of JP 2019-038135, published on Mar. 2019. (Year: 2019).*
(Continued)

*Primary Examiner* — Huan H Tran
(74) *Attorney, Agent, or Firm* — Harness, Dickey & Pierce, P.L.C.

(57) ABSTRACT

An image forming apparatus includes a recording device configured to record an image on a recording medium, a main body configured to house the recording device, and a cover rotatably attached to the main body. The main body includes a recording face to be disposed opposite the recording medium, a first face positioned opposite the recording face, and a second face positioned between the recording face and the first face. The cover includes a first cover portion configured to cover the first face of the main body, and a second cover portion configured to cover at least a portion of the second face, and the second cover portion is configured to house a battery.

17 Claims, 39 Drawing Sheets

(58) Field of Classification Search
CPC ..... B41J 29/02; B41J 2/1753; B41J 2/1752; B41J 29/13
See application file for complete search history.

(56) References Cited

U.S. PATENT DOCUMENTS

2018/0361761 A1 12/2018 Okeguchi et al.
2019/0283453 A1* 9/2019 Nishii ..... B41J 29/023

OTHER PUBLICATIONS

Machine translation of JP 2001-225512, published Aug. 2001. (Year: 2001).*

* cited by examiner

IMAGE FORMING APPARATUS AND IMAGE FORMING APPARATUS BODY

CROSS-REFERENCE TO RELATED APPLICATIONS

This patent application is based on and claims priority pursuant to 35 U.S.C. § 119(a) to Japanese Patent Application Nos. 2018-169131, filed on Sep. 10, 2018, and 2019-128444, filed on Jul. 10, 2019, in the Japan Patent Office, the entire disclosure of which is hereby incorporated by reference herein.

BACKGROUND

Technical Field

The present disclosure generally relates to an image forming apparatus body and an image forming apparatus incorporating same.

Description of the Related Art

There are mobile image forming apparatuses including a recording device to record an image on a recording medium.

Generally, the recording device is disposed at the bottom of the mobile image forming apparatus, and the mobile image forming apparatus is manually moved by user on the recording medium.

SUMMARY

According to an embodiment of this disclosure, an image forming apparatus includes a recording device configured to record an image on a recording medium, a main body configured to house the recording device, and a cover rotatably attached to the main body. The main body includes a recording face to be disposed opposite the recording medium, a first face positioned opposite the recording face, and a second face positioned between the recording face and the first face. The cover includes a first cover portion configured to cover the first face of the main body, and a second cover portion configured to cover at least a portion of the second face, and the second cover portion is configured to house a battery.

According to another embodiment, an image forming apparatus body includes a main body configured to removably house a recording device, and a cover rotatably attached to the main body. The main body includes a recording face to be disposed opposite the recording medium, a first face positioned opposite the recording face, and a second face positioned between the recording face and the first face. The cover includes a first cover portion configured to cover the first face of the main body, and a second cover portion configured to cover at least a portion of the second face. The second cover portion is configured to house a battery.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
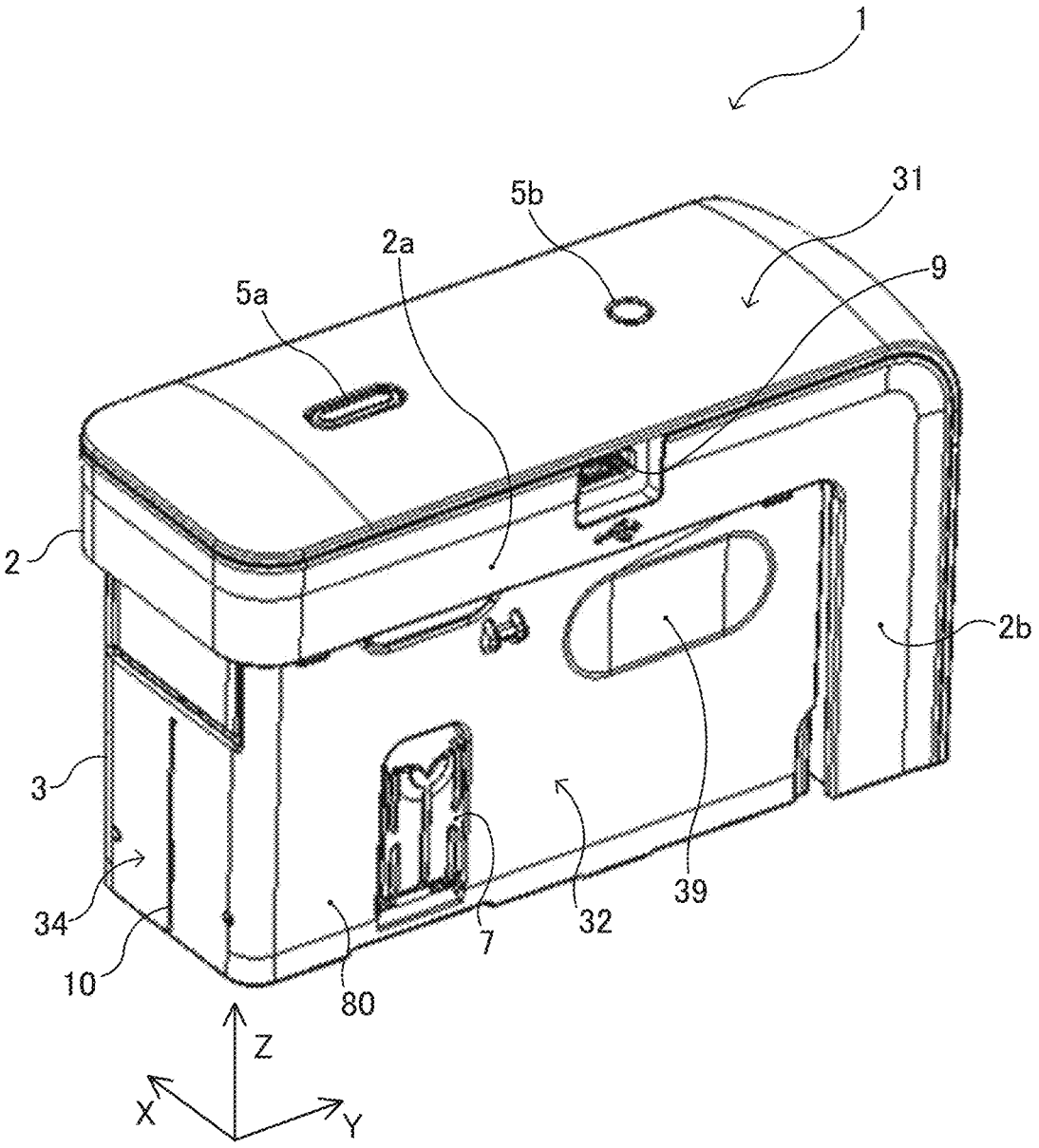
FIG. 1 is an exterior perspective view illustrating a handheld mobile printer (hereinafter simply "handheld printer") according to an embodiment, as viewed from above on a rear left side.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

Descriptions are given below of a handy (or handheld) mobile printer (hereinafter simply referred to as "handheld printer") that is a mobile image forming apparatus, according to an embodiment of the present disclosure. First, a basic configuration of the handheld printer according to the present embodiment is described.

Figure 2:
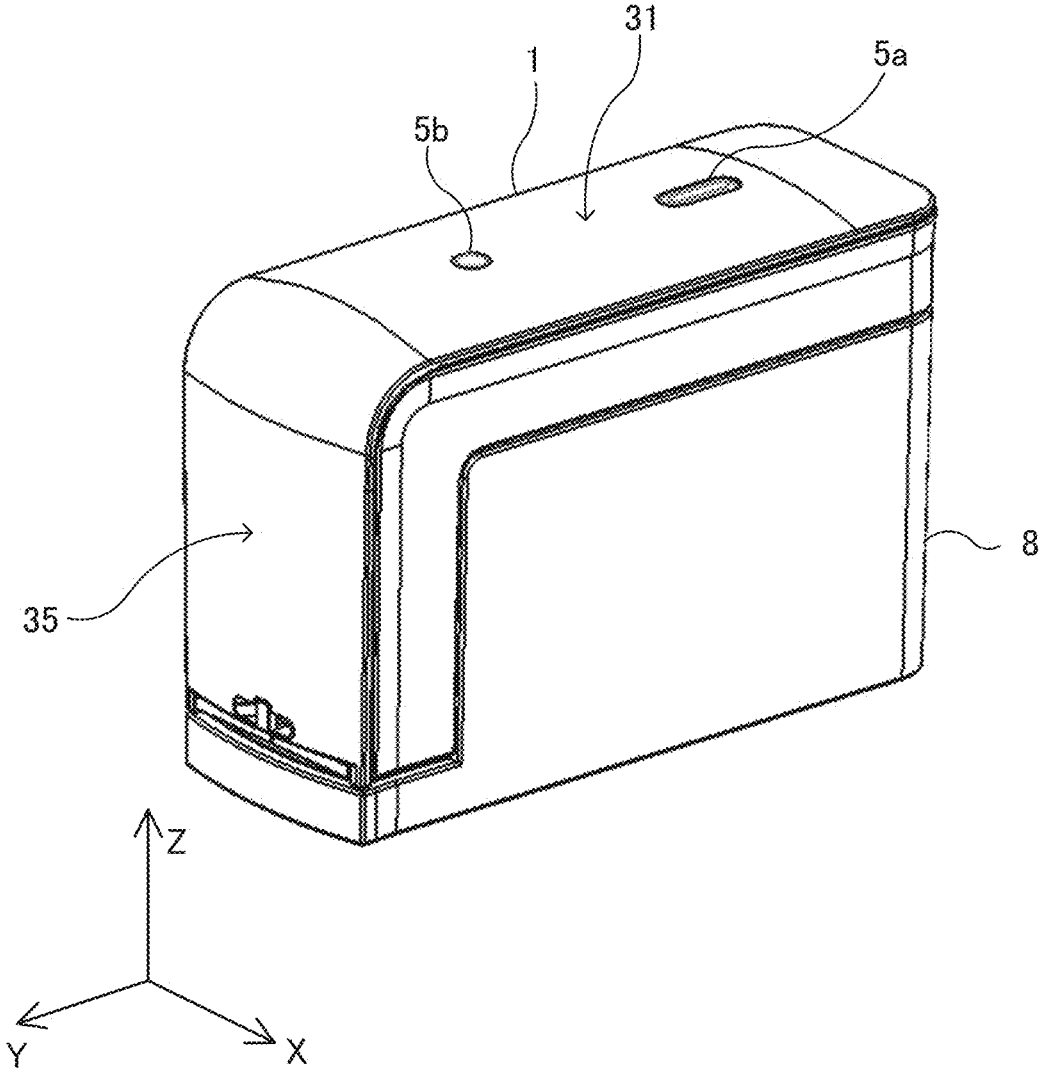
FIG. 2 is an exterior perspective view illustrating a state of the handheld printer to which a capping unit according to an embodiment is attached.

FIG. 2 is an exterior perspective view of a state in which a capping unit 8 is attached to the handheld printer 1 according to the present embodiment, as viewed obliquely from above.

Figure 3:
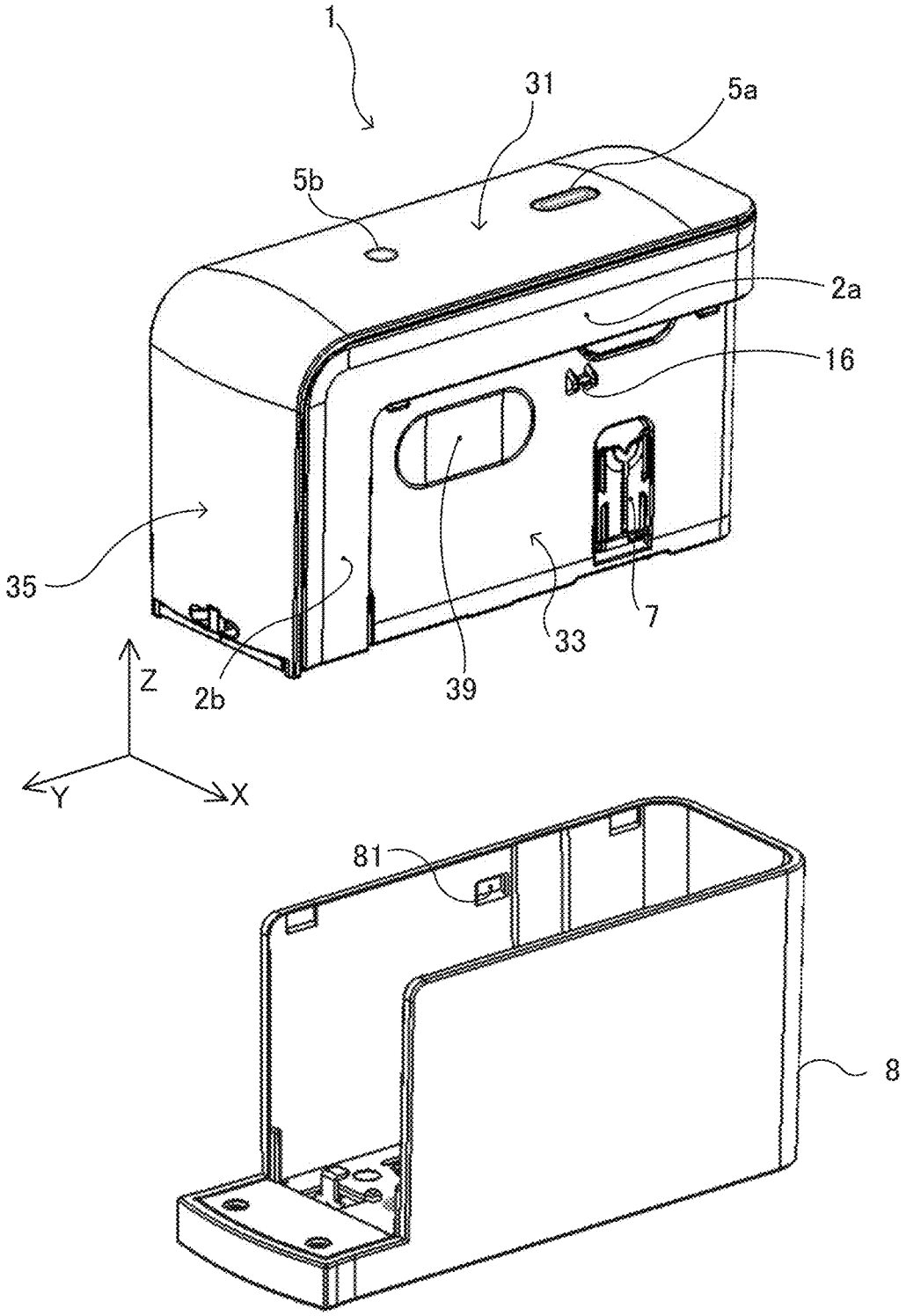
FIG. 3 is an exterior perspective view illustrating a state of the handheld printer from which the capping unit is removed.

FIG. 3 is an exterior perspective view illustrating a state in which the capping unit 8 is removed from the handheld printer 1. FIG. 3 is a perspective view of the handheld printer 1 and the capping unit 8 as viewed from above on a front right side.

The handheld printer 1 according to the present embodiment is provided with thee capping unit 8 that is attachable to the handheld printer 1. The capping unit 8 is made of resin such as acrylonitrile butadiene styrene (ABS) resin, and a recess 81 is formed on the inner wall surface thereof. When the capping unit 8 is attached to the handheld printer 1, a projection 16 provided on the handheld printer 1 is hooked on the recess 81 by snap-fit. Thus, the state in which the capping unit 8 is attached to the handheld printer 1 (the state illustrated in FIG. 2) is maintained.

When removing the capping unit 8 from the handheld printer 1, the user withdraws the main body of the handheld printer 1 from the capping unit 8 upward (Plus side in z-axis direction in the drawing), so that the projection 16 caught by the snap-fit is disengaged from the recess 81. Thereby, the capping unit 8 can be removed from the handheld printer 1.

Figure 4:
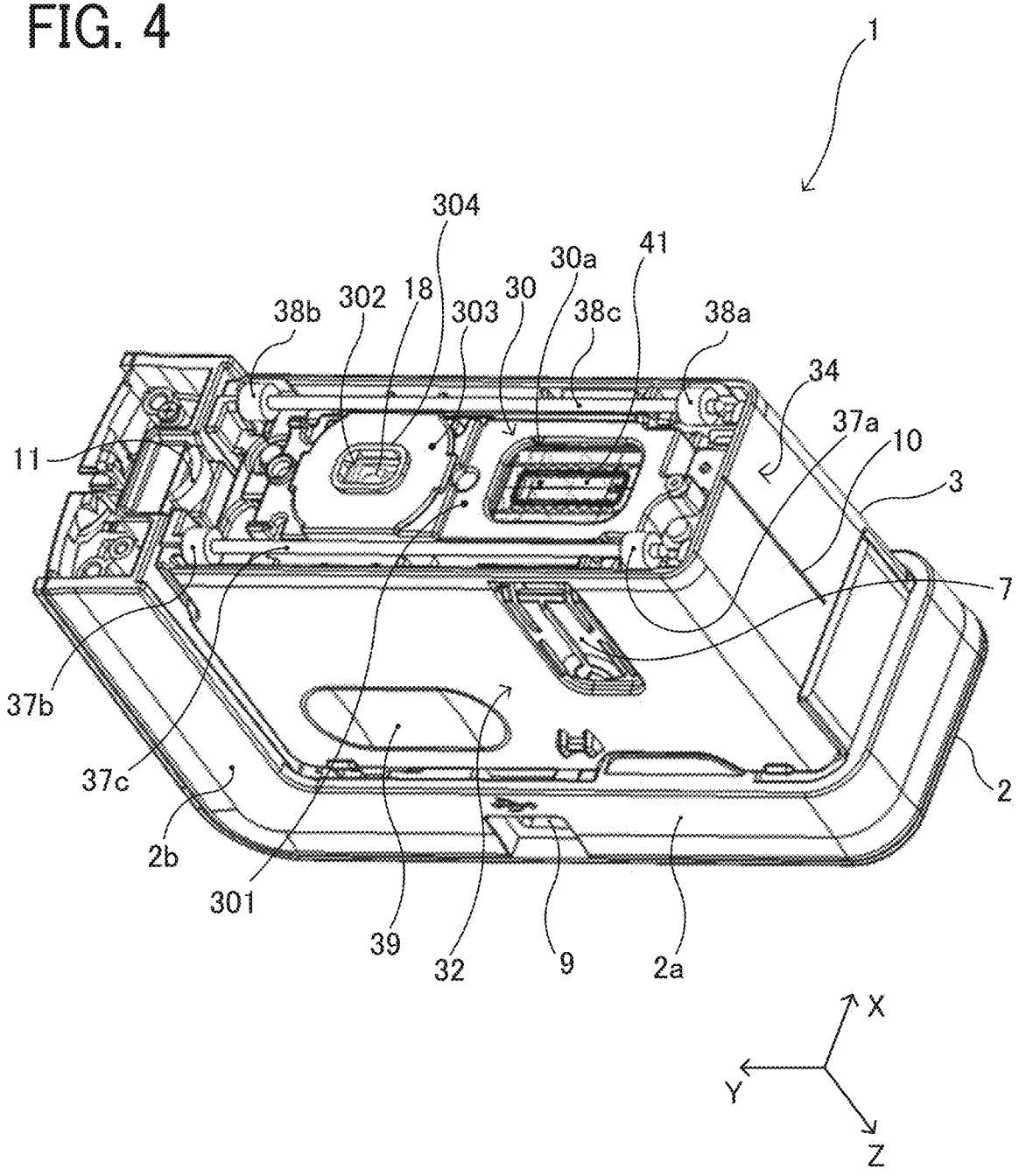
FIG. 4 is a perspective view illustrating the exterior of the handheld printer as viewed obliquely from below.
Figure 5:
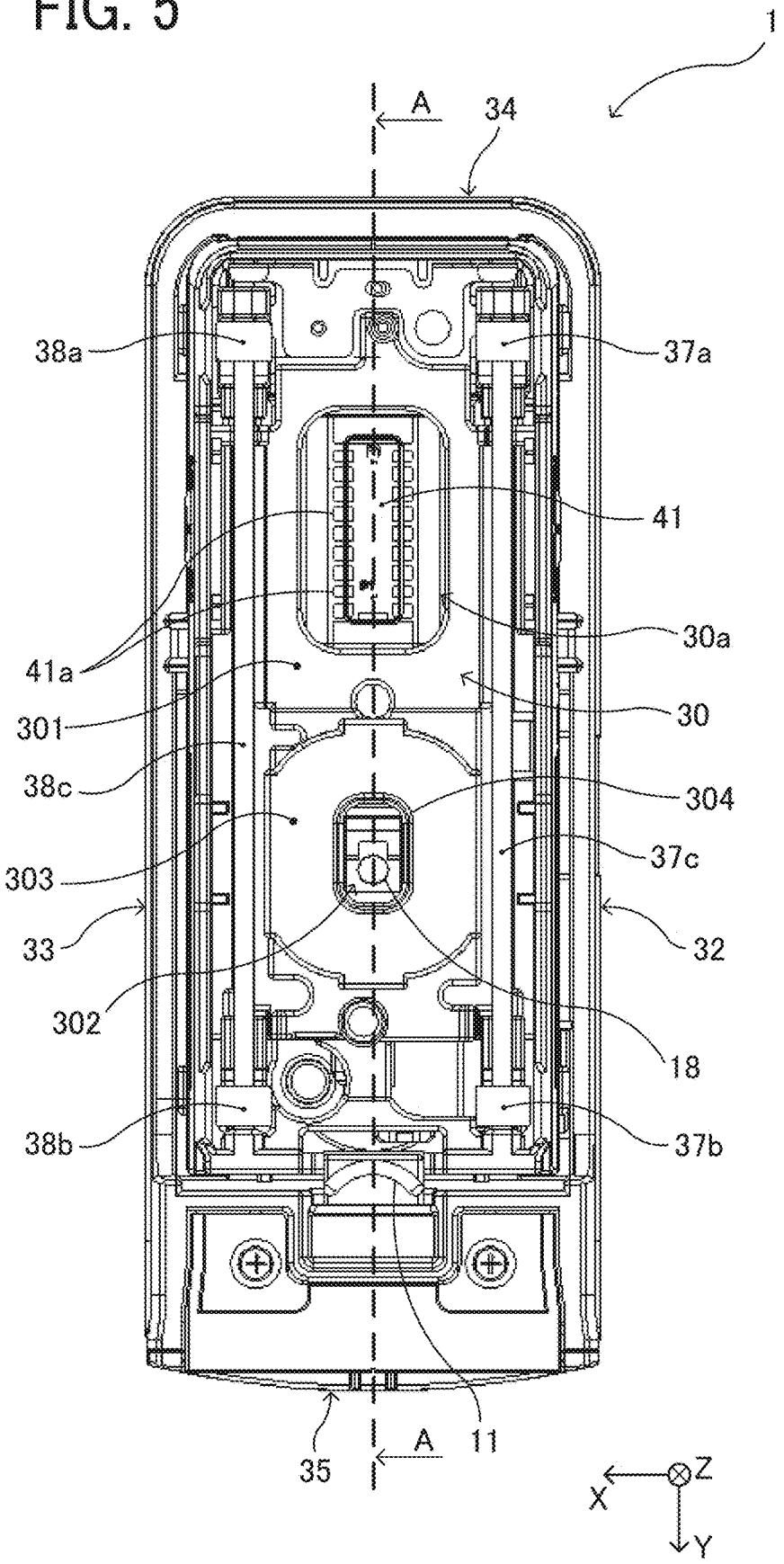
FIG. 5 is a bottom view of the handheld printer.

FIG. 1 is an exterior perspective view of the handheld printer 1 as from above the rear left side, and FIG. 4 is an exterior perspective view of the handheld printer 1 as viewed obliquely from below. FIG. 5 is a bottom view of the handheld printer 1.

As illustrated in FIGS. 1, 3, and 4, the handheld printer 1 includes an upper unit 2 and a lower unit 3. The handheld printer 1 as a whole is shaped like a rectangular parallelepiped. The handheld printer 1 has such a length in a scanning direction (that is, a printing direction or an X-axis direction in drawings) that a user can grasp the handheld printer 1 with a palm.

As illustrated in FIGS. 1, 3, and 4, the lateral direction (a short-side direction) of the body of the handheld printer 1 is defined as X-axis direction, and a longitudinal direction of the body orthogonal to the horizontal direction is defined as a Y-axis direction. In printing operation using the handheld printer 1, to linearly print letters or illustrations, the handheld printer 1 is moved in the X-axis direction, which is the scanning direction. Then, the handheld printer 1 is moved in the Y-axis direction to perform line feed.

However, the printing operation using the handheld printer 1 is not limited to the above-described operation. For a case where letters, illustrations, etc. are arranged attractively, the handheld printer 1 can be moved for printing in an oblique direction other than the X-axis direction or along a curved track. In addition, the handheld printer 1 can be moved in a direction other than the Y-axis direction for line feed.

Figure 6:
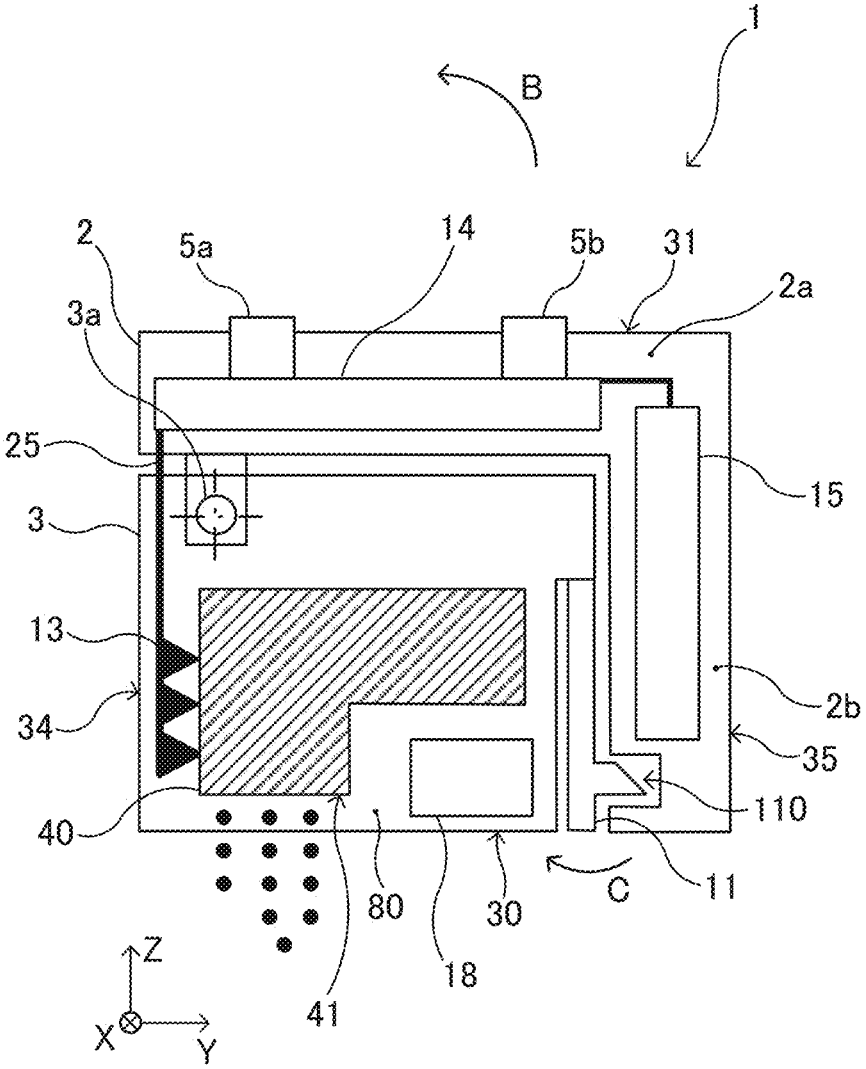
FIG. 6 is a schematic cross-sectional view of the handheld printer as viewed from the left side.

FIG. 6 is a schematic cross-sectional view of the handheld printer 1 as viewed from the left side.

As illustrated in FIG. 6, the upper unit 2 is shaped like a letter "L" and includes a horizontal portion 2*a* extending in the Y-axis direction and a vertical portion 2*b* extending in the Z-axis direction in the drawings. The vertical portion 2*b* of the upper unit 2 contains a battery 15 as a power source to supply power to components of the handheld printer 1. The horizontal portion 2*a* includes a control board 14, and a print button 5*a* and a power button 5*b* are connected to the control board 14. The power button 5*b* is a button for powering on and off the handheld printer 1, and the print button 5*a* is a button for the timing of ink discharge.

The lower unit 3 includes an upper unit rotation shaft 3*a* to rotatably support the upper unit 2, a position detection sensor 18 that is an optical sensor (reflection type), a flexible printed circuit (FPC) contact portion 13, an upper unit lock claw 110, and a housing 80 that supports these components. The position detection sensor 18 detects position coordinates and presence and absence of a print target. The housing 80 of the lower unit 3 contains an ink cartridge 40 (an inkjet head) that includes a recording device 41 (an image forming device) and an ink tank combined into a single unit, and the ink cartridge 40 is removable from the housing 80. The ink cartridge 40 (the inkjet head) is configured to discharge ink from the recording device 41 for image formation. When the handheld printer 1 is used, the recording device 41 to discharge ink droplets are faced down.

As the upper unit 2 is rotated relative to the lower unit 3 in the direction indicated by arrow B in FIG. 6, an opening above the housing 80 of the lower unit 3 is exposed. Then, the ink cartridge 40 disposed therein becomes removable from the housing 80. The above-mentioned lower unit 3 serves as a main body, and the upper unit 2 serves as a cover.

In the handheld printer 1 according to the present embodiment, the battery 15 is disposed on the vertical portion 2*b* of the upper unit 2, and the vertical portion 2*b* is positioned to cover the front face 35 (on the right in FIG. 6) of the lower unit 3. Thus, the battery 15 is located on the front face 35 side of the ink cartridge 40. Therefore, the height of the handheld printer 1 is reduced compared with the configuration in which the battery 15, which is relatively heavy, is positioned above the ink cartridge 40. Such placement lowers the gravitational center (gravity center position) of the handheld printer 1, thus preventing the handheld printer 1 from falling over while being moved.

In the scanning direction (X-axis direction), the size (apparatus width) of the handheld printer 1 is slightly wider than the size of the ink cartridge 40. Minimizing the apparatus width can widen the range in which the handheld printer 1 can be moved in the scanning direction on the surface of the recording medium and maximize a recordable range on the surface of the recording medium.

As illustrated in FIGS. 1 and 3 to 6, the handheld printer 1 has a recording face 30 on which the recording device 41 of the ink cartridge 40 is disposed and to be opposed to a recording medium, such as a paper sheet. The handheld printer 1 further has an upper face 31 on the opposite side of the recording face 30, a left face 32 extending in an orthogonal direction (Y-axis direction in the drawing) orthogonal to the scanning direction of the handheld printer 1, and the like. The handheld printer 1 further has, for example, a right face 33 extending in the orthogonal direction (Y-axis direction) orthogonal to the scanning direction (X-axis direction), a rear face 34 extending in the scanning direction, and a front face 35 extending in the scanning direction. The handheld printer 1 is usually used in such a posture that the recording face 30 is faced vertically down and the upper face 31, which is opposite the recording face 30, is faced vertical up.

The print button 5*a* and the power button 5*b* are disposed within an outer edge (within a frame) of the upper face 31. The left face 32 of the upper unit 2 includes a universal serial bus (USB) connection port 9. The USB connection port 9 is a port for connecting a USB cable. The handheld printer 1 is provided with the rechargeable battery 15 mounted therein. The battery 15 can be charged with electric power supplied thereto from an external power supply via the USB cable connected to the USB connection port 9.

As illustrated in FIGS. 1, 3, and 6, the L-shaped upper unit 2 is disposed to cover the upper face 31 and the front face 35 of the lower unit 3, and the upper unit 2 is wider (longer in the X-axis direction) than the lower unit 3.

Note that a face of the above-described lower unit 3 on the upper face 31 side serves as a first face. Faces of the lower unit 3 on the front face 35 side, the left face 32 side, the right face 33 side, and the rear face 34 side serve as second faces.

Figure 7:
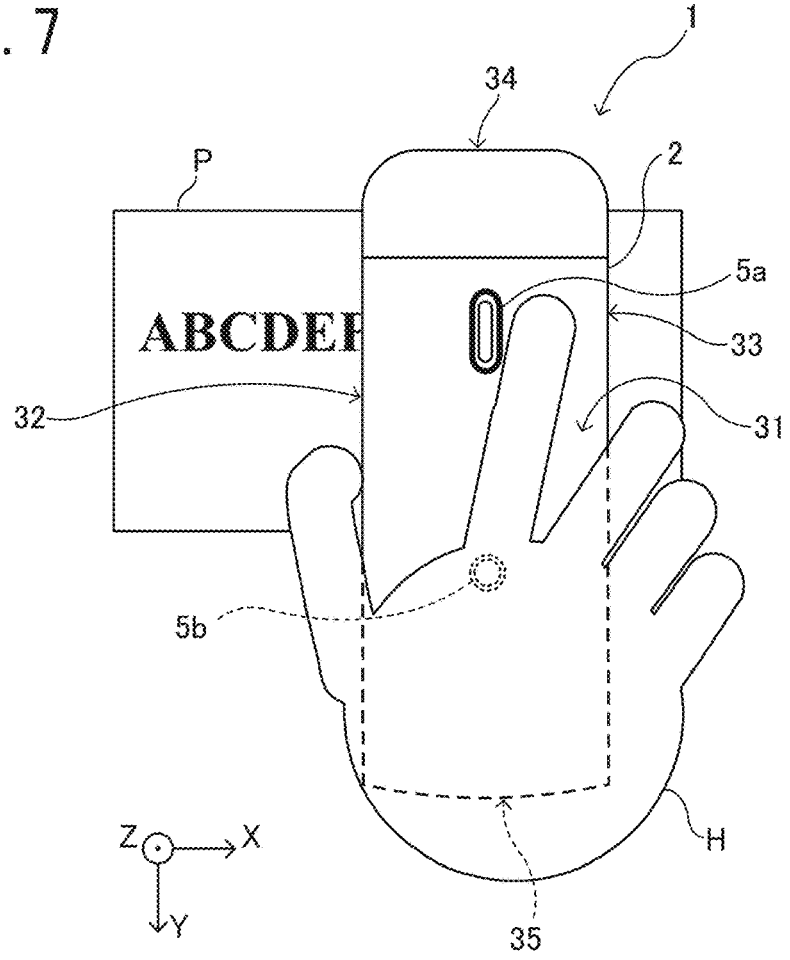
FIG. 7 is an illustration indicating a positional relationship between a hand of a user and the handheld printer being operated by the user.

FIG. 7 is an illustration indicating a positional relationship between a hand H of a user and the handheld printer 1 being operated by the user.

As illustrated in FIG. 7, to move the handheld printer 1 for image formation on the recording medium P in the scanning direction (X-axis direction, lateral in FIG. 7), the user holds the upper unit 2. Since the upper unit 2 is wider than the lower unit 3, the user can easily hold the upper unit 2 with the hand, and the vertical portion 2*b* thereof can serve as a container for the battery 15. Further, as illustrated in FIGS. 1 and 3, the left face 32 and the right face 33 of the lower unit 3 respectively include grip portions 39 that are recesses. The grip portions 39 are disposed, respectively, at positions where fingers (usually a thumb and a middle finger or a ring finger) of the hand H holding the upper unit 2 when the user uses the handheld printer 1. The user can put his or her fingers in the respective grip portions 39 on the left face 32 and the right face 33 with the handheld printer 1 sandwiched between these fingers, thereby holding the handheld printer 1 stably.

The user can hold the power button 5*b* for a while to switch on and off the power of the handheld printer 1. With the power turned on, the control board 14 mounted in the upper unit 2 of the handheld printer 1 can acquire image information with, e.g., a smartphone, by wireless communication using Bluetooth (registered trademark) communication or the like.

Figure 8:
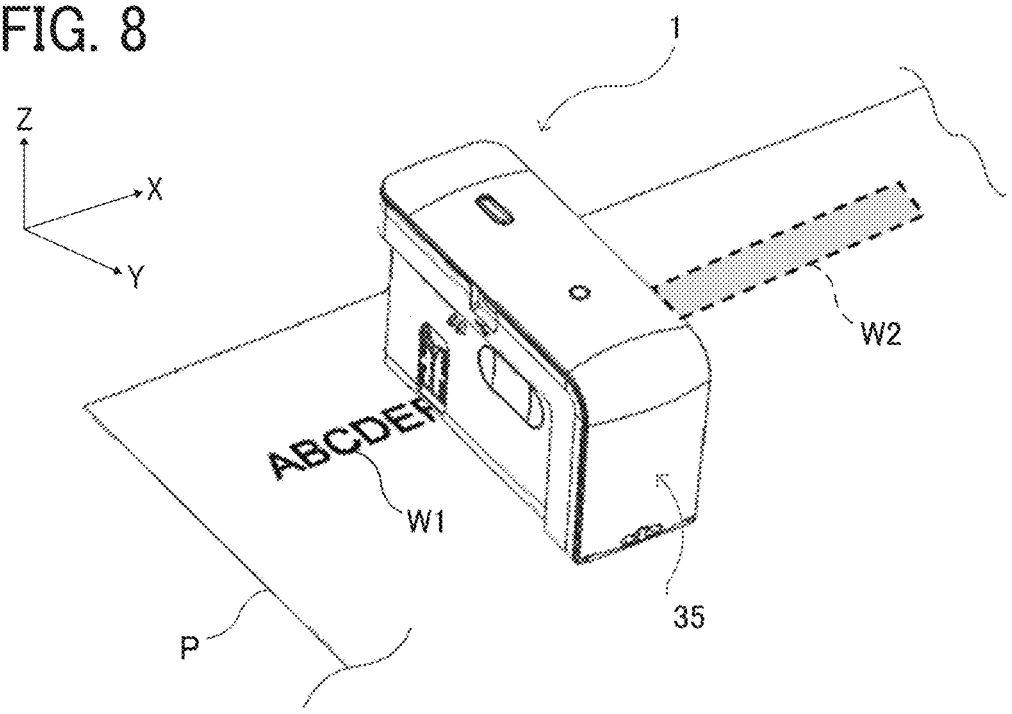
FIG. 8 is a perspective view illustrating how the handheld printer forms an image on a recording medium.

FIG. 8 is a perspective view illustrating how the handheld printer 1 forms an image on the recording medium P.

After the image data is acquired, the handheld printer 1 is placed on the recording sheet P with the recording face 30 opposed to the surface of the recording sheet P. Then, the user presses the print button 5*a* once and moves the handheld printer 1 in the scanning direction as illustrated in FIG. 8, thus forming an image on the recording medium P. As illustrated in FIG. 8, in the image formation by the handheld printer 1, the user can check an already printed portion W1 and a planned print area W2 in which printing is to be made.

The handheld printer 1 can form an image on the surface of the recording medium P both when the user moves the handheld printer 1 (manual scanning) toward one side (right side in FIG. 8) in the scanning direction (X-axis direction and when the user moves the handheld printer 1 to the opposite side (left side in FIG. 8) in the scanning direction. The handheld printer 1 can be configured to discharge ink from the ink cartridge 40 continuously after the user once presses and releases the print button 5*a* or discharge ink from the ink cartridge 40 only while the user presses the print button 5*a*.

The recording medium is not limited to paper, such as recording paper, but includes, for example, overhead projector (OHP) sheets, cloth, cardboards, packaging containers, glass, and substrates.

As illustrated in FIGS. 4 and 5, the face of the lower unit 3 (the lower face of the housing 80) serving as the recording face 30 includes a discharge opening 30*a*. From the discharge opening 30*a*, the recording device 41 of the ink cartridge 40 mounted in the lower unit 3 is exposed to the outside. The recording device 41 of the ink cartridge 40 includes a plurality of discharge nozzles 41*a* (e.g., ports) and is capable of discharging ink droplets separately from the respective discharge nozzles 41*a* as piezoelectric elements are driven.

The width of an image recording area of the recording device 41, that is, the length of the image in the direction (Y-axis direction) orthogonal to the scanning direction, is the distance between the discharge nozzles 41*a* located at both ends of the plurality of discharge nozzles 41*a* in the Y-axis direction.

The ink discharged from the recording device 41 passes through the discharge opening 30*a* and reaches the recording medium P, thus forming an image thereon.

As a driving source to discharge ink, the ink cartridge 40 can employ, for example, an electromechanical transducer element (a piezoelectric actuator) including a lamination-type piezoelectric element or a thin-film-type piezoelectric element. Example configurations of the driving source further include an electrothermal transducer element, such as a heat element, and an electrostatic actuator including a diaphragm and opposed electrodes.

The ink cartridge 40 has a so-called inkjet mechanism to discharge liquid or droplets such as ink to perform recording. Any inkjet mechanism mountable in handheld printer 1 can be used. In the handheld printer 1 according to the present embodiment, the inkjet mechanism corresponds to the recording device 41 that records an image on a recording medium, and the recording device 41 is stored in the housing 80 of the lower unit 3.

The "liquid" discharged from the discharge nozzles 41*a* of the recording device 41 is not particularly limited as long as the liquid has a viscosity and a surface tension that can be discharged from the discharge nozzles 41*a*. However, it is preferable that the viscosity is 30 mPa·s or less under ordinary temperature and pressure or by heating or cooling. Specifically, the term "ink (liquid)" represents, for example, a solution, a suspension, or an emulsion including a solvent, such as water or organic solvent, a colorant, such as a dye or a pigment, a polymerizable compound, a resin, a functional material, such as a surfactant, a biocompatible material, such as deoxyribonucleic acid (DNA), amino acid, protein, or calcium, or an edible material, such as a natural colorant. Such a solution, a suspension, or an emulsion can be used for, e.g., inkjet ink, a surface treatment liquid, liquid for forming components of electronic elements or light-emitting elements, liquid for forming resist patterns of electronic circuits, or a material solution for three-dimensional fabrication.

Inside the outer edge of the recording face 30, the position detection sensor 18 as a detector is disposed. The position detection sensor 18 contactlessly detects the position of the handheld printer 1 on the recording medium P. The lower face of the housing 80 serving as the recording face 30 is provided with a detection opening 302 to expose a detection portion of the position detection sensor 18.

In the case of a contact type sensor using a rotary encoder or the like, the sensor needs to be in contact with the print surface, and a detection error due to the contact state is likely to occur. Specifically, when the detection portion of the contact type sensor separates from or slips on the print surface, the actual travel distance differs from the travel distance calculated based on the detection result, which is a detection error. By contrast, the accuracy of detection is higher when the optical sensor as the position detection sensor 18 detects the print surface contactlessly.

Further, inside the outer edge of the recording face 30, a first left roller 37*a*, a second left roller 37*b*, a first right roller 38*a*, and a second right roller 38*b* are disposed and rotatably attached to the housing 80. The first left roller 37*a* and the second left roller 37*b* are secured to a left rotation shaft 37*c*, and the left rotation shaft 37*c* is rotatably held by the housing 80. Similarly, the first right roller 38*a* and the second right roller 38*b* are secured to a right rotation shaft 38*c*, and the right rotation shaft 38*c* is rotatably held by the housing 80.

When the handheld printer 1 is moved in the scanning direction by the user, the four rollers (37*a*, 37*b*, 38*a*, and 38*b*) in contact with the surface of the recording medium P rotate like tires. Owing to such rollers, the user can advance the handheld printer 1 straight in the scanning direction. When the handheld printer 1 is moved straight in the scanning direction, only the four rollers (37*a*, 37*b*, 38*a*, and 38*b*) provided on the handheld printer 1 are in contact with the surface of the recording medium P or the surface of the table on which the recording medium P is placed. The recording face 30 is not in contact with the surface of the recording medium P. Therefore, the user can move the handheld printer 1 straight along the scanning direction while keeping a constant distance between the recording device 41 of the ink cartridge 40 and the surface of the recording medium P. Thus, a desired high-quality image can be formed. That is, the four rollers guide the movement of the handheld printer 1 in the scanning direction and assist the linear movement in the scanning direction.

The position detection sensor 18 is a sensor to detect the distance to the surface of the recording medium P, the surface state (for example, asperities) of the recording medium P, and the distance by which the handheld printer 1 has traveled. The position detection sensor 18 is similar to a sensor used for, for example, an optical mouse (a pointing device) of a personal computer. The position detection sensor 18 irradiates, with light, a place (e.g., the recording medium P) where the position detection sensor 18 is placed and reads the state of the place as a "pattern". The position detection sensor 18 sequentially detects how the "pattern" moves relative to the movement of the position detection sensor 18, to calculate the amount of movement. As the position detection sensor 18, any sensor other than an optical sensor such as an ultrasonic sensor can be used as long as a change in position with respect to the recording medium P can be detected contactlessly. The position detection device of mobile image forming apparatuses, such as handheld printer 1, to which aspects of the present disclosure can be applied is not limited to a contactless sensor such as the position detection sensor 18, but can be a contact-type sensor using a rotary encoder or the like.

Figure 9:
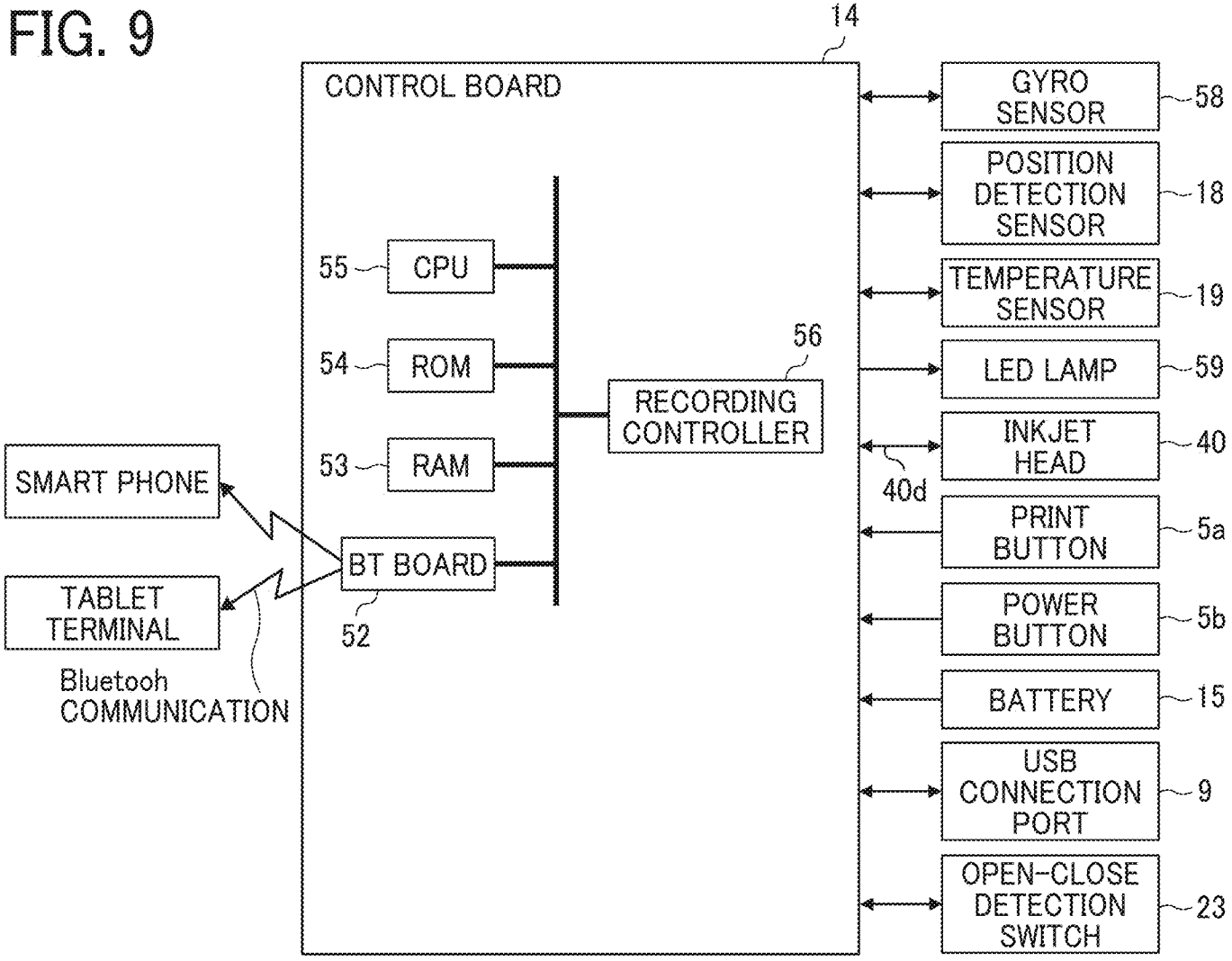
FIG. 9 is a block diagram illustrating a part of an electric circuit of the handheld printer, according to an embodiment.

FIG. 9 is a block diagram illustrating a portion of an electric circuit of the handheld printer 1.

The control board 14 includes a center processing unit (CPU) 55 that performs various arithmetic processing and program execution, a Bluetooth (registered trademark, hereinafter "BT") board 52 for short-range wireless communication using Bluetooth, a random access memory (RAM) 53 that temporarily stores data, a read-only memory (ROM) 54, and a recording controller 56. The control board 14 is secured at a position on the inner side of the USB connection port 9 in a hollow space of the upper unit 2.

The BT board 52 performs data communication by short-range wireless communication with an external device, such as a smartphone or a tablet terminal. The ROM 54 stores, for example, firmware for hardware control of the handheld printer 1 and drive waveform data of the ink cartridge 40. The recording controller 56 executes data processing for driving the ink cartridge 40 and generates drive waveforms.

The control board 14 is electrically connected to a gyro sensor 58, the position detection sensor 18, a temperature sensor 19, a light emitting diode (LED) lamp 59, the ink cartridge 40, the print button 5*a*, the power button 5*b*, the battery 15, and the like. The gyro sensor 58 detects a tilt and a rotation angle of the handheld printer 1 and transmits the result of detection to the control board 14. The LED lamp 59 is disposed inside an exterior cover made of a light transmissive material of the print button 5*a* and makes the print button 5*a* luminous.

When the power button 5*b* is pressed to turn on the power of the handheld printer 1, power is supplied to each module. The CPU 55 initiates startup according to the program stored in the ROM 54 and loads the program and each data in the RAM 53. When data of an image to be formed is received from an external device by short-range wireless communication, the recording controller 56 generates a drive waveform corresponding to the image data. The discharge of ink from the ink cartridge 40 is controlled to form an image corresponding to the position on the surface of the recording medium P detected by the position detection sensor 18.

The position detection sensor 18 detects the direction and the speed of movement of the handheld printer 1 and the distance by which the handheld printer 1 has traveled. The discharge amount of ink and the discharge position of ink are adjusted based on the detection result of the position detection sensor 18, thereby printing a target image. Further, the discharge start position can be adjusted using sub-scanning guides 7 provided on the left face 32 and the right face 33 of the housing 80 and a main scanning guide 10 provided on the rear face 34 of the housing 80. Specifically, the main scanning guide 10 is used to align the position of the handheld printer 1 on the recording sheet P in the main scanning direction (X-axis direction in the figure), and the sub-scanning guide 7 is used to align the position of the handheld printer 1 on the recording sheet P in the sub-scanning direction (Y-axis direction). Thus, the discharge start position can be adjusted.

In response to acquisition of image data via short-range wireless communication from an external device, the control board 14 causes the LED lamp 59 to blink so that the light transmissive print button 5*a*, which transmits light, becomes luminous and blinks. Seeing such light blinking, the user knows the completion of the acquisition of the image data. Then, the user places the handheld printer 1 on the recording medium P and presses the print button 5*a*.

Meanwhile, as the control board 14 starts blinking of the LED lamp 59, the control board 14 waits for pressing of the print button 5*a*. When the print button 5*a* is pressed, the control board 14 causes the LED lamp 59 to keep emitting light so that the print button 5*a* continuously emits light. Seeing the continuous light emission, the user starts moving the handheld printer 1 (manual scanning) in the scanning direction.

The user who has finished moving the handheld printer 1 (manual scanning) again presses the print button 5*a*. With such an operation, the control board 14 turns off the LED lamp 59 and stops lighting of the print button 5*a*. Or, there may be a case where the user does not press the print button 5*a* but picks up the handheld printer 1 from the recording medium P and places the handheld printer 1 on, for example, a table or mounts the handheld printer 1 in a cover that covers the recording face 30. In these cases, the position detection sensor 18 becomes incapable of detecting the position when the handheld printer 1 is picked up from the recording medium P. At the timing when the position detection sensor 18 no longer detects the position, the control board 14 turns off the LED lamp 59 and stops lighting of the print button 5*a*. Seeing the stop of lighting, the user knows that the operation of the handheld printer 1 for printing has ended.

It is not necessary to keep pushing the print button 5*a* while the user moves the handheld printer 1 (manual scanning). When the print button 5*a* is pressed and released prior to the moving of the handheld printer 1, printing operation is continued until a predetermined timing. Examples of the predetermined timing includes a timing when the image formation based on the detection result by the position detection sensor 18 ends, the timing when the print button 5*a* is pressed again, and the timing when the position detection sensor 18 becomes incapable of position detection.

When the image formation is not performed, such as after the image formation is completed, the capping unit 8 is attached to the handheld printer 1. Thereby, the drying of the ink in the discharge nozzles 41*a* can be prevented.

Next, the shape of the upper unit 2 of the handheld printer 1 according to the present embodiment will be described.

The handheld printer 1 includes the lower unit 3 and the upper unit 2. The lower unit 3 is an apparatus main body including the recording device 41. The upper unit 2 serves as a cover to open and close the face of the lower unit 3 opposite the recording face 30 (at the bottom of the housing 80), which is the location of the recording device 41 in the lower unit 3. That is, the upper unit 2 is the cover for the opening at the top of the housing 80.

As illustrated in FIGS. 3 to 4 and 6, the upper unit 2 is "L-shaped" and includes the horizontal portion 2*a* and the vertical portion 2*b*. The horizontal portion 2*a* is a first cover portion that covers the upper side of the housing 80 opposite to the bottom side of the housing 80 of the lower unit 3 on which the recording device 41 is disposed. The vertical portion 2*b* extends from the horizontal portion 2*a* to the side (downward) of the recording face 30 side. The vertical portion 2*b* is a second cover portion that covers at least a portion of the side face (the left face 32, the right face 33, the rear face 34, or the front face 35) of the lower unit 3 between the bottom side and the upper side of the lower unit 3.

As a mobile (or portable) image forming apparatus such as handheld printer 1, printers that are manually moved for printing (manual scanning) are known for printing on books or notebooks printing on which are difficult for conventional inkjet printers.

To a printer body of such a mobile printer, a head cartridge in which an ink tank and a head are combined can be mounted. That is, the printer body includes a space to accommodate the heard cartridge and has an opening for attachment of the heard cartridge.

It is assumed that the cover is provided only on the upper side of the main body (corresponding to the lower unit 3 according to the present embodiment) forming a space for the head cartridge. In such a case, to open and close the cover, the opening and closing force is given by holding only the upper side of the main body, and the usability may deteriorate.

In the handheld printer 1 according to the present embodiment, the upper unit 2 as the cover is L-shaped, and includes the vertical portion 2*b* extending from the horizontal portion 2*a* to the side (downward) of the recording face. Owing to the vertical portion 2*b*, not only the horizontal portion 2*a* but also the vertical portion 2*b* can be touched with the hand and the force for opening or closing can be applied to both thereof, in order to open or close the upper unit 2 as the cover. Therefore, the user can hold one or both of the horizontal portion 2*a*, which is on the side opposite the recording face 30 in the handheld printer 1, and the vertical portion 2*b*, which is on a lateral side of the recording face 30, to open or close the upper unit 2 as the cover. That is, the user can hold one or both of the two portions to which the opening or closing force can be easily applied. Thus, the ease of operation in opening and closing the upper unit 2 can be improved.

Further, there is a configuration in which a relatively heavy battery is disposed in the upper part of the mobile image forming apparatus and in parallel to the recording face. In the configuration in which the battery is disposed in the upper part of the mobile image forming apparatus, the center of gravity is located in the upper part of the apparatus, and the apparatus can easily fall. Accordingly, the usability of the apparatus or the usability may be deteriorated.

By contrast, in the handheld printer 1 according to the present embodiment, as illustrated in FIG. 6, the battery 15 is disposed in the vertical portion 2*b* which is a portion of the L-shaped upper unit 2 and extends in the vertical direction of the handheld printer 1. As a result, the relatively heavy battery 15 can be disposed on a lateral side of the lower unit 3, not above the lower unit 3. Further, the longitudinal direction of the battery 15, the specific gravity of which is relatively large, can be in the height direction of the handheld printer 1. Therefore, the gravitational center of the entire printer can be lowered. This feature can attain the effect that the handheld printer 1 does not easily fall and the usability is improved.

Improving the usability is advantageous in preventing the deterioration of the quality of printed images caused by the impaired usability of the handheld printer 1.

Here, the reason for disposing the battery 15 in the vertical portion 2*b* of the L-shaped upper unit 2 will be briefly described. In the handheld printer 1 according to the present invention, there are three possible locations for the battery 15 other than the vertical portion 2*b*.

The first location is on the front face 35 side of the lower unit 3. In this case, the horizontal portion 2*a* and the vertical portion 2*b* of the upper unit 2 are separated, and the vertical portion 2*b* is disposed on the front face 35 side of the lower unit 3.

The second location is on the upper face 31 side of the lower unit 3. In this case, the battery 15 is disposed in the horizontal portion 2*a* of the upper unit 2, and the control board 14 is disposed in the vertical portion 2*b*. That is, the positions of the battery 15 and the control board 14 are interchanged.

The third location is on the rear face 34 side of the lower unit 3.

However, these three installation locations have disadvantages as explained below.

Regarding the first location (on the front face 35 side of the lower unit 3), the control board 14 and the battery 15 should be connected with each other by a harness. Therefore, if the battery 15 is disposed separately from the control board 14 at the rear end of the lower unit 3 (the main body), the harness inevitably pass through the upper unit rotation shaft 3*a* of the upper unit 2 at the front end of the lower unit 3, to connect the battery 15 with the control board 14. Such a manner of connecting increases the length of the harness and the cost of the harness.

In addition, when the harness is long, the route of the harness becomes complicated, and the number of assembling steps increases, resulting in increases in the cost. Further, since the route of the harness extending from the battery 15, which is positioned at the rear end of the lower unit 3, to the upper unit rotation shaft 3*a*, which is at the front end of the lower unit 3, is provided somewhere in the lower unit 3 as described above, the lower unit 3 is increased in size to secure the space for the route of the harness, thus making the handheld printer 1 bulkier.

Regarding the second location (on the upper face 31 side of the lower unit 3, if the battery 15 is disposed in the horizontal portion 2*a* of the upper unit 2 and the control board 14 is disposed in the vertical portion 2*b*, the print button 5*a* and the power button 5*b* which are in set with the control board 14 are inevitably disposed on the front face 35 side of the lower unit 3, and the usability at the time of printing of the handheld printer 1 is significantly impaired. In order to solve this problem, a separate control board for the print button 5*a* and the power button 5*b* may be further provided above the battery 15 disposed in the horizontal portion 2*a*. Such an arrangement, however, increase the height of the upper unit 2 in order to secure the installation space of the control board 14. As a result, the overall height of the handheld printer 1 is increased, making the handheld printer 1 bulkier.

Furthermore, since the battery 15 is positioned in the upper part of the handheld printer 1, the gravitational center of the entire apparatus is high, and the apparatus can easily fall during printing operation, thus degrading the usability.

Regarding the third location (on the rear face 34 side of the lower unit 3), similar to the first location described above, the battery 15 and the control board 14 are separated. Accordingly, the harness connecting the two becomes longer. At the same time, since the harness inevitably passes through the upper unit rotation shaft 3*a*, the route of the harness becomes complicated. This leads to an increase in cost due to the increased length of the harness and the increase in the number of assembling steps, resulting in increases in the cost.

Additionally, the position of the inkjet head (the print position) is desirably in an upper portion in the longitudinal direction of the handheld printer 1 from the viewpoint of the usability. The reason is that the margin at the top of the print is reduced when the print position is positioned in the upper portion of the handheld printer 1 in the longitudinal direction. Generally, the print is generally made with the top alignment, and it is preferable that the top margin is smaller than the bottom margin. Accordingly, the position of the inkjet head (the print position) is desirably positioned in the upper portion in the longitudinal direction of the handheld printer 1.

However, when the battery 15 is disposed at the front end of the lower unit 3, the longitudinal dimension of the handheld printer 1 becomes large, and the print position is relatively shifted to the center side in the longitudinal direction of the handheld printer 1. Such an arrangement may cause discomfort for the user from the viewpoint of the usability, which leads to the deterioration of the usability and deterioration of print quality.

The mobile image forming apparatus is preferably provided with a lock mechanism (e.g., the upper unit lock claw 110 according to the present embodiment) to lock the cover to the main body so that the cover is not opened or closed during the image forming operation. However, if the cover extends only on the upper side of the main body, an operated portion (e.g., a lever) of the lock mechanism is disposed on the lateral side (the right side, the left side, the front side, and the rear side) or the upper side of the main body. In this structure, however, the operated portion of the lock mechanism is in the reach of the user hand in a state in which the printer is placed on the sheet, and it is possible that, during the image forming operation, the user erroneously operates the lock mechanism and releases the lock of the cover.

In the handheld printer 1 according to the present embodiment, the lower end of the vertical portion 2*b* forms a portion of the recording face 30, and the position, in the direction from the upper face 31 toward the recording face 30, of the lower end portion of the vertical portion 2*b* is the same as the lower face of the housing 80. The lower face of the housing 80 includes the discharge opening 30*a*, and an upper unit lock claw 110 as the lock mechanism is disposed on the recording face 30 which is on the same plane as the discharge opening 30*a*. The upper unit lock claw 110 includes an operated portion 11 (e.g., a lever) to be operated to release the lock of the upper unit 2 from the lower unit 3.

The recording face 30 provided with the discharge opening 30*a* is the bottom side of the handheld printer 1, and the recording face 30 faces the paper surface in the state in which the handheld printer 1 is placed on the paper sheet. Accordingly, the user can be prevented from touching the operated portion 11 of the upper unit lock claw 110 positioned on the recording face 30. This arrangement can prevent the user from erroneously operating the operated portion 11 of the upper unit lock claw 110 during the image forming operation (during printing operation) and prevent the upper unit 2 from being released due to the erroneous operation.

Arranging the operated portion 11 of the upper unit lock claw 110 on the lower face of the handheld printer 1 is advantageous in preventing the user from touching the operated portion 11, not only during printing operation, but also at an unintended timing, such as when the user touches the handheld printer 1 without aim. This can reduce the possibility that the upper unit 2 may be released at an unintended timing.

The configuration to prevent the user from erroneously operating the lock mechanism during the image forming operation is not limited to the configuration in which the lower end of the vertical portion 2*b* is at the same position as the lower face of the housing 80. As long as the shape includes the vertical portion 2*b*, the locking mechanism can be disposed on the lower face serving as the lower end of the vertical portion 2*b* or the lateral side face of the housing 80 adjacent to the lower face, thereby preventing the user from touching the locking mechanism with the vertical portion 2*b*. By inhibiting the user from touching the lock mechanism, this configuration can prevent the user from erroneously operating the lock mechanism during the image forming operation.

As illustrated in FIG. 1, the upper view in FIG. 3, and FIG. 4, a grip portion 39 is provided on each of the left face 32 and the right face 33. It is desirable that the grip portion 39 be disposed at the gravitational center on the Y-Z plane of the handheld printer 1. Specifically, the gravitational center on the Y-Z plane of the handheld printer 1 is disposed so as to be positioned inside the grip portion 39 on the Y-Z plane. The following effect can be attained by providing the grip portion 39, in which the user puts his or her finger to grip the handheld printer 1, in the vicinity of the gravitational center of the handheld printer 1. The user can be guided to grip the vicinity of the gravitational center of the handheld printer 1, so that the user can smoothly operate the handheld printer 1.

Next, the operation to taking out the ink cartridge 40 from the handheld printer 1 according to the present embodiment will be described.

Figure 10:
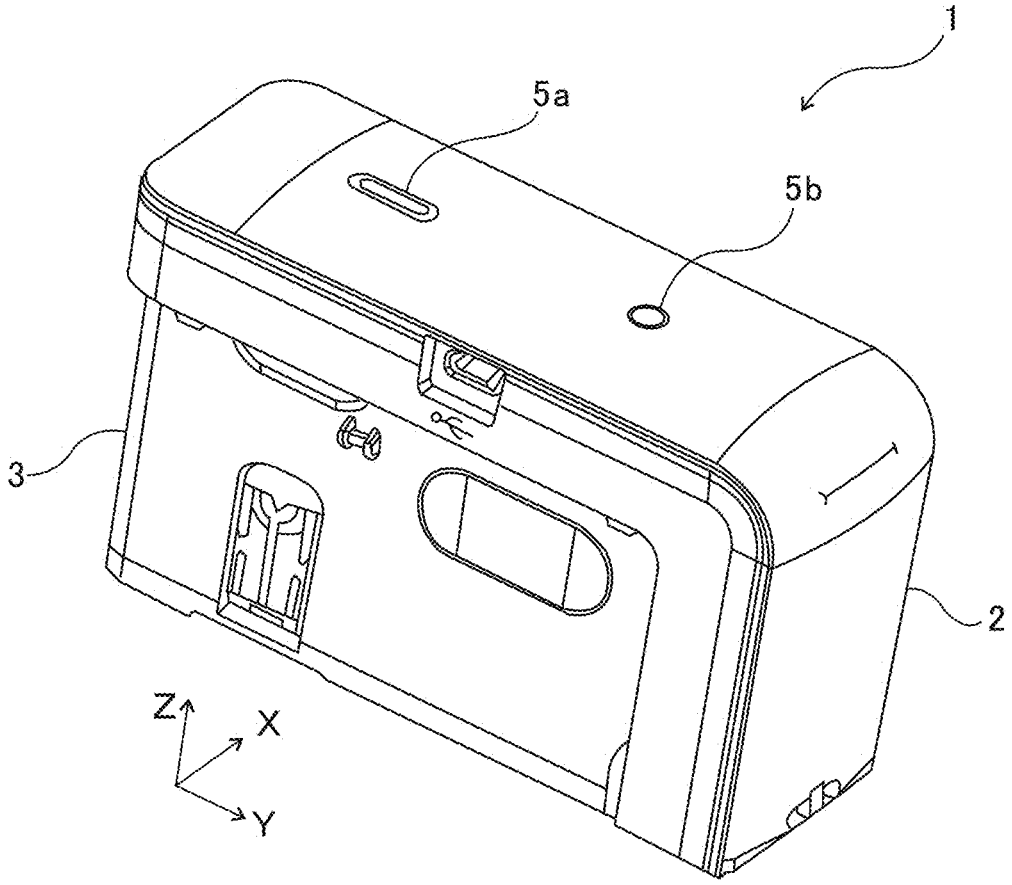
FIG. 10 is an exterior perspective view illustrating the handheld printer as viewed from above on a front left side.
Figure 11:
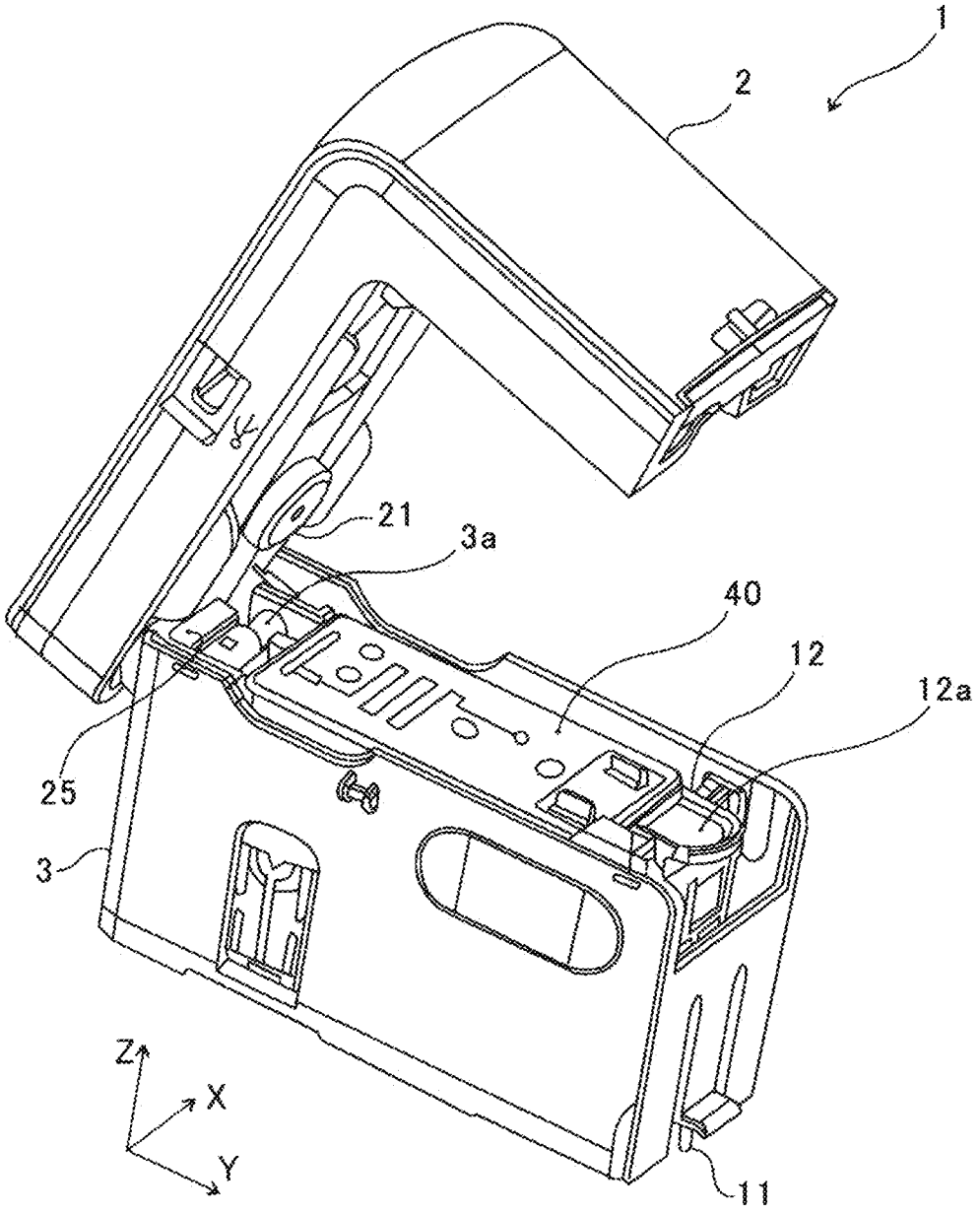
FIG. 11 is an exterior perspective view of the handheld printer with an upper unit thereof opened.

FIG. 10 is an exterior perspective view of the handheld printer 1 as viewed from the upper left on the front side. FIG. 11 is a perspective view of the handheld printer 1 in a state in which the upper unit 2 is rotated in the direction indicated by arrow B illustrated in FIG. 6, with respect to the lower unit 3, from the state illustrated in FIG. 10.

As illustrated in FIGS. 4, 5, and 6, on the recording face 30 of the handheld printer 1, the operated portion 11 of the upper unit lock claw 110 is disposed near the boundary between the lower unit 3 (the lower face of the housing 80) and the upper unit 2 (the lower face of the vertical portion 2*b*). The operated portion 11 of the upper unit lock claw 110 is moved (e.g., pushed) in the direction indicated by arrow C in FIG. 6, to release the lock of the upper unit 2 relative to the lower unit 3. In such a released state, the upper unit 2 is rotated, relative to the lower unit 3, around the lower unit rotation shaft 3*a* in the direction indicated by arrow B in FIG. 6. Then, the upper unit 2 is open as illustrated in FIG. 11.

As illustrated in FIG. 11, when the upper unit 2 is in the open state, the ink cartridge 40 and a cartridge attaching and detaching mechanism 12 are exposed. As illustrated in FIG. 11, on the inner face of the upper unit 2, a head pressing member 21 to press and hold the ink cartridge 40 mounted in the lower unit 3 is attached.

Figure 12:
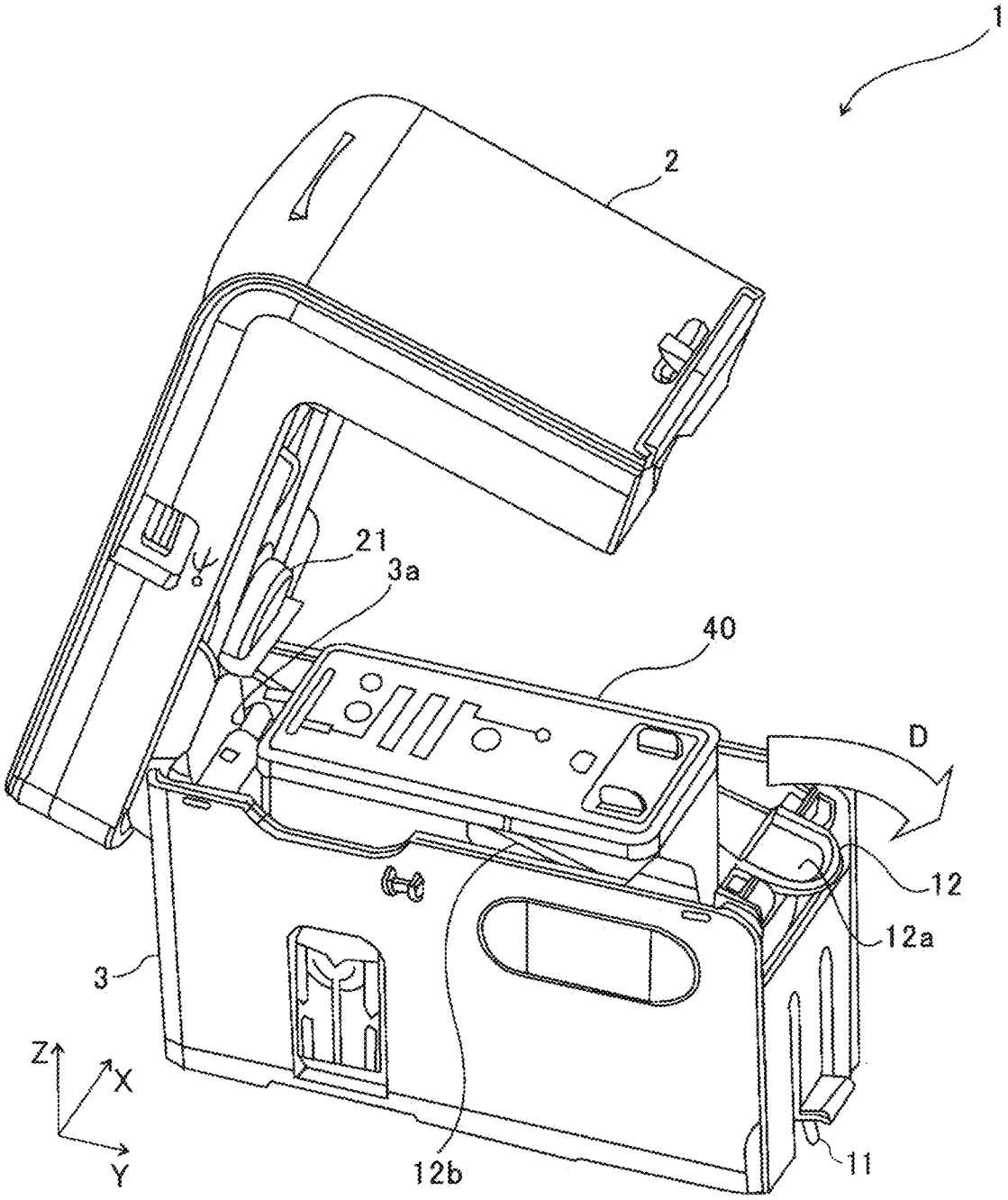
FIG. 12 is a perspective view illustrating a state of the handheld printer in which an ink cartridge pops up.

FIG. 12 is a perspective view of the handheld printer 1 in a state in which the ink cartridge 40 is pushed up by operating an operated portion 12*a* (e.g., a lever, a handle, etc.) of the cartridge attaching and detaching mechanism 12 of the handheld printer 1 in the state illustrated in FIG. 11.

As the operated portion 12*a* of the cartridge attaching and detaching mechanism 12 is pulled to the front side (toward the front face 35 in FIG. 6) as indicated by arrow D in FIG. 12 the ink cartridge 40 in the state illustrated in FIG. 11 pops up as illustrated in FIG. 12. Then, the ink cartridge 40 can be removed.

Figure 13:
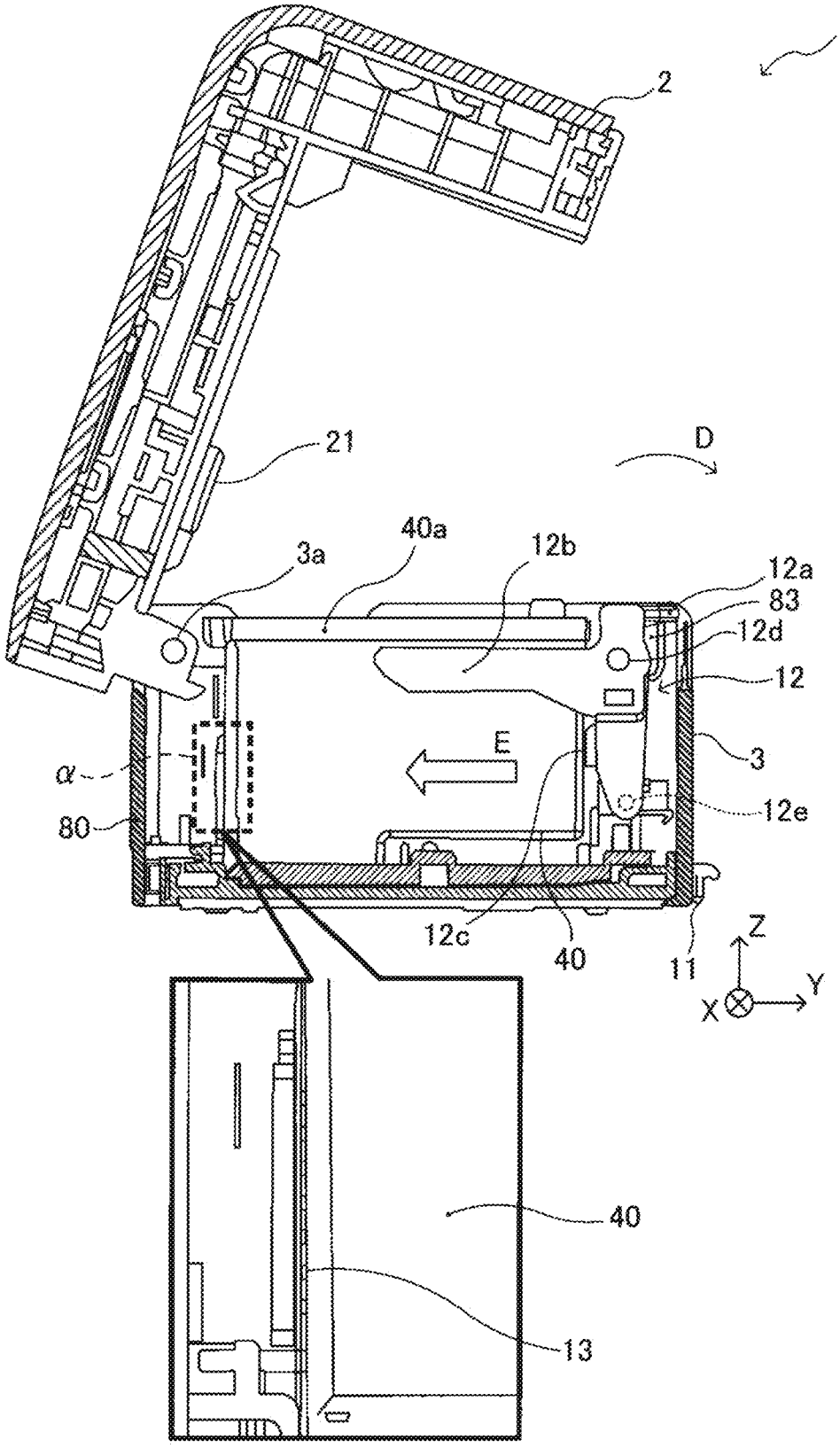
FIG. 13 is a cross-sectional view, from a side, of the handheld printer illustrated in FIG. 11.

FIG. 13 is a cross-sectional view of the handheld printer 1 illustrated in FIG. 11 as viewed from the left face 32 side. Specifically, FIG. 13 illustrates a cross section at the position of the inner side of the wall on the left face 32 side of the housing 80. The upper section of FIG. 13 is a cross-sectional view of the entire handheld printer 1, and the lower section of FIG. 13 is an enlarged cross-sectional view of a region "α" indicated by broken lines in the upper section of FIG. 13.

As illustrated in FIG. 13, the cartridge attaching and detaching mechanism 12 further includes a pressing portion 12*c*. The pressing portion 12*c* presses the lateral side face of the ink cartridge 40 on the front side (right side in FIG. 13), thereby pressing the ink cartridge 40 to the rear side (left side in FIG. 13) as illustrated by the arrow E in FIG. 13. Thus, the contact of the ink cartridge 40 is pressed to the FPC contact portion 13 fixed to the main body of the handheld printer 1.

Figure 14:
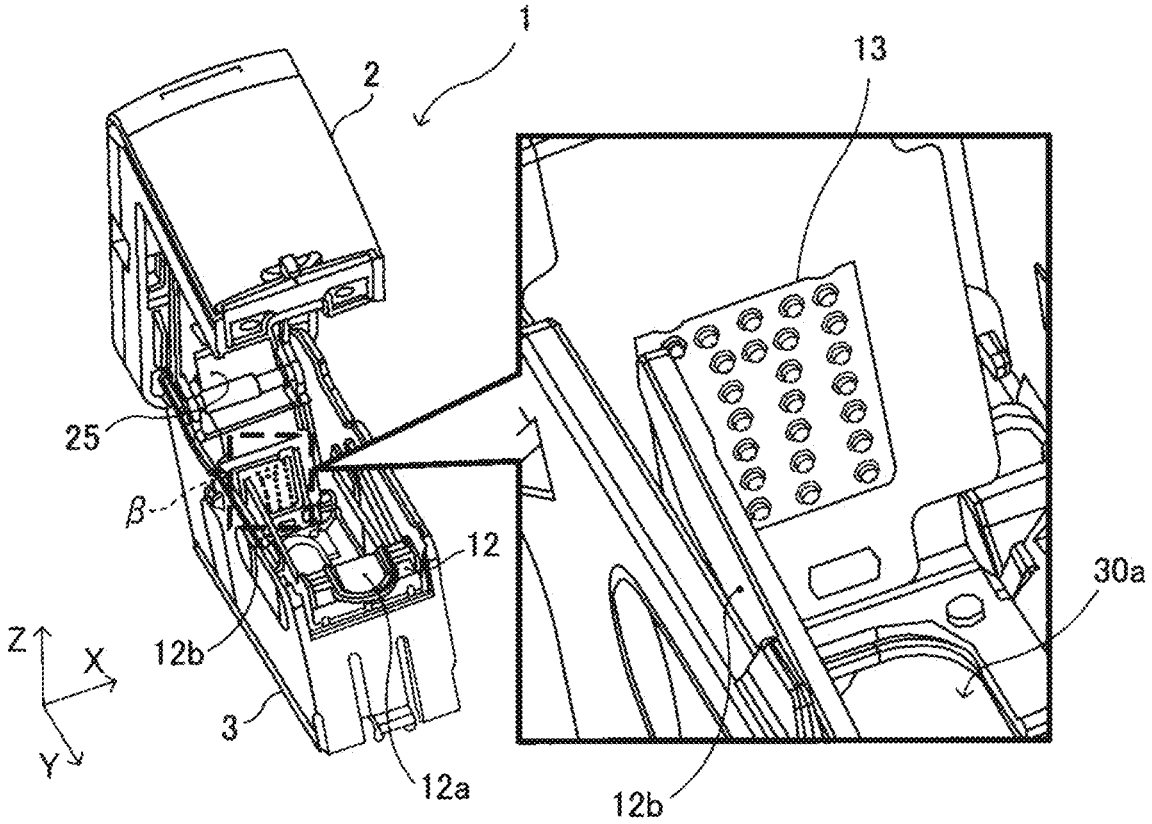
FIG. 14 is a perspective view of the handheld printer with the ink cartridge removed.

FIG. 14 is a perspective view of the handheld printer 1 in the state in which the upper unit 2 is open and the ink cartridge 40 is removed, as viewed obliquely above on the front side. The left section of FIG. 14 is a cross-sectional view of the entire handheld printer 1, and the right section of FIG. 14 is an enlarged cross-sectional view of a region "β" indicated by broken lines in the left section of FIG. 14.

As illustrated in FIG. 14, the FPC contact portion 13 is disposed on the inner wall surface on the rear side of the space where the ink cartridge 40 is disposed in the lower unit 3.

Figure 15A:
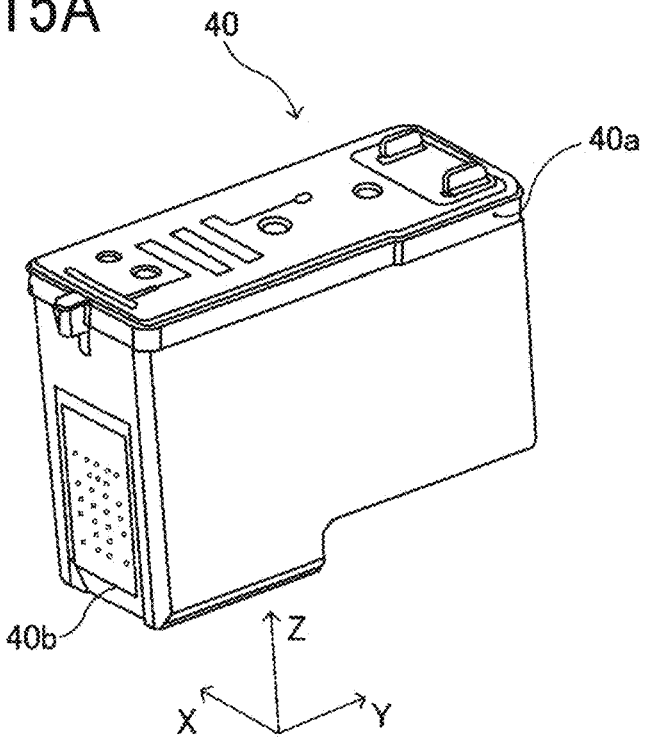
FIGS. 15A and 15B are perspective views illustrating the ink cartridge.
Figure 15B:
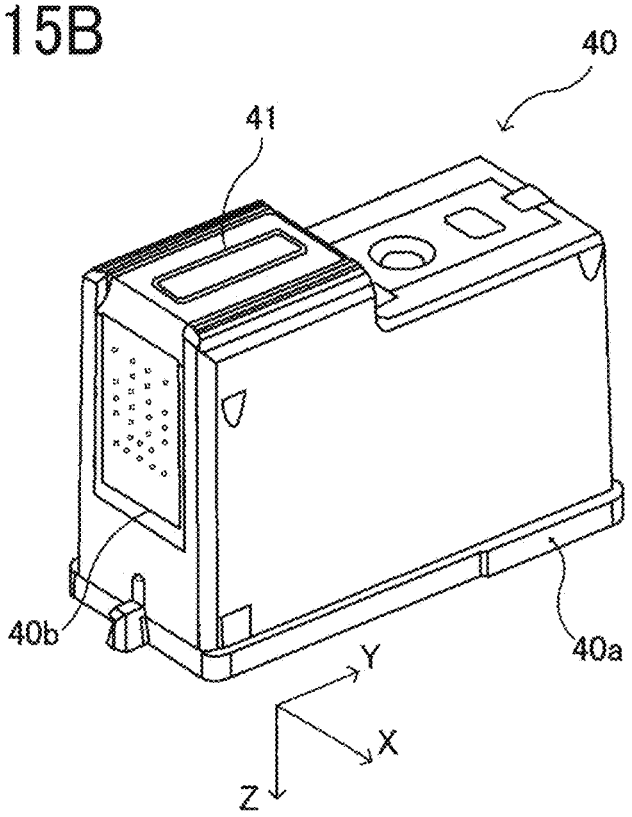

FIGS. 15A and 15B are perspective views of the ink cartridge 40. FIG. 15A is a perspective view of the ink cartridge 40 as viewed from above on the rear left side, and FIG. 15B is a perspective view of the ink cartridge 40 as viewed from below on the rear right side. As illustrated in FIGS. 15A and 15B, a cartridge contact portion 40*b* is disposed on the outer wall surface on the rear side of the ink cartridge 40.

When the ink cartridge 40 is mounted on the lower unit 3 and the FPC contact portion 13 is electrically connected with the cartridge contact portion 40*b*, power is supplied from the power source (the battery 15) to the ink cartridge 40. Further, an electrical signal for controlling the ink cartridge 40 is transmitted to the ink cartridge 40.

As illustrated in FIGS. 6, 11, and 14, a flexible flat cable 25 is disposed on the rear face 34 side of the upper unit rotation shaft 3*a*. The flexible flat cable 25 connects the control board 14 in the upper unit 2 to the FPC contact portion 13 in the lower unit 3. The flexible flat cable 25 can be deformed in accordance with the opening and closing operation of the upper unit 2, and the connection between the control board 14 and the FPC contact portion 13 can be maintained even when the opening and closing operation of the upper unit 2 is repeated.

Figure 16:
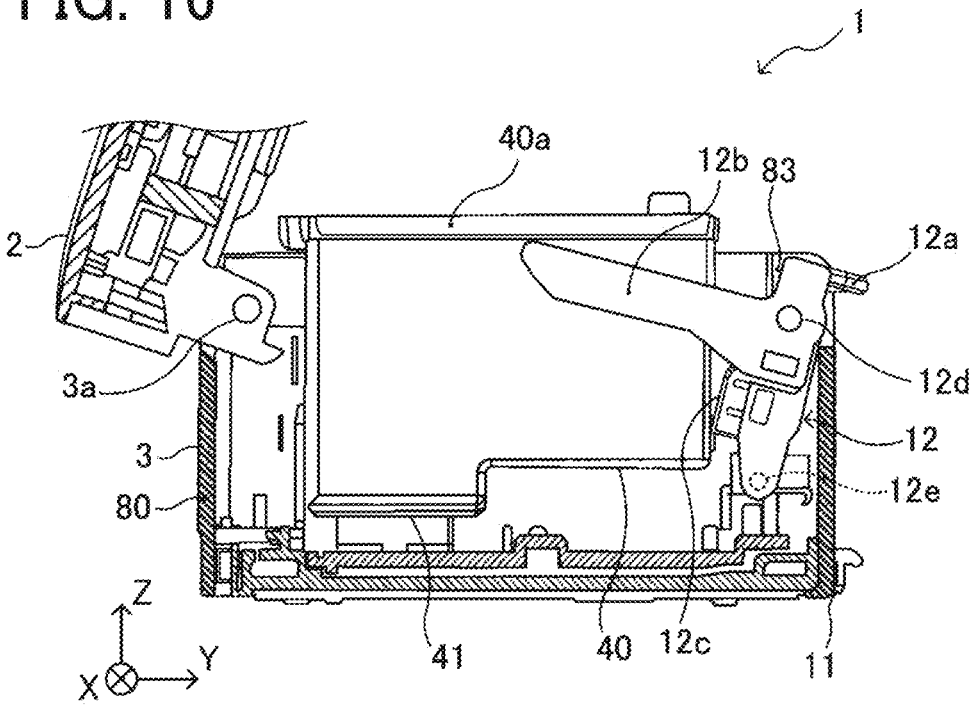
FIG. 16 is a cross-sectional view, from a side, of the handheld printer illustrated in FIG. 12.

FIG. 16 is a cross-sectional view of the handheld printer 1 illustrated in FIG. 12 as viewed from the left face 32 side. Specifically, similar to FIG. 13, FIG. 16 illustrates a cross section at the position of the inner side of the wall on the left face 32 side of the housing 80.

As the operated portion 12*a* of the cartridge attaching and detaching mechanism 12 is pulled to the front face 35 side as indicated by arrow D in FIG. 13, the cartridge attaching and detaching mechanism 12 rotates, centering on a rotation shaft 12*e* of the cartridge attaching and detaching mechanism 12, to the front face 35 side. At this time, the cartridge attaching and detaching mechanism 12 rotates to a position where a projecting stopper 12*d* provided in the cartridge attaching and detaching mechanism 12 fits in a stopper groove 83 provided in the housing 80. By this rotation, a push-up lever 12*b* of the cartridge attaching and detaching mechanism 12 pushes up a flange portion 40*a* of the ink cartridge 40 from the state illustrated in FIG. 13. Then, the ink cartridge 40 pops up from the state illustrated in FIG. 13 to the state illustrated in FIG. 16. As a result, the ink cartridge 40 becomes removable.

In the handheld printer 1 according to the present embodiment, the operated portion 11 of the upper unit lock claw 110 is operated to release the upper unit 2 from the lower unit 3, thereby opening the upper unit 2. When the upper unit 2 is open, the cartridge attaching and detaching mechanism 12 is exposed. As the cartridge attaching and detaching mechanism 12 is operated, the ink cartridge 40 pops up. Alternatively, the cartridge attaching and detaching mechanism 12 can be configured to push up the ink cartridge 40 in conjunction with the opening operation of the upper unit 2.

To mount the ink cartridge 40 in the main body of the handheld printer 1 according to the present embodiment, the ink cartridge 40 is set in the hollow portion inside the lower unit 3 in the state in which the upper unit 2 is open as illustrated in FIG. 14. At this time, the upper face of the ink cartridge 40 is pressed and so that the ink cartridge 40 is inserted to the position illustrated in FIG. 13. Then, the upper unit 2 is closed. As a result, image formation can be performed using the mounted ink cartridge 40.

Further, in the handheld printer 1 according to the present embodiment, the upper unit 2 can be closed in the state illustrated in FIG. 16 before the ink cartridge 40 is inserted to the position illustrated in FIG. 13. In this case, the head pressing member 21 of the upper unit 2 presses the upper face of the ink cartridge 40 positioned at the same position as in the pop-up state, and the ink cartridge 40 can be set at the position illustrated in FIG. 13.

In the handheld printer 1 according to the present embodiment, only the upper unit 2 is the cover that is opened to mount the ink cartridge 40 in the handheld printer 1 or remove the ink cartridge 40 therefrom. Therefore, compared with the structure including a plurality of covers, the apparatus structure can be simple, and the apparatus can be compact. Additionally, since the number of components to be opened by the user is smaller, the number of operation steps can be reduced in attachment and removal of the ink cartridge 40. Thus, the usability can be improved.

As can be seen by comparing FIGS. 13 and 16, in the handheld printer 1, the ink cartridge 40 pops up with the FPC contact portion 13 and the cartridge contact portion 40*b* kept in contact with each other. Accordingly, the following risk will arise if all the electric connections between the battery 15 and the ink cartridge 40 via the FPC contact portion 13 and the cartridge contact portion 40*b* are maintained when pop-up is performed. That is, a short circuit may occur due to unintended connection of contacts, and the ink cartridge 40 or the handheld printer 1 may be broken.

The ink cartridge 40 of the handheld printer 1 according to the present embodiment includes a heater for discharging ink, a control board for controlling the heater, and the like, and the power having a voltage of 11 V is supplied from the handheld printer 1 to the ink cartridge 40. In addition, the gap between the contacts (terminals) of the cartridge contact portion 40*b* is small, about 1 mm or slightly larger than 1 mm. Furthermore, when the operated portion 12*a* of the cartridge attaching and detaching mechanism 12 is operated to pop up and take out the ink cartridge 40, the ink cartridge 40 pops up almost vertically (in the direction along the surface of the FPC contact portion 13).

Further, the FPC contact portion 13 on the lower unit 3 also has contacts (terminals). Then, when the ink cartridge 40 is vertically lifted, the ink cartridge 40 moves up while a contact on the lower side (hereinafter "lower side contact") of the cartridge contact portion 40*b* rubs against a contact (hereinafter "upper side contact") on the FPC contact portion 13 designed to contact another contact (hereinafter "upper side contact") positioned above the lower side contact. At this time, if electrical current is applied to the upper side contact of the FPC contact portion 13 that should contact the upper side contact of the cartridge contact portion 40*b*, electrical power is supplied to the lower side contact of the cartridge contact portion 40*b* that is not to electrically connect to the upper side contact of the FPC contact portion 13. Then, a short circuit may occur. For this reason, when the ink cartridge 40 is taken out, it is desirable that no electricity flows to the contacts of the FPC contact portion 13 which may cause a short circuit.

In order to realize this, the handheld printer 1 according to the present embodiment is configured to shut off at least a part of the electric connections between the lower unit 3 and the ink cartridge 40 in response to opening of the upper unit 2 by the user. That is, since opening the upper unit 2 is necessary to take out the ink cartridge 40, at least a part of the electric connections between the lower unit 3 and the ink cartridge 40 is shut off in response to detecting of the open state of the upper unit 2, thereby preventing the occurrence of short circuit.

According to the present embodiment, the handheld printer 1 includes an upper unit open-close detector (e.g., a feeler 22 and an open-close detection switch 23 illustrated in FIG. 21) to detect the open state of the upper unit 2, which will be described in detail later. As described above, the handheld printer 1 is configured to shut off at least a part of the electric connections from the battery 15 to the FPC contact portion 13 via the control board 14 in response to the detection result that the upper unit 2 is in the open state, detected by the upper unit open-close detector. Specifically, at least a part of the electric connections between the control board 14 and the plurality of contact points of the FPC contact portion 13 is shut off. Thereby, at least a part of the electric connections of the portion indicated by arrow 40*d* in FIG. 9 is shut off.

With such a configuration, when the user opens the upper unit 2, at least a part of the electric connections between the lower unit 3 and the ink cartridge 40 can be shut off.

Preferably, the configuration to shut off a part of the electric connections is configured to shut off, among the members of the ink cartridge 40, an electric connection for supplying power to the heater, which is relatively large in power consumption.

Figure 17:
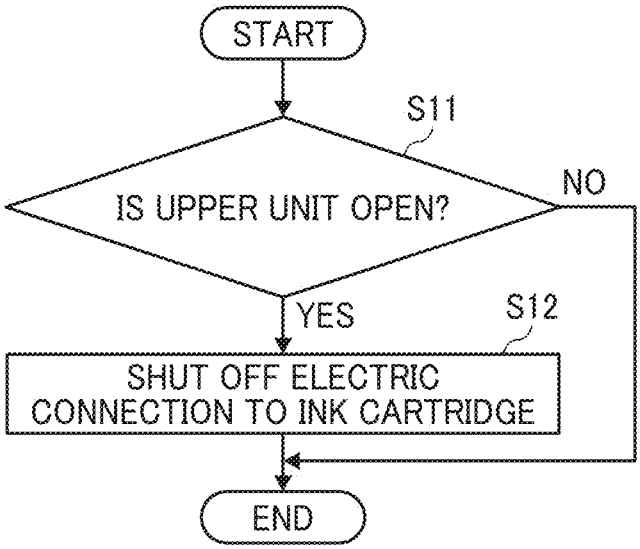
FIG. 17 is a flowchart illustrating an outline of control for blocking an electric connection to the ink cartridge, according to an embodiment.

FIG. 17 is a flowchart illustrating an outline of control for blocking the electric connection to the ink cartridge 40.

When the power supply of the handheld printer 1 is turned on, the process in FIG. 17 starts. In S11 in FIG. 17, the control board 14 repeatedly determines whether the upper unit 2 is in the open state. In response to a detection result that the upper unit 2 is not in the open state (No in S11), the control board 14 repeats the determination of whether the upper unit 2 is in the open state. By contrast, if the upper unit 2 is in the open state (Yes in S11), at S12 in FIG. 17, the control board 14 shuts off the electric connection to the ink cartridge 40.

In the handheld printer 1 according to the present embodiment, the control board 14 which is a controller repeats the process in the flowchart illustrated in FIG. 17, thereby constantly monitoring whether the upper unit 2 is open or closed.

Figure 18:
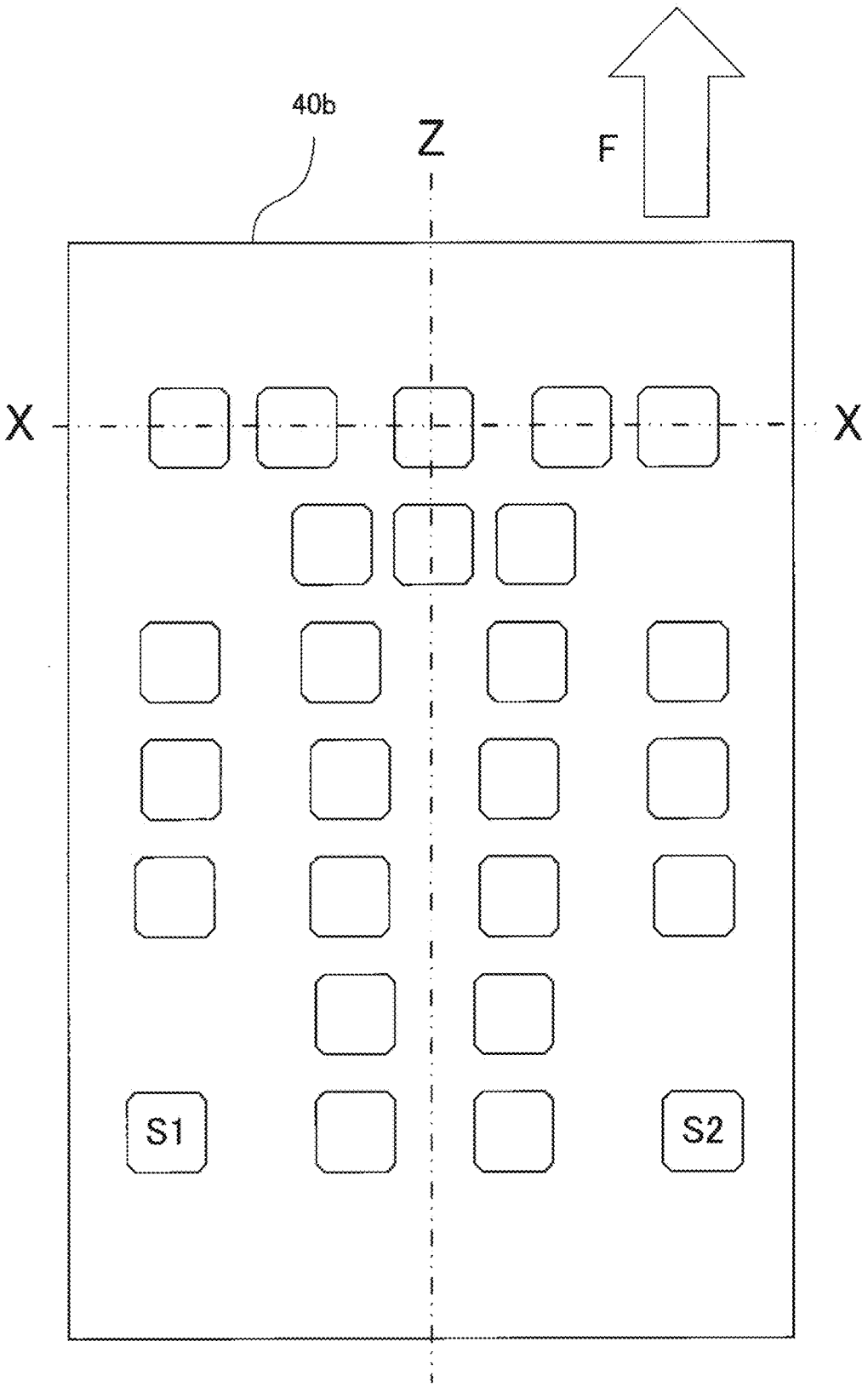
FIG. 18 is an enlarged view illustrating a cartridge contact portion according to an embodiment.

FIG. 18 is an enlarged view illustrating the cartridge contact portion 40*b*. Each square illustrated in FIG. 18 is the terminal on the side of the cartridge contact portion 40*b*. As the terminal on the side of the FPC contact portion 13 illustrated in FIG. 14 comes into contact with the terminal illustrated in FIG. 18, electric connection is established between the handheld printer 1 (the main body) and the ink cartridge 40.

Apart from the temperature sensor 19, illustrated in FIG. 9, of the handheld printer 1 (main body side), the ink cartridge 40 is also provided with a cartridge side temperature sensor as a temperature detector. The recording device 41, which is an inkjet head, properly discharges the ink only in a certain temperature range. Accordingly, it is necessary to control the temperature of the head to be in a certain range with the cartridge side temperature sensor.

Among the plurality of terminals of the cartridge contact portion 40*b* illustrated in FIG. 18, two terminals S1 and S2 positioned at the bottom are for supplying power to the cartridge side temperature sensor. Therefore, the electric connections to the terminals S1 and S2 are maintained at the time of shutting off at least a part of the electric connections between the control board 14 and the FPC contact portion 13 in response to the detection result that the upper unit 2 is in the open state. Specifically, the electric connections between the two terminals of the FPC contact portion 13 facing the two terminals S1 and S2 and the control board 14 are maintained. This is because the temperature control of the recording device 41 is not feasible when the electric connections to the two terminals S1 and S2 are shut off.

When the ink cartridge 40 pops up from the housing 80, the cartridge contact portion 40*b* moves in the direction indicated by arrow F in FIG. 18. There are no terminals below the two terminals S1 and S2. Therefore, at the time of pop-up, the two lower side terminals of the FPC contact portion 13 facing the terminals S1 and S2 of the cartridge contact portion 40*b* do not contact the other terminals of the cartridge contact portion 40*b*. Therefore, at the time of pop-up, even if the two terminals of the FPC contact portion 13 opposed to the terminals S1 and S2 are kept energized, no short circuit occurs. Furthermore, in the handheld printer 1 according to the present embodiment, since the voltage input to the two terminals S1 and S2 is a relatively low and, for example, 3.3 V, a short circuit hardly occurs. Since a short circuit does not occur at the time of pop-up, there is no need to shut off the electric connections to the two terminals S1 and S2 even when the upper unit 2 is opened. Thus, even when the upper unit 2 is open, temperature control of the recording device 41 is feasible.

Next, upper unit open-close detector for detecting that the upper unit 2 is in the open state will be described.

Figure 19:
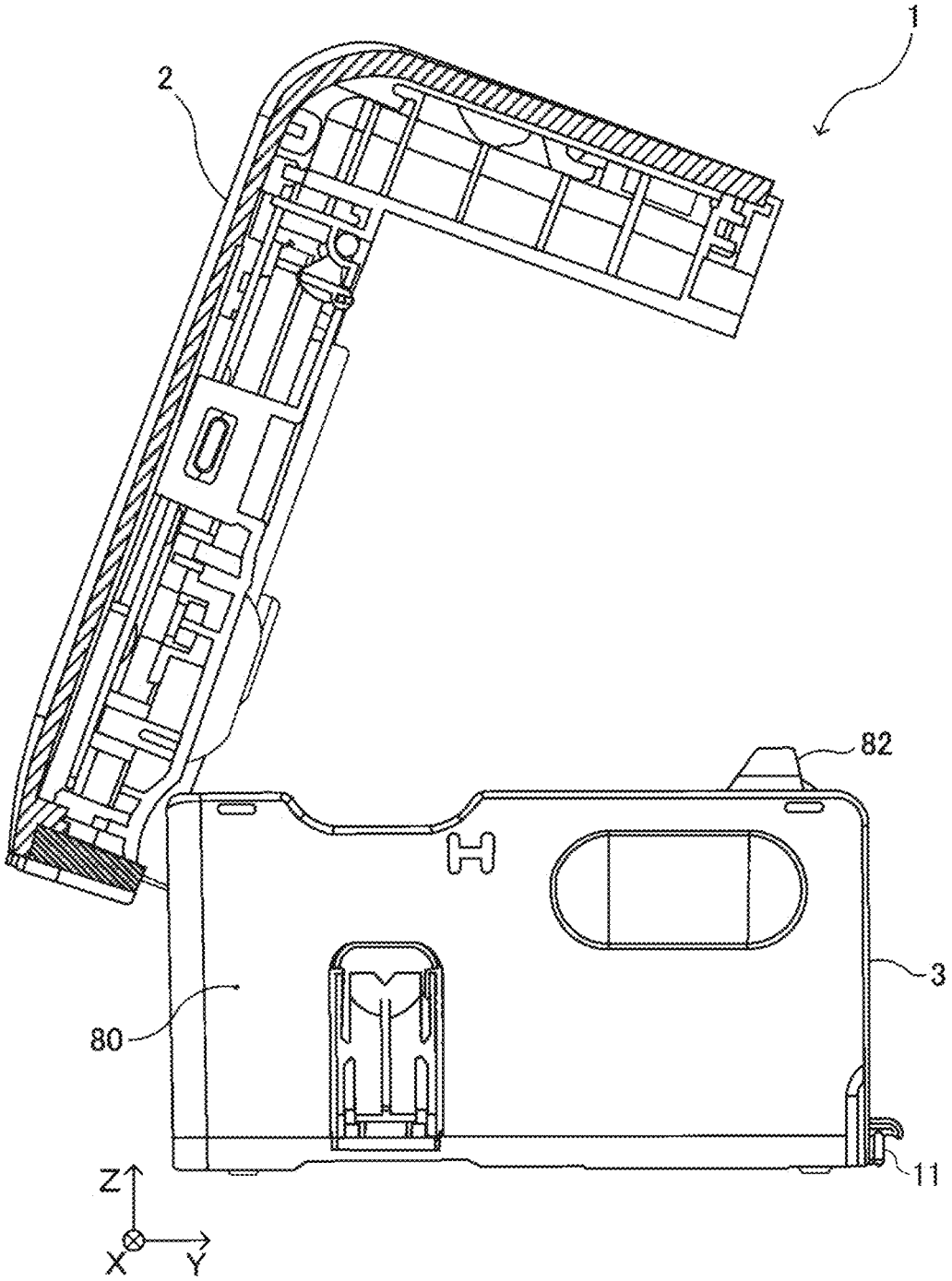
FIG. 19 is a cross-sectional side view of the handheld printer illustrated in FIG. 11, as viewed from a position closer to the front end than in the cross section illustrated in FIG. 13.

FIG. 19 is a cross-sectional view of the handheld printer 1 illustrated in FIG. 11, as viewed from the left face 32 side. Specifically, FIG. 13 illustrates a cross section at a position closer to the front end than the position of the cross section illustrated in FIG. 13 and the cross section at the position on the inner side of the wall on the left face 32 side of the upper unit 2. Therefore, in the cross-sectional view illustrated in FIG. 19, the outer wall surface of the wall on the left face 32 side of the lower unit 3 is visually recognized.

Figure 20:
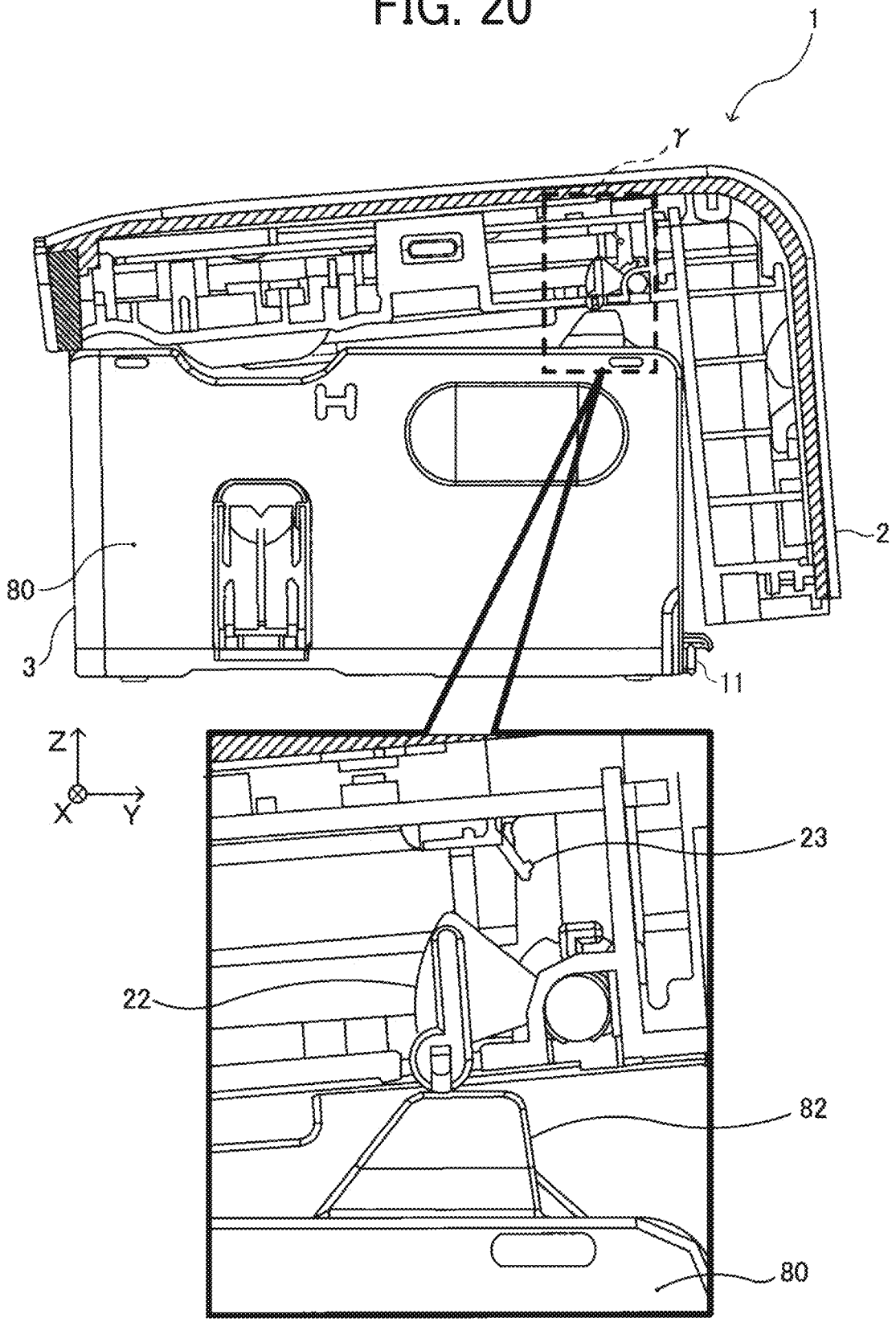
FIG. 20 is a cross-sectional side view of the handheld printer in a state in which an open state is detected midway in closing of the upper unit from the state illustrated in FIG. 19.

FIG. 20 is a cross-sectional view at the same position as the position illustrated in FIG. 19. FIG. 20 is a cross-sectional view of a state in which the open state is detected in the middle of rotating the upper unit 2 in the closing direction from the position illustrated in FIG. 19. The upper section of FIG. 20 is a cross-sectional view of the entire handheld printer 1, and the lower section of FIG. 20 is an enlarged cross-sectional view of a region "γ" indicated by broken lines in the upper section of FIG. 20.

Figure 21:
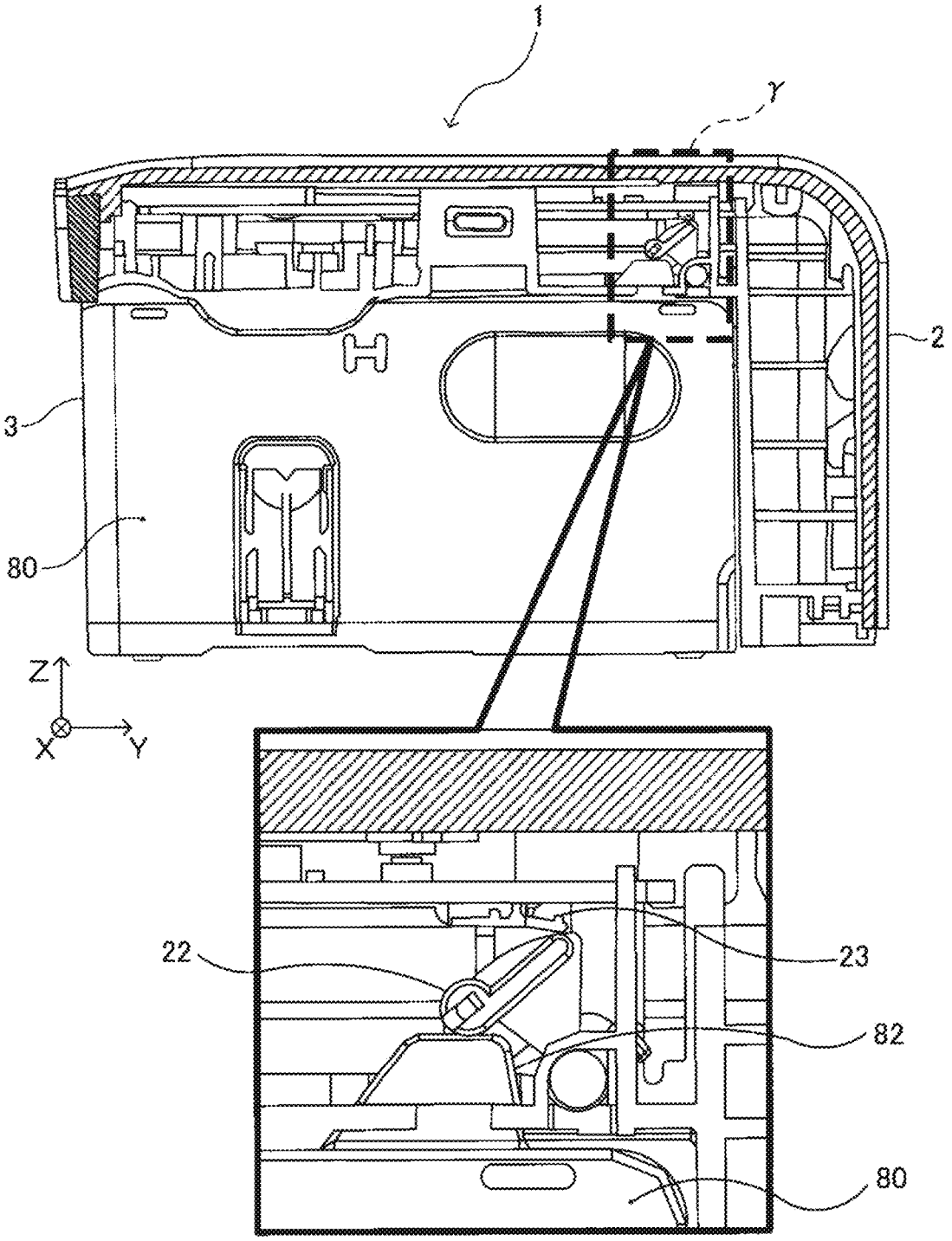
FIG. 21 is a cross-sectional side view of the handheld printer in a state in which a closed state is detected as the upper unit is closed from the state illustrated in FIG. 19.

FIG. 21 is a cross-sectional view at the same position as the position illustrated in FIG. 19 and is a cross-sectional view of a state in which the closed state is detected as the upper unit 2 is rotated in the closing direction from the position illustrated in FIG. 19. The upper section of FIG. 21 is a cross-sectional view of the entire handheld printer 1, and the lower section of FIG. 21 is an enlarged cross-sectional view of a region "γ" indicated by broken lines in the upper section of FIG. 21.

The upper unit 2 is rotated from the open position illustrated in FIG. 19 to the position illustrated in FIG. 20 and further to the closed position illustrated in FIG. 21. The lower unit 3 includes a striker 82, and the feeler 22 is rotatably latched on the upper unit 2. While the upper unit 2 is rotated to the closed state, the striker 82 pushes in the feeler 22 upward. As the feeler 22 that has been pushed-in switches on and off the open-close detection switch 23 that is connected to the control board 14, whether the upper unit 2 is open or closed can be detected. Specifically, the feeler 22 contacts the open-close detection switch 23 and further pushes up the open-close detection switch 23 (to the state illustrated in FIG. 21), turning on the open-close detection switch 23. Then, the close state of the upper unit 2 is detected, for example, based on a signal transmitted from the open-close detection switch 23 to the control board 14.

Since the handheld printer 1 includes the upper unit open-close detector (the striker 82, the feeler 22, the open-close detection switch 23, and the control board 14) for detecting whether the upper unit 2 is open or closed, the handheld printer 1 can be configured to be powered on only when the upper unit 2 is closed. Furthermore, in response to detection that the upper unit 2 has changed from the closed state to the open state with the power turned on, the power supply can be turned off automatically. That is, in the open state, the power is always "OFF".

Further, by performing the control illustrated in FIG. 17, the ink cartridge 40 can be prevented from being taken out in the state in which the handheld printer 1 main body and the ink cartridge 40 are electrically connected.

The handheld printer 1 may be configured to allow power on even when the upper unit 2 is open, but in such a case, an operation in response to pressing of the print button 5*a* (an operation key) is prohibited. This can prevent printing with the upper unit 2 in the open state.

Although the description above concerns an example of the preventive configuration to prevent a short circuit even if the ink cartridge 40 is attached or detached in a state in which the control board 14 detects the open state of the upper unit 2, the preventive configuration is not limited to shutting off the electric connection between the ink cartridge 40 and the lower unit 3. Another example is a configuration to slide the ink cartridge 40 in the direction in which the cartridge contact portion 40*b* is separated from the FPC contact portion 13, thereby separating the contacts from each other, before taking out the ink cartridge 40.

Figure 22:
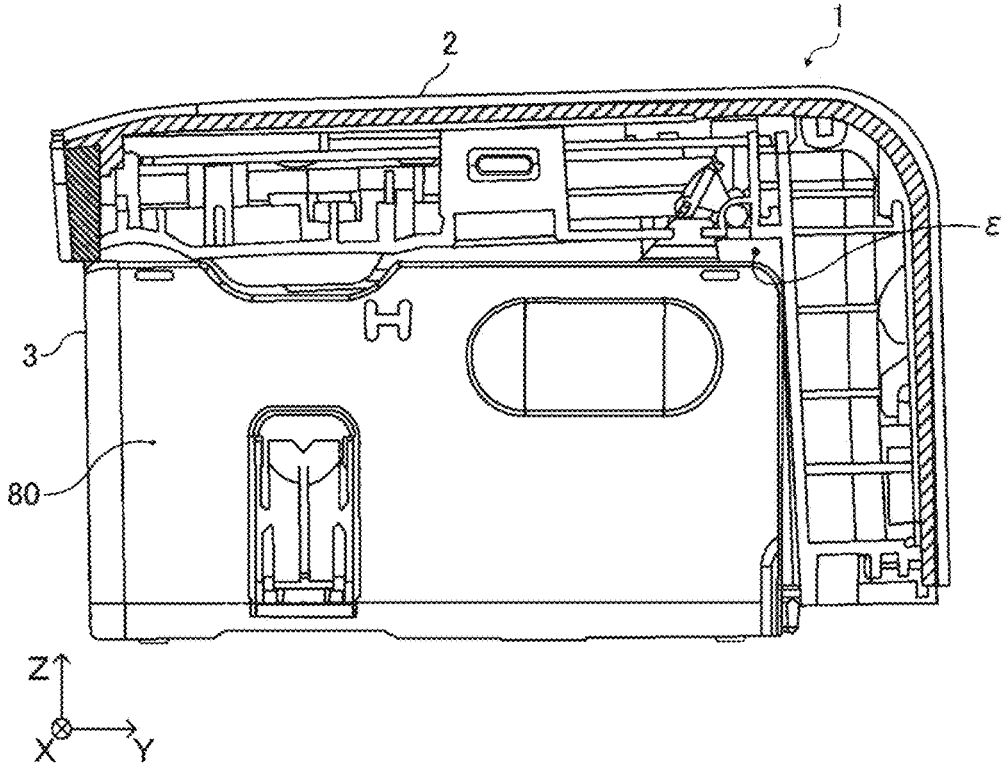
FIG. 22 is a cross-sectional side view of the handheld printer in a state immediately before the closed state of the upper unit is closed from the state illustrated in FIG. 19.

FIG. 22 is a cross-sectional view of the same cross section as that illustrated in FIG. 19 and illustrates the state immediately before the closed state of the upper unit 2 is detected while the upper unit 2 is rotated in the closing direction from the position illustrated in FIG. 19 (or the open state is detected while upper unit 2 is rotated in the open direction).

An opening ε illustrated in FIG. 22 is an access path to the operated portion 12*a* of the cartridge attaching and detaching mechanism 12 illustrated in FIG. 11 or the like. The opening ε is sufficiently narrow in the state immediately before the closed state illustrated in FIG. 22 is detected (the open state is detected). Accordingly, in the state in which the close state is detected, the opening ε is further narrowed, and access to the operated portion 12*a* of the cartridge attaching and detaching mechanism 12 is not available. Therefore, when the upper unit 2 is in the closed state in which power is supplied to the ink cartridge 40, the user is prevented from accessing the operated portion 12*a* of the cartridge attaching and detaching mechanism 12. Therefore, the occurrence of a short circuit at the connection position between the FPC contact portion 13 and the cartridge contact portion 40*b* can be prevented.

In the handheld printer 1 according to the present embodiment, in a state in which the closed state of the upper unit 2 is detected, the striker 82 functions as an access path shield that narrows the opening ε. Although a small gap is present between the upper unit 2 and the lower unit 3 in the state immediately before the closed state is switched to the open state, the striker 82 can prevent the user from inserting, e.g., his or her finger in this space and operating the operated portion 12*a* of the cartridge attaching and detaching mechanism 12. As a result, this configuration can prevent the ink cartridge 40 from being taken out in the state in which power is supplied to the ink cartridge 40 and accordingly prevent the occurrence of short circuit at the connection position of the FPC contact portion 13 and the cartridge contact portion 40*b*.

In the handheld printer 1 according to the present embodiment, the upper unit open-close detector has a mechanical structure using the feeler 22 and the striker 82. Examples of the upper unit open-close detector is not limited to the mechanical structure but can be a structure using a magnetic sensor or an optical sensor. However, use of the feeler 22 and the striker 82 as the upper unit open-close detector is advantageous in that these components can double as the access path shield.

The handheld printer 1 according to the present embodiment includes the upper unit 2 that is an upper structure holding the battery 15 being the power supply and the control board 14. The control board 14 is the board for controlling the operation of the handheld printer 1 that is a printer of manual scanning type. The handheld printer 1 further includes the lower unit 3 that is a lower structure holding the position detection sensor 18 serving as the position detector to acquire position information for performing the discharge control of the ink and the ink cartridge 40. Further, in the handheld printer 1, the upper unit 2 that is the upper structure is L-shaped. Such structure can lower the gravitational center (gravity center position) of the handheld printer 1, thus preventing the handheld printer 1 from falling over while being moved.

Variation 1

Next, descriptions are given below of a first variation (hereinafter referred to as "Variation 1") in which the position of the cartridge attaching and detaching mechanism 12 in the lower unit 3 is different from that in the above-described embodiment.

Figure 23:
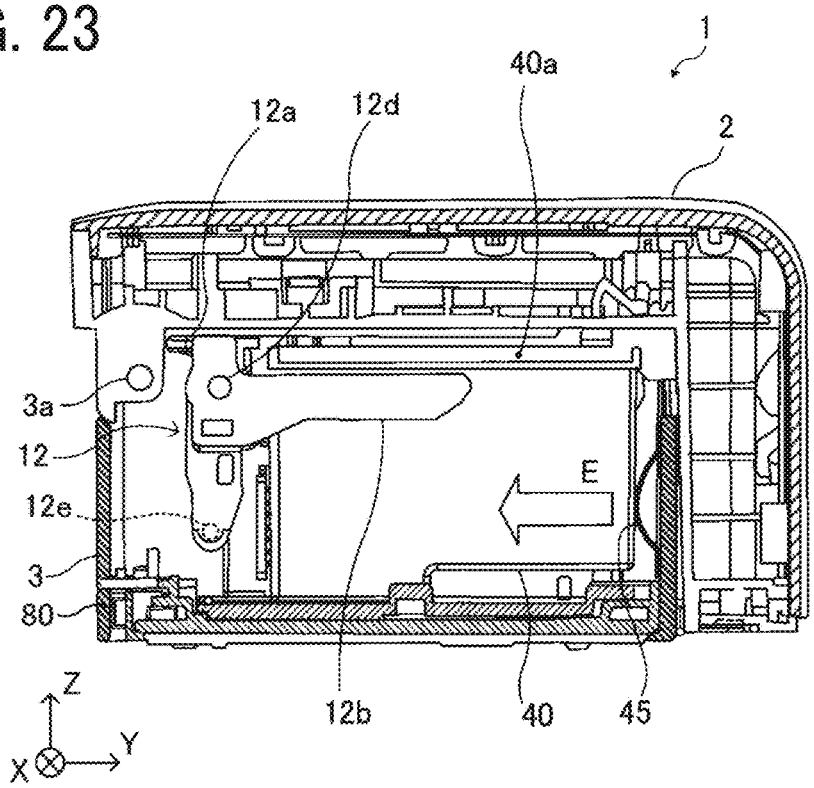
FIG. 23 is a cross-sectional side view illustrating a state in which an upper unit of a handheld printer is in a closed state, according to Variation 1.
Figure 24:
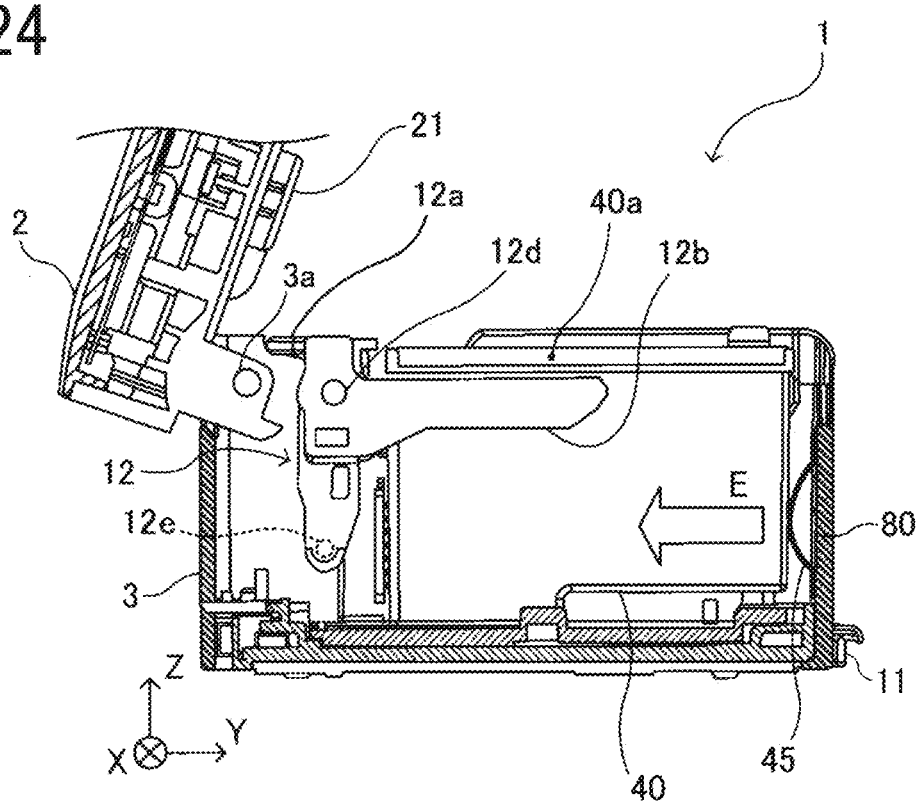
FIG. 24 is a cross-sectional view of the handheld printer according to Variation 1, in which the upper unit is rotated to the open state from the state illustrated in FIG. 23.
Figure 25:
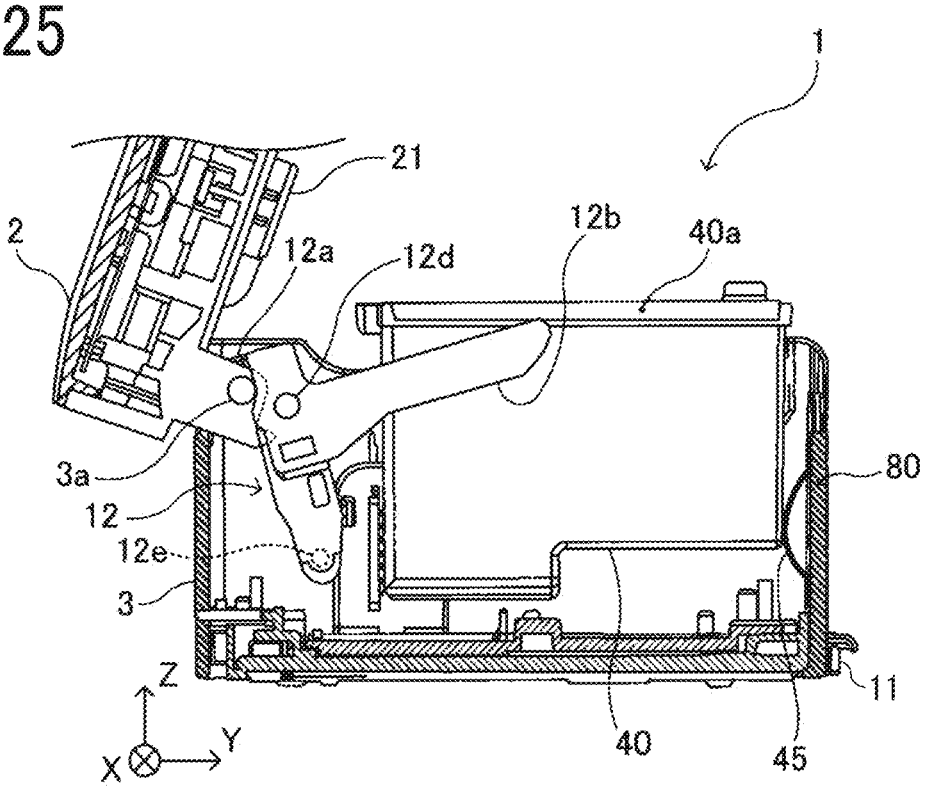
FIG. 25 is a cross-sectional side view of the handheld printer according to Variation 1 in a state in which the ink cartridge pops up from the state illustrated in FIG. 24.

FIGS. 23, 24, and 25 are cross-sectional views of the handheld printer 1 according to Variation 1 as viewed from the left face 32 side. FIG. 23 is a cross-sectional view of the upper unit 2 in the closed state. FIG. 24 is a cross-sectional view of the upper unit 2 rotated to the open state from the state illustrated in FIG. 23. FIG. 25 is a cross-sectional view in which the ink cartridge 40 pops up from the state illustrated in FIG. 24. These cross-sectional views illustrate the cross section at the position of the inner side of the wall on the side of the left face 32 side of the housing 80, similar to FIG. 13.

In the handheld printer 1 according to the above-described embodiment, the operated portion 12*a* of the cartridge attaching and detaching mechanism 12 is disposed in the vicinity of the end of the lower unit 3 on the front face 35 side, and the upper unit rotation shaft 3*a* (see FIG. 6) is disposed in the vicinity of the end of the lower unit 3 on the rear face 34 side (see FIGS. 6 and 12). That is, in the handheld printer 1 according to the embodiment described above, the operated portion 12*a* and the upper unit rotation shaft 3*a* are provided on the opposite sides in the Y-axis direction of the lower unit 3.

By contrast, in the handheld printer 1 according to Variation 1 illustrated in FIGS. 23 to 25, the operated portion 12*a* of the cartridge attaching and detaching mechanism 12 is disposed on the same side as the upper unit rotation shaft 3*a*. The configuration other than the arrangement of the cartridge attaching and detaching mechanism 12 is the same as that according to the above-described embodiment, and therefore, the description of the common configuration will be appropriately omitted.

In the embodiment described above, the cartridge attaching and detaching mechanism 12 includes the pressing portion 12*c* (see FIG. 13) to press the ink cartridge 40 to the FPC contact portion 13. By contrast, in Variation 1, a pressure spring 45 is disposed on the side opposite to the upper unit rotation shaft 3*a*, and the pressure spring 45 presses the ink cartridge 40 against the FPC contact portion 13.

As described above, in the handheld printer 1 according to Variation 1, the cartridge attaching and detaching mechanism 12 is disposed on the same side as the upper unit rotation shaft 3*a*. Thereby, even if the opening angle of the upper unit 2 is the same, compared with the above-described embodiment in which the cartridge attaching and detaching mechanism 12 is provided on the opposite side of the upper unit rotation shaft 3*a*, the opening ε, serving as the access path to the cartridge attaching and detaching mechanism 12, becomes smaller. Thereby, the access to the cartridge attaching and detaching mechanism 12 in the closed state of the upper unit 2 becomes more difficult, and the occurrence of short circuit in the FPC contact portion 13 can be prevented.

Variation 2

Next, descriptions are given below of a second variation (hereinafter referred to as "Variation 2") in which the cartridge attaching and detaching mechanism 12 moves in conjunction with opening and closing of the upper unit 2.

Figure 26:
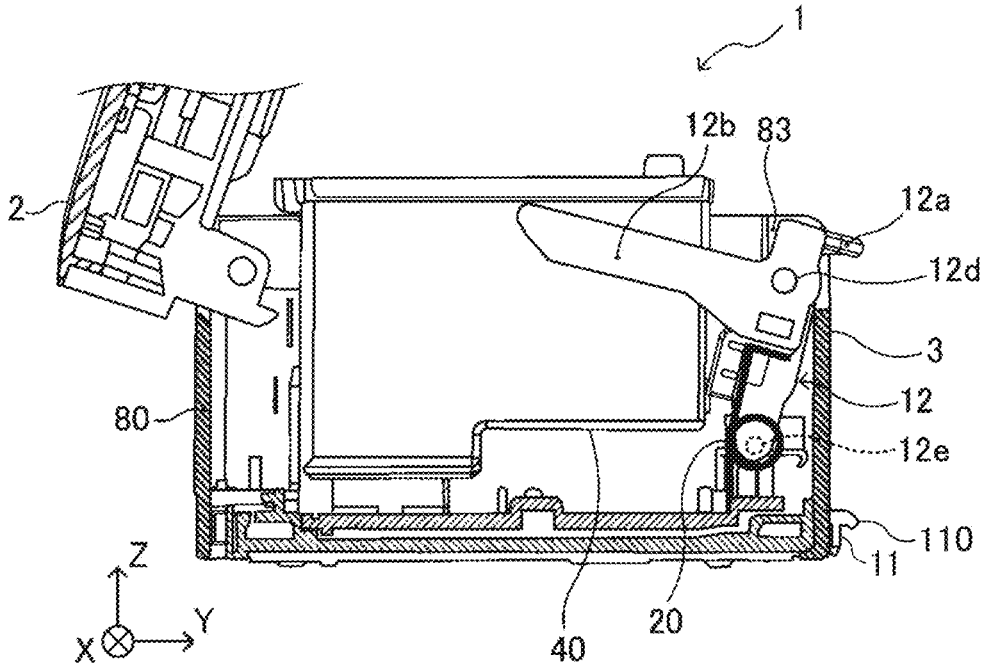
FIG. 26 is a cross-sectional side view illustrating a state in which the upper unit of the handheld printer is in an open state, according to Variation 2.

FIG. 26 is a cross-sectional view of the handheld printer 1 according to Variation 2 being a state in which the upper unit 2 thereof is in the open state, as viewed from the left face 32 side. Specifically, similar to FIG. 13, FIG. 26 illustrates a cross section at the position of the inner side of the wall on the left face 32 side of the housing 80.

The handheld printer 1 illustrated in FIG. 26 includes a torsion spring 20 attached to the rotation shaft 12*e* of the cartridge attaching and detaching mechanism 12. With this structure, the cartridge attaching and detaching mechanism 12 rotates in conjunction with the opening of the upper unit 2. Specifically, with the biasing force of the torsion spring 20 attached to the rotation shaft 12*e*, the push-up lever 12*b* of the cartridge attaching and detaching mechanism 12 can be held at a position to allow removal of the ink cartridge 40 from the lower unit 3, as illustrated in FIG. 26. Then, as the upper unit 2 is closed from the open state illustrated in FIG. 26, the bottom of the upper unit 2 contacts the upper portion of the ink cartridge 40. As closing of the upper unit 2 is further continued, the ink cartridge 40 is set in the lower unit 3 against the biasing force of the torsion spring 20. Then, by the action of the upper unit lock claw 110, the upper unit 2 is secured to the lower unit 3, and the closed state of the upper unit 2 is maintained. Thus, by releasing the lock of the upper unit lock claw 110, the ink cartridge 40 can pop up in conjunction with the opening of the upper unit 2, thereby reducing the number of user operations to remove the ink cartridge 40. This configuration can improve usability.

By contrast, in the handheld printer 1 according to the embodiment described above, the following two operations (1) and (2) are performed to push up the ink cartridge 40:

(1) open the upper unit 2; and (2) operate the cartridge attaching and detaching mechanism 12 to push up the ink cartridge 40.

As described above, in the handheld printer 1 according to the embodiment described above, two steps are required to take out the ink cartridge 40. Taking such a time-consuming method is advantageous in reliably shutting off the electric connection between the ink cartridge 40 and the main body of the handheld printer 1 before the ink cartridge 40 pops up.

In the handheld printer 1 according to the embodiment described above, as illustrated in FIGS. 19 to 22, the upper unit open-close detector uses the striker 82 and the feeler 22. Such a structure can reduce the size of the opening ε, which makes it difficult to access the cartridge attaching and detaching mechanism 12 when the upper unit 2 is closed. Thus, the ink cartridge 40 can be prevented from being taken out in a state in which the ink cartridge 40 is not electrically disconnected and accordingly prevent the occurrence of a short circuit at the connection position of the FPC contact portion 13 and the cartridge contact portion 40*b*.

As illustrated in FIGS. 4 and 5, in the handheld printer 1 according to the embodiment described above, the recording face 30 includes an opening-surrounding flat area 301 (a flat portion) in which the discharge opening 30*a* is formed for exposing the recording device 41 of the ink cartridge 40 mounted in the lower unit 3 to the outside. The recording face 30 further includes an opening-surrounding flat area 303 in which a detection opening 302 is formed for exposing a detection portion of the position detection sensor 18. The position detection sensor 18 detects the position of the handheld printer 1 on the recording medium P.

The opening-surrounding flat area 303 has a shape projecting, toward the print surface, in the direction of discharge of ink, beyond the opening-surrounding flat area 301 surrounding the discharge opening 30*a*. Further, the opening-surrounding flat area 303 is provided with a projecting rim 304 enclosing the detection opening 302. The projecting rim 304 projects, toward the print surface in the direction of discharge of ink, beyond the opening-surrounding flat area 303 surrounding the detection opening 302.

The opening-surrounding flat area 301, the opening-surrounding flat area 303 and the projecting rim 304 are portions of the lower face of the housing 80 of the lower unit 3.

If a portion of the recording medium P floats and the floating portion closely approaches the position detection sensor 18, the position detection sensor 18 may cause erroneous detection. The handheld printer 1 according to Variation 2 can press the floating portion of the recording sheet P by the projecting rim 304 such that the position detection sensor 18 does not cause erroneous detection. Therefore, the position detection sensor 18 can accurate detect the distance by which the handheld printer 1 has moved, and the accuracy of position detection can be improved.

Variation 3

Next, descriptions are given below of a third variation (hereinafter referred to as "Variation 3") in which prevention of approach of the recording sheet P to the position detection sensor 18 is achieved with a structure different from the above-described structure.

Figure 27:
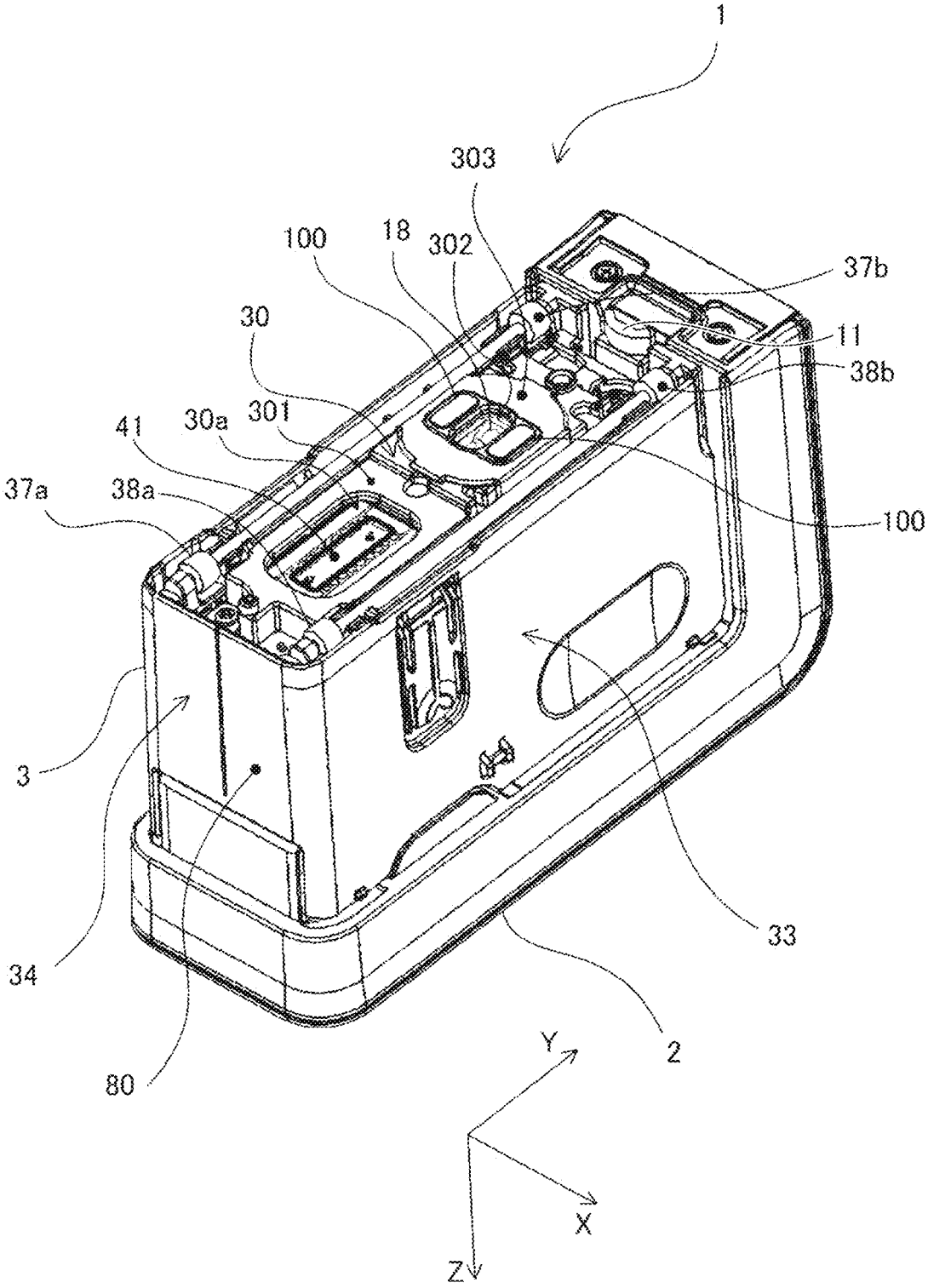
FIG. 27 is an exterior perspective view of the handheld printer according to Variation 3, as viewed from the lower right on the rear side.

FIG. 27 is an exterior perspective view of the handheld printer 1 according to Variation 3, as viewed from the lower right on the rear side.

Figure 28:
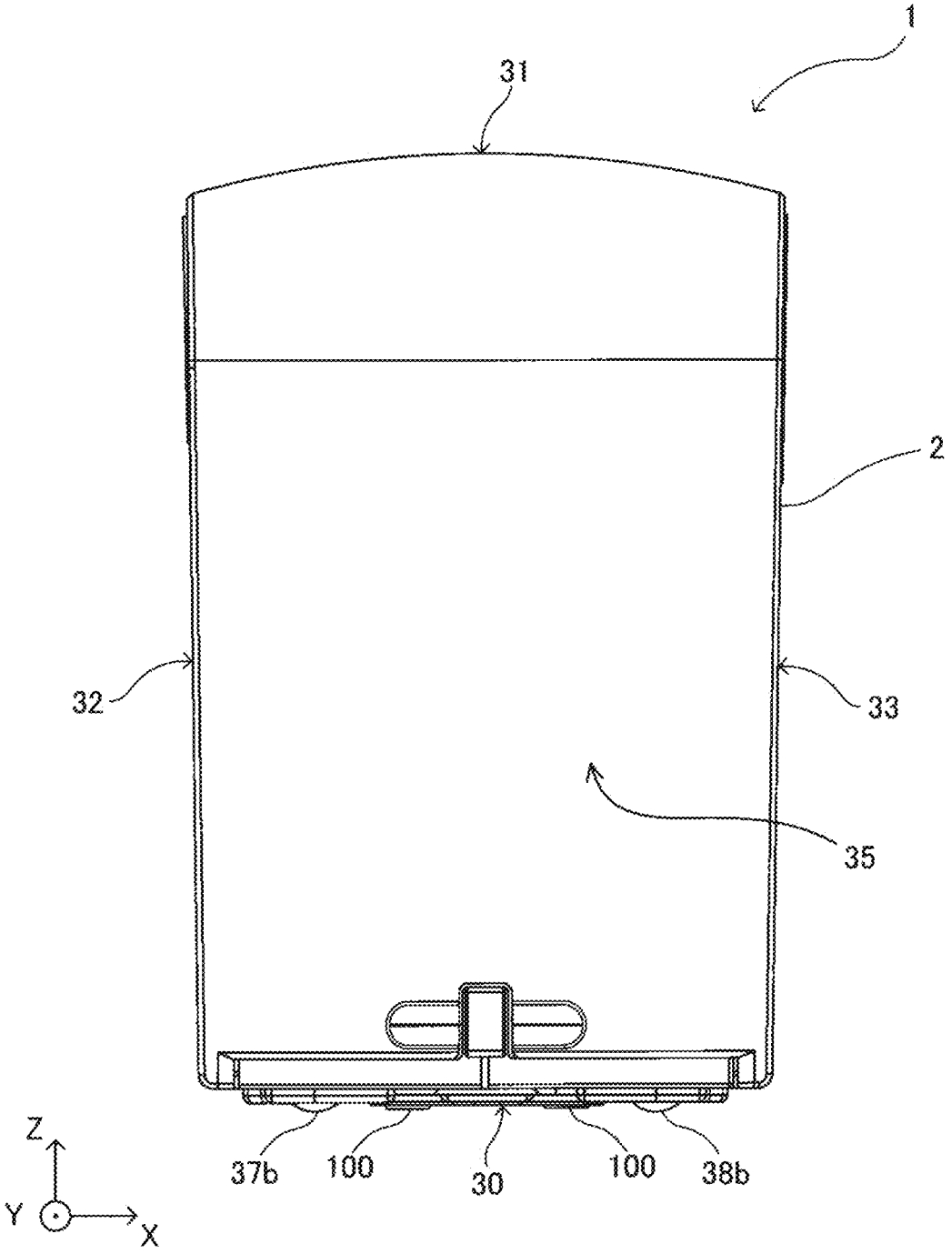
FIG. 28 is a front view of the handheld printer according to Variation 3.
Figure 29:
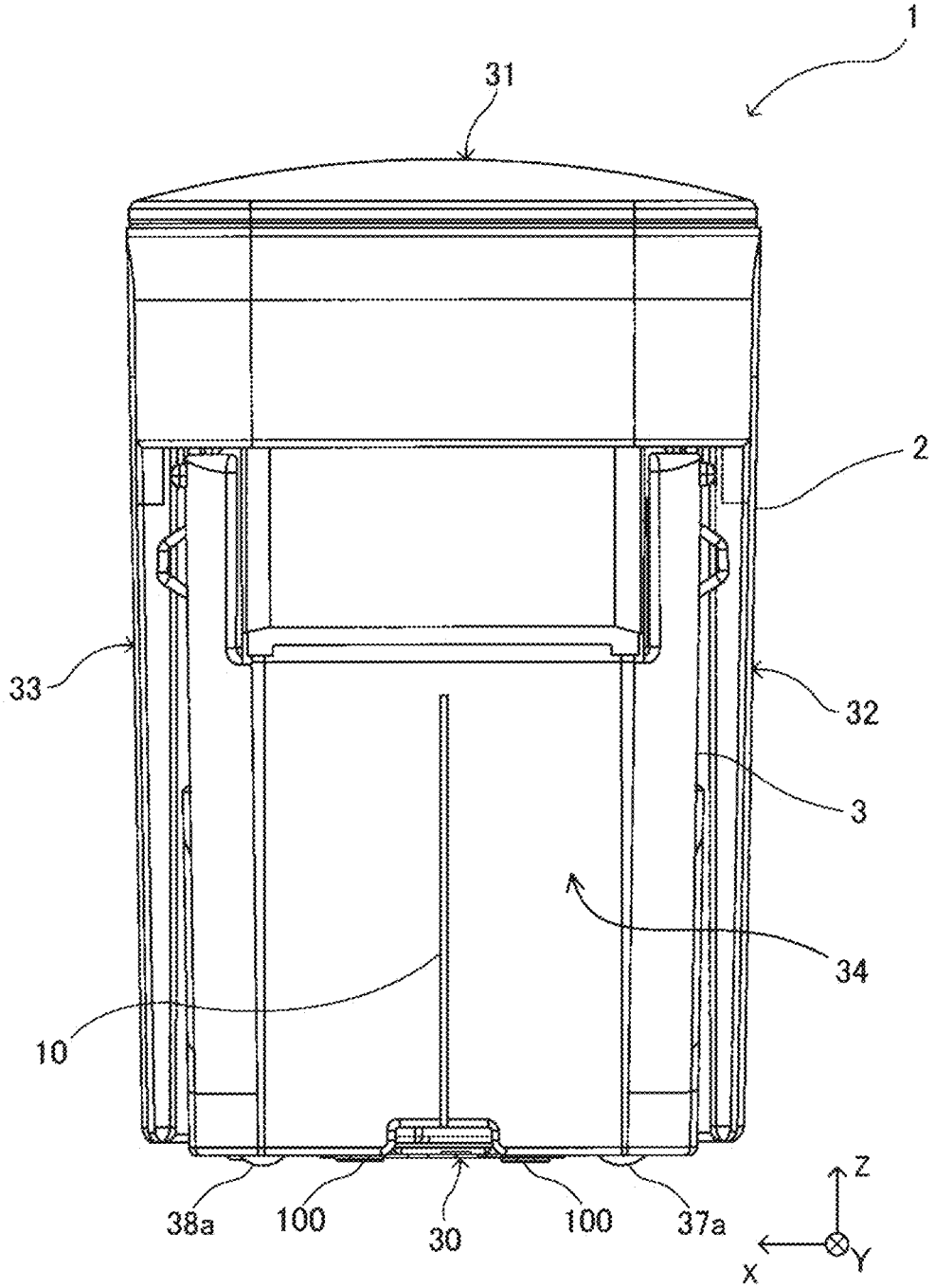
FIG. 29 is a rear view of the handheld printer according to Variation 3.
Figure 30:
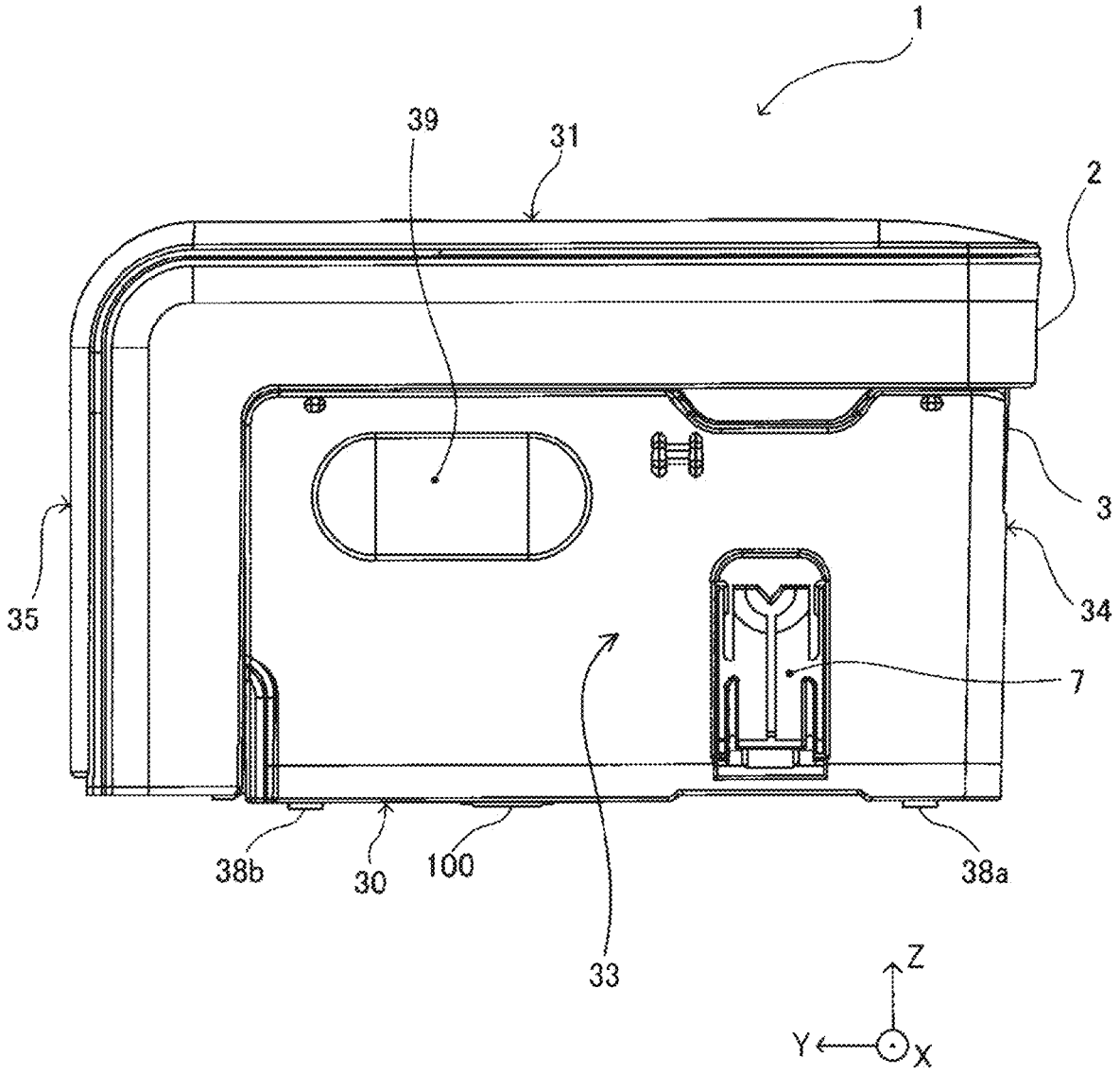
FIG. 30 is a right side view of the handheld printer according to Variation 3.
Figure 31:
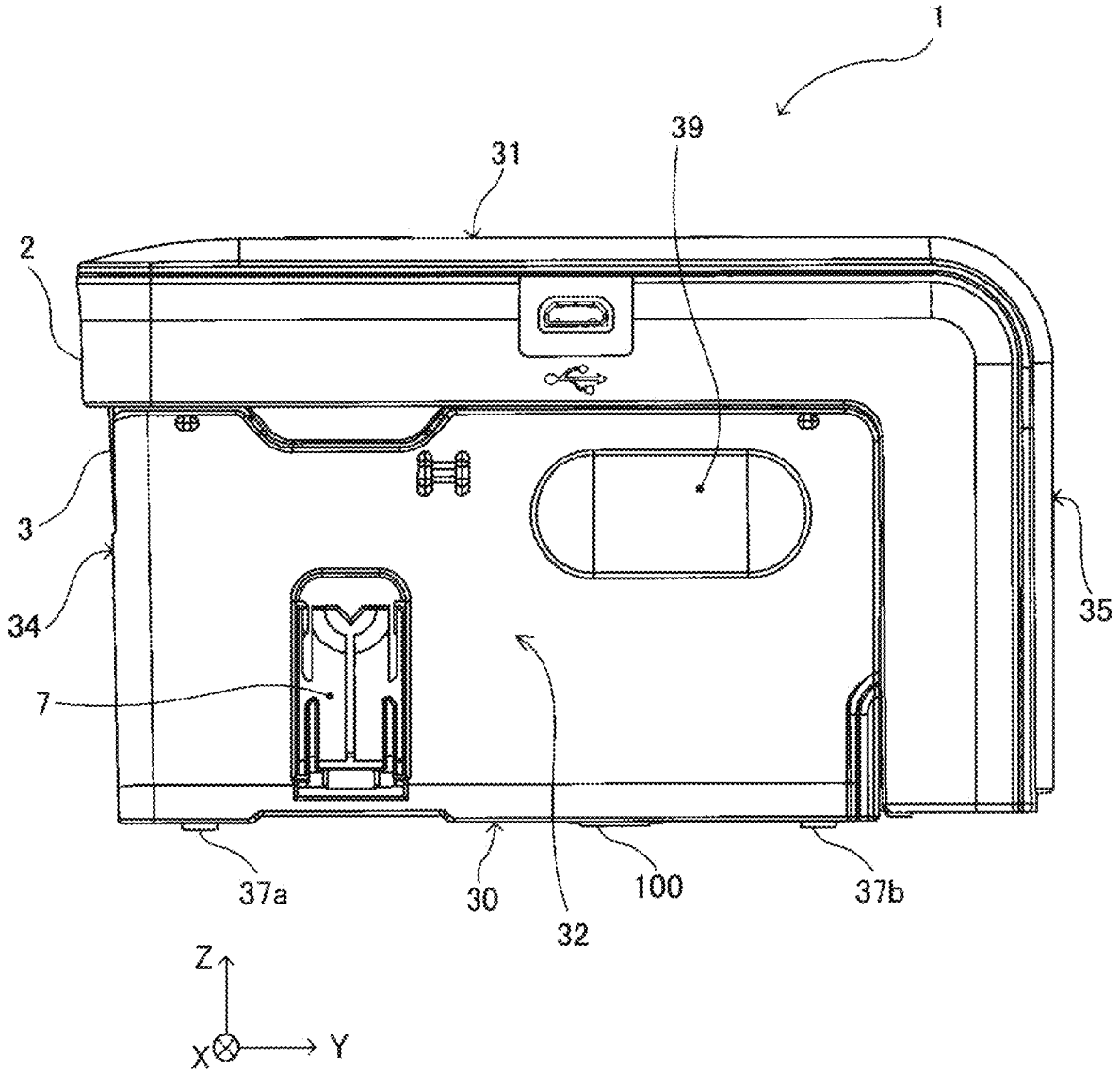
FIG. 31 is a left side view of the handheld printer according to Variation 3.
Figure 32:
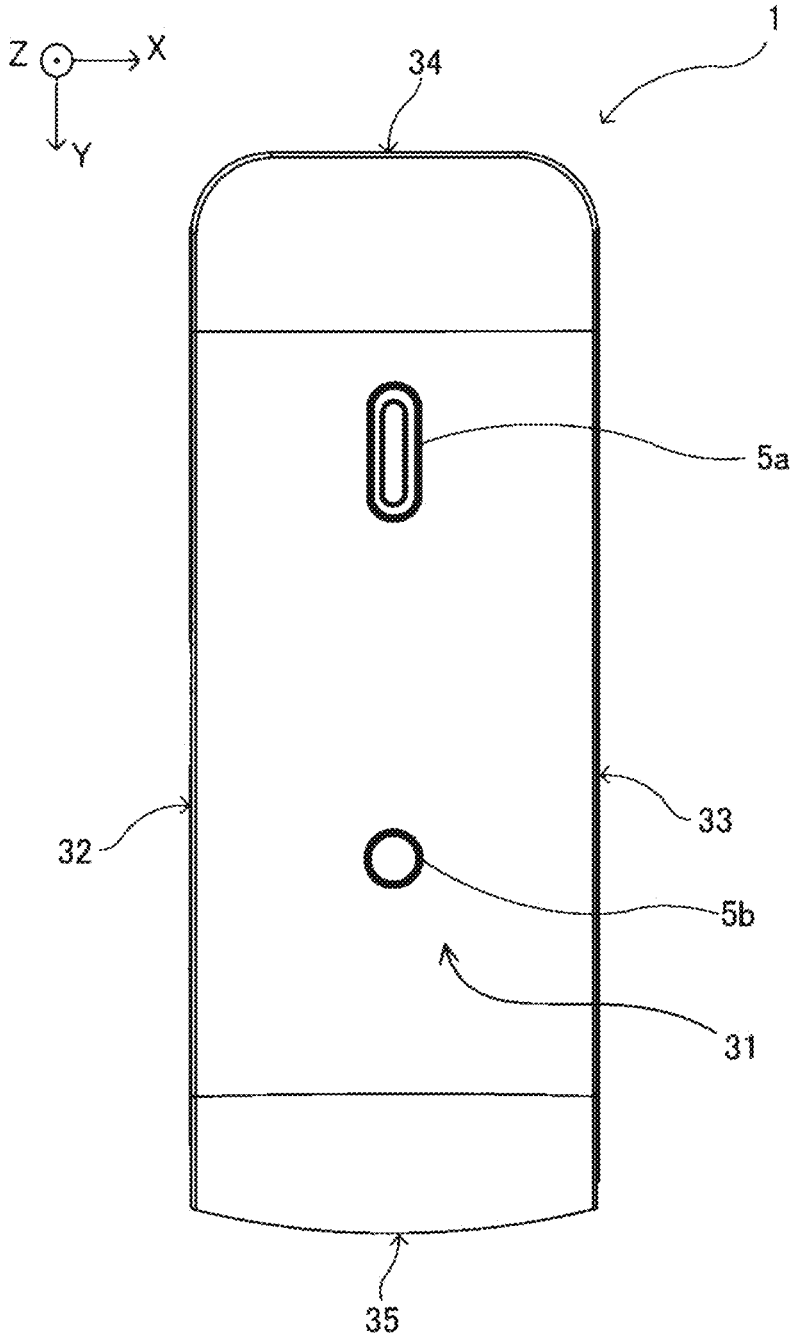
FIG. 32 is a top view of the handheld printer according to Variation 3.
Figure 33:
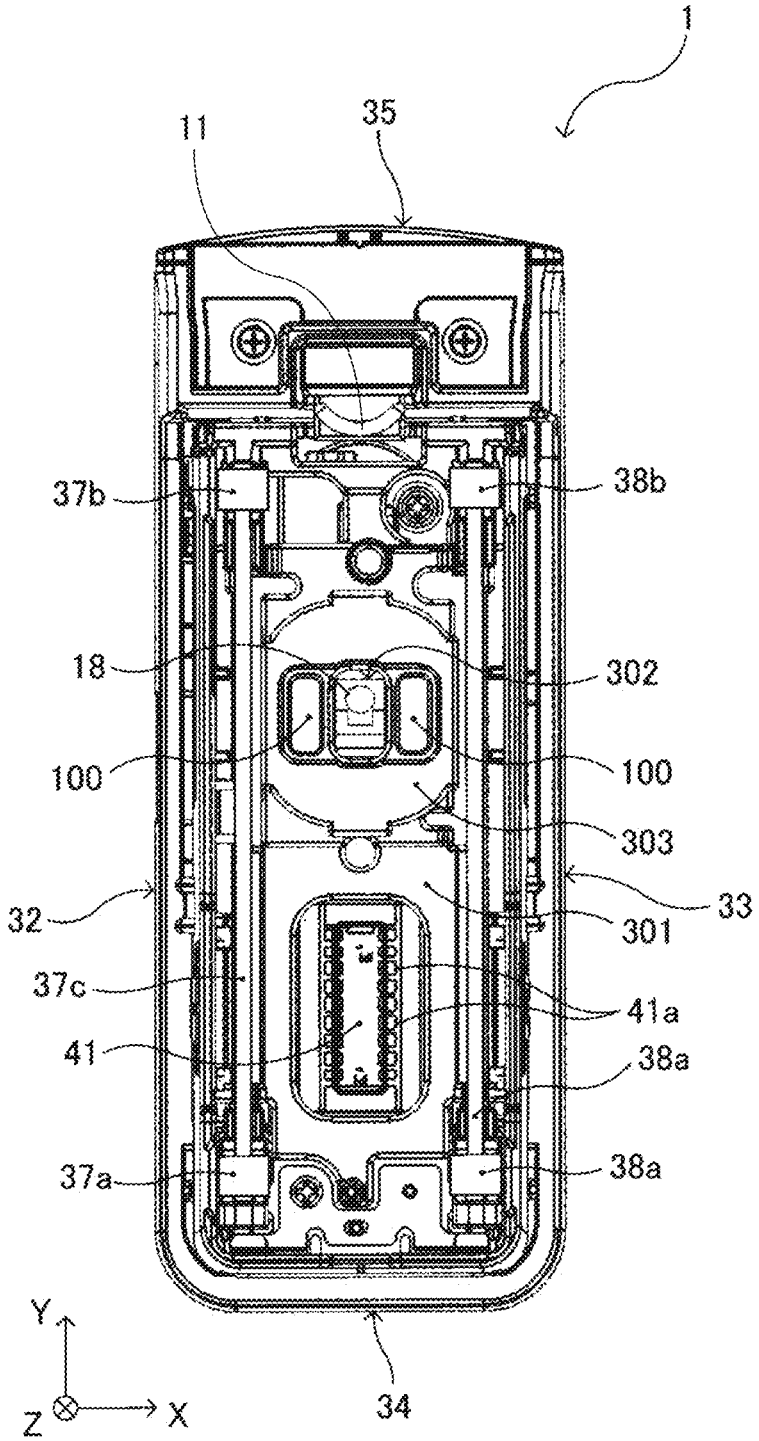
FIG. 33 is a bottom view of the handheld printer according to Variation 3.

FIGS. 28 to 33 illustrate six sides of the handheld printer 1 according to Variation 3. FIG. 28 is a front view, FIG. 29 is a rear view, FIG. 30 is a right side view, FIG. 31 is a left side view, FIG. 32 is a top view, and FIG. 33 is a bottom view of the handheld printer 1.

The handheld printer 1 according to Variation 3 includes, instead of the projecting rim 304 described above, a slidable sheet 100 made of a material higher in slidability than the material of the housing 80. The slidable sheet 100 is attached to the opening-surrounding flat area 303 (an opposed face member) surrounding the detection opening 302 in the housing 80. Except that the slidable sheet 100 is provided instead of the projecting rim 304, the structure according to Variation 3 is similar to the handheld printer 1 according to the embodiment described above or the Variation 1 or 2, and the description of the common configuration will be appropriately omitted. The perspective view of the handheld printer 1 according to Variation 3 as viewed obliquely from above is similar to that of the above-described embodiment, and similar to FIGS. 1 and 10 and the upper section of FIG. 3. Further, the drawing illustrating the usage state of the handheld printer 1 according to Variation 3 is similar to the drawings (FIGS. 7 and 8) of the embodiment described above.

As illustrated in FIGS. 27 and 33, in the handheld printer 1 according to Variation 3, the slidable sheet 100 is disposed on each side of the detection opening 302 in the printing direction (X-axis direction). The surface of the slidable sheet 100 is at a position projecting, beyond the opening-surrounding flat area 303, toward the print surface in the direction of discharge of ink. Further, as illustrated in FIGS. 28 to 31, among the members other than the four rollers (37*a*, 37*b*, 38*a*, and 38*b*) in contact with the surface of the recording sheet P in the handheld printer 1, the surface of the slidable sheet 100 on the recording sheet P side projects most toward the recording medium P.

As illustrated in FIGS. 27 and 33, the slidable sheet 100 is provided on each of the upstream side and the downstream side of the printing direction (scanning direction) of the detection opening 302 for exposing the position detection sensor 18. This configuration can suppress fluttering of the recording medium P in the printing direction.

In the handheld printer 1 according to the embodiment described above, a portion of the lower face of the housing 80 is made projecting into the projecting rim 304. Accordingly, the sliding load arising when the recording medium P contacts the projecting rim 304 depends on the material of the housing 80. Since the housing 80 supports the members constructing the lower unit 3, the material thereof requires a higher degree of rigidity, and it is difficult to increase the slidability with the same material.

For this reason, in the handheld printer 1 according to the embodiment described above, the sliding friction arising when the recording sheet P contacts the projecting rim 304 is large. Accordingly, a greater force is required to move the handheld printer 1 in the printing direction, and there is a risk that the usability is deteriorated.

In addition, when the handheld printer 1 is moved in a state in which the recording medium P is in contact with the projecting rim 304 whose slidability is not very high, noise occurs due to the rubbing between the projecting rim 304 and the recording medium P. Then, the user may feel discomfort.

By contrast, in the handheld printer 1 according to Variation 3, the slidable sheet 100 is made of a material having higher slidability than the slidability of the material of the housing 80. This structure can reduce the amount of force to move the handheld printer in the printing direction when the recording medium P contacts the slidable sheet 100. Thus, the usability is improved.

In addition, use of the slidable sheets 100 having high slidability can suppress the noise of rubbing when the recording medium P contacts the slidable sheets 100 and alleviate a sense of discomfort for the user. Thus, feeling of the user operating the handheld printer 1 is improved.

Figure 34:
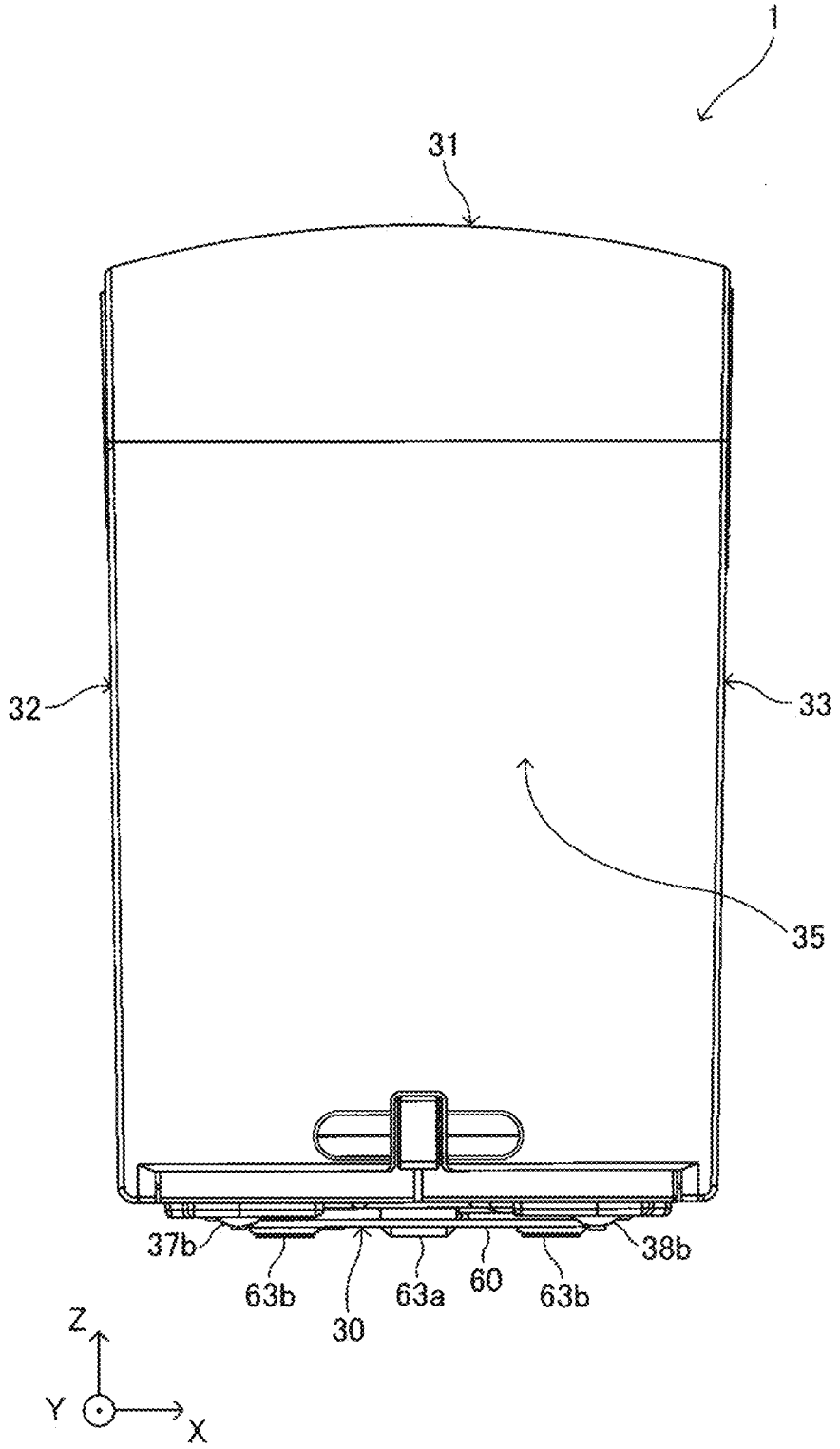
FIG. 34 is a front view of the handheld printer equipped with a spacer according to Variation 3.
Figure 35:
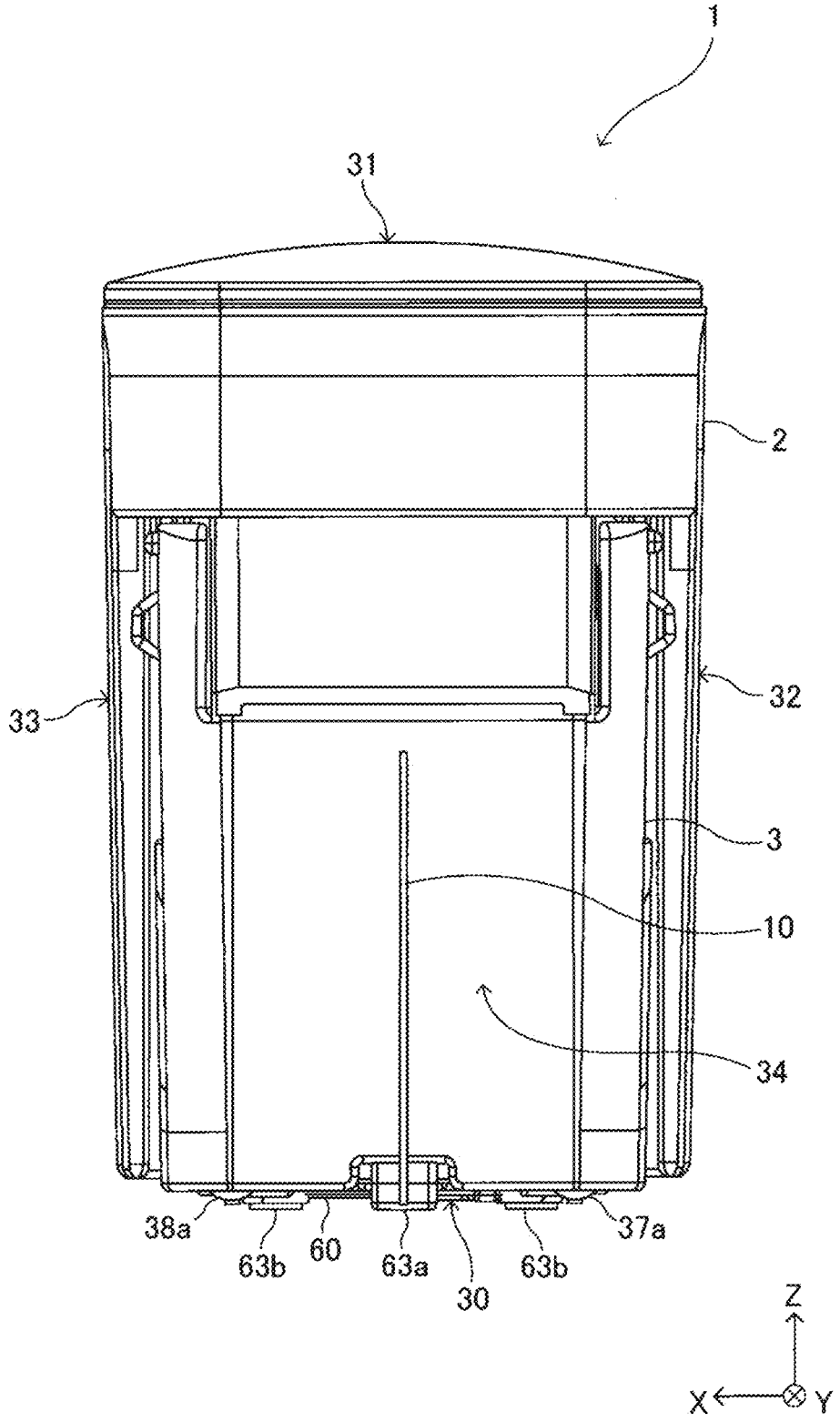
FIG. 35 is a rear view of the handheld printer equipped with the spacer according to Variation 3.
Figure 36:
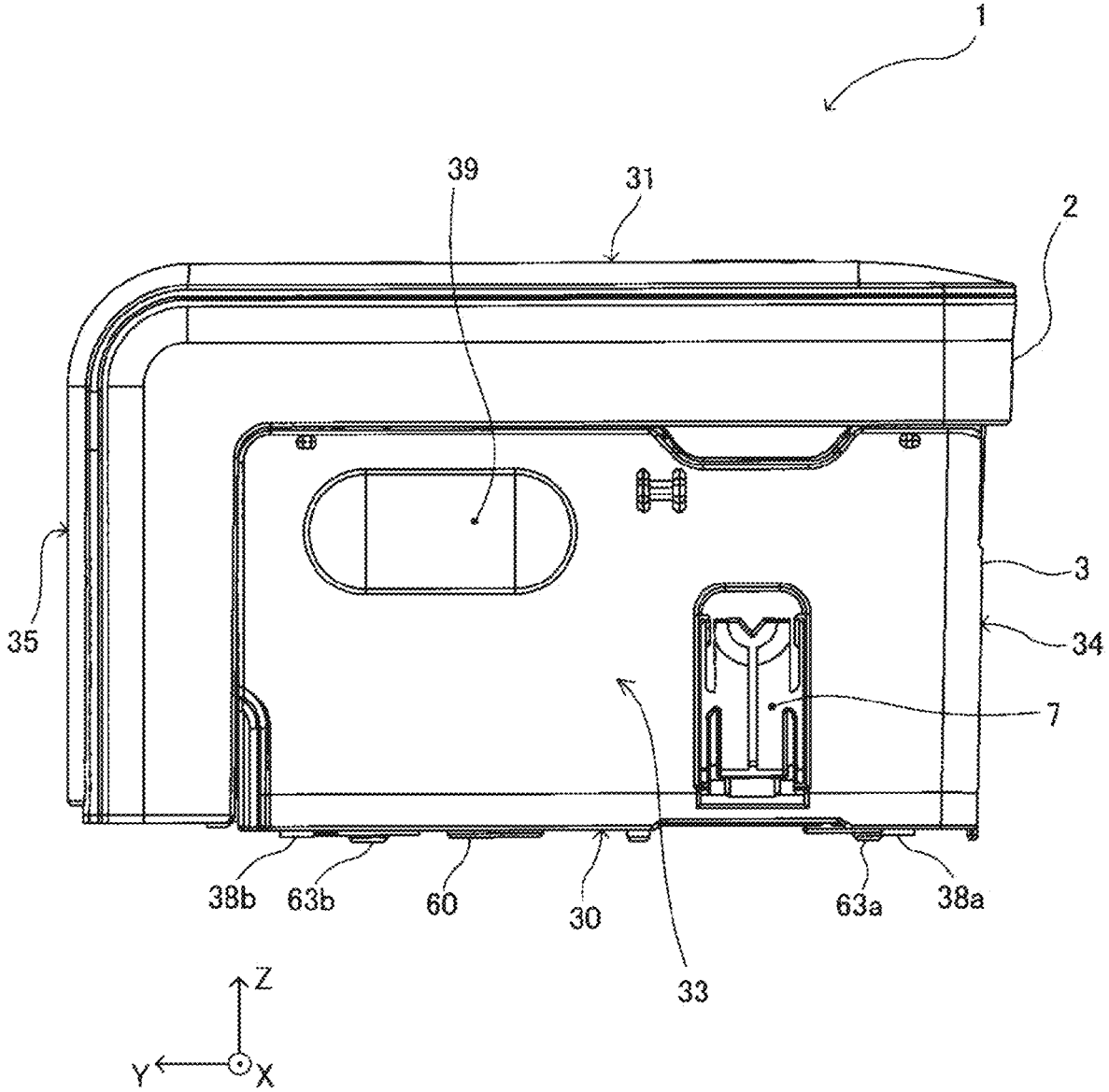
FIG. 36 is a right side view of the handheld printer according to Variation 3 equipped with the spacer.
Figure 37:
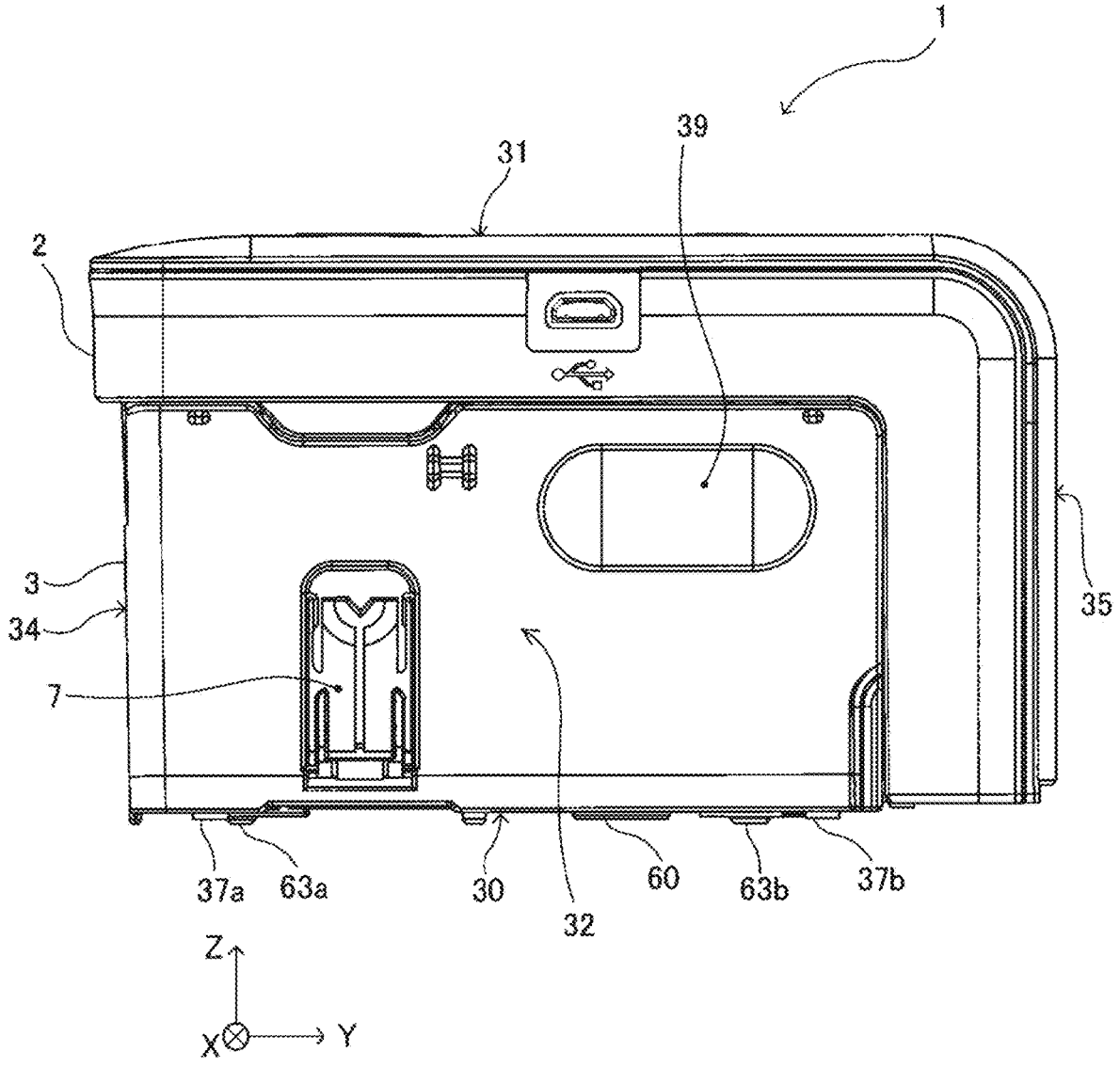
FIG. 37 is a left side view of the handheld printer according to Variation 3 equipped with a spacer.
Figure 38:
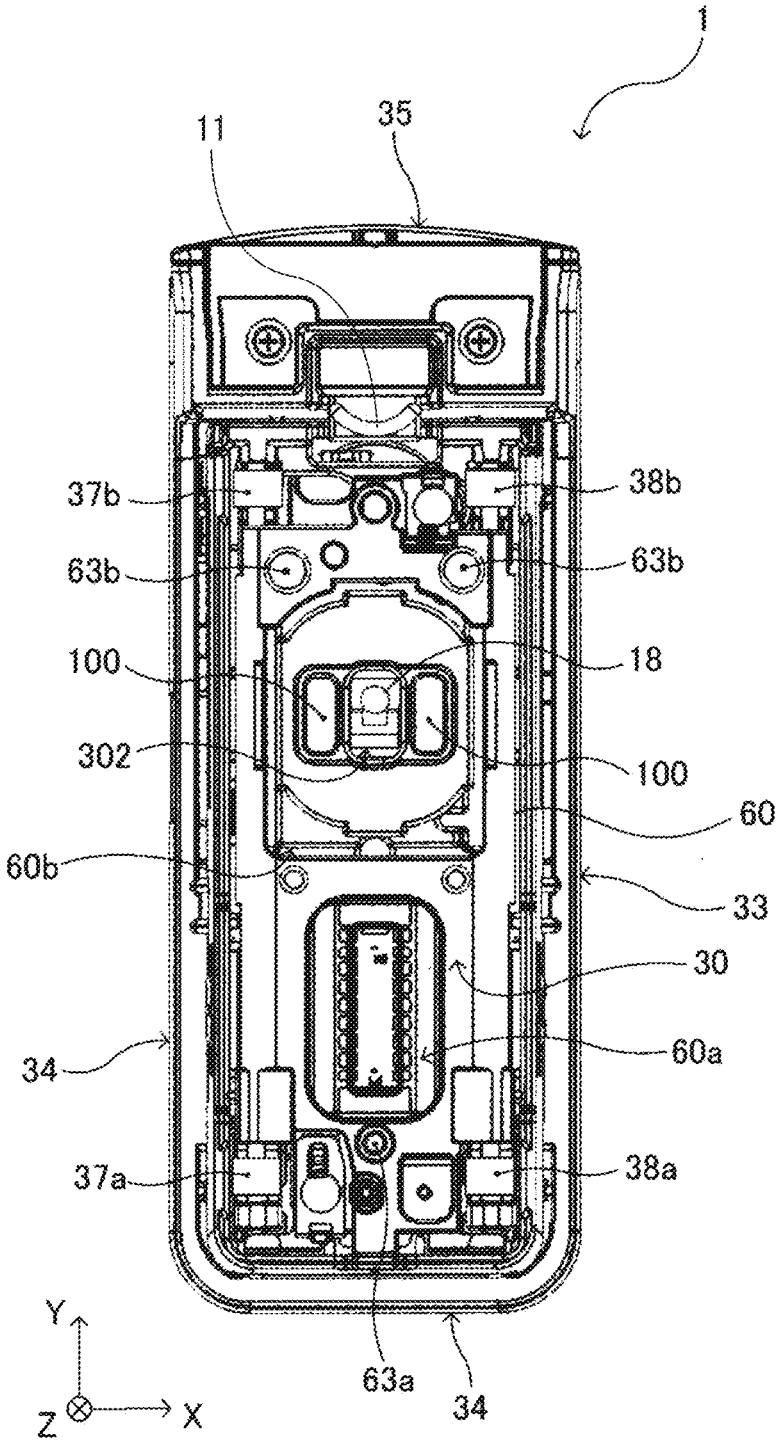
FIG. 38 is a bottom view of the handheld printer according to Variation 3 equipped with a spacer.

FIG. 34 to FIG. 38 are side views illustrating a state in which a spacer 60 is attached to the recording face 30 of the handheld printer 1 according to Variation 3. FIG. 34 is a front view, FIG. 35 is a rear view, FIG. 36 is a right side view, FIG. 37 is a left side view, and FIG. 38 is a bottom view of the handheld printer 1. The top view of the handheld printer 1 according to Variation 3 in the state in which the spacer 60 is attached is the same as FIG. 32.

As illustrated in FIG. 38, the lower face of the spacer 60 is provided with three contact projections 63, specifically, two front side contact projections 63*b* and one rear side contact projection 63*a*.

When the spacer 60 is attached to the recording face 30 of the handheld printer 1, as illustrated in FIGS. 34 to 38, while the four rollers (37*a*, 37*b*, 38*a*, and 38*b*) are exposed, the three contact projections 63 provided on the lower face of the spacer 60 project beyond the four rollers.

As a result, when the handheld printer 1 is placed on the recording medium P, the contact projections 63 contact the recording medium P and the rollers does not contact the recording medium P. Thus, the guide by the roller can be invalidated.

A magnet is provided on the upper side of the spacer 60, and the magnet is magnetically attached to an iron part on the recording face 30 of the handheld printer 1. Thus, the spacer 60 can be attached to the handheld printer 1.

As illustrated in FIG. 38, the spacer 60 includes a spacer-side discharge opening 60*a* at a position opposed to the discharge opening 30*a*, to expose the recording device 41 to the outside. The spacer 60 further includes a spacer-side detection opening 60*b* at a position opposed to the opening-surrounding flat area 303 surrounding the detection opening 302. Through the two openings, the position detection by the position detection sensor 18 and the image formation by the recording device 41 of the ink cartridge 40 can be performed in a state in which the spacer 60 is attached.

Figure 39:
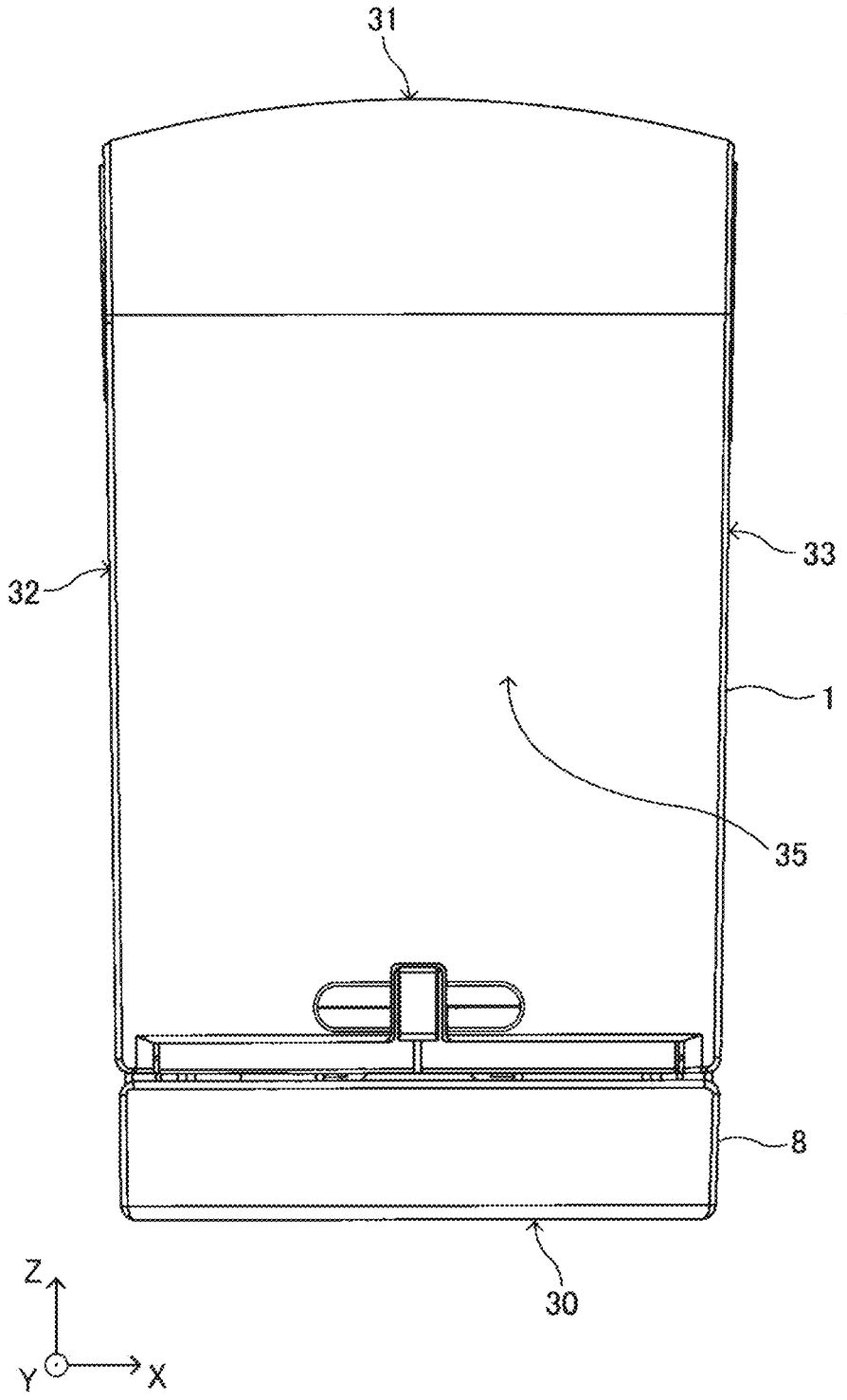
FIG. 39 is a front view of a state in which the capping unit is attached to the handheld printer according to Variation 3.
Figure 40:
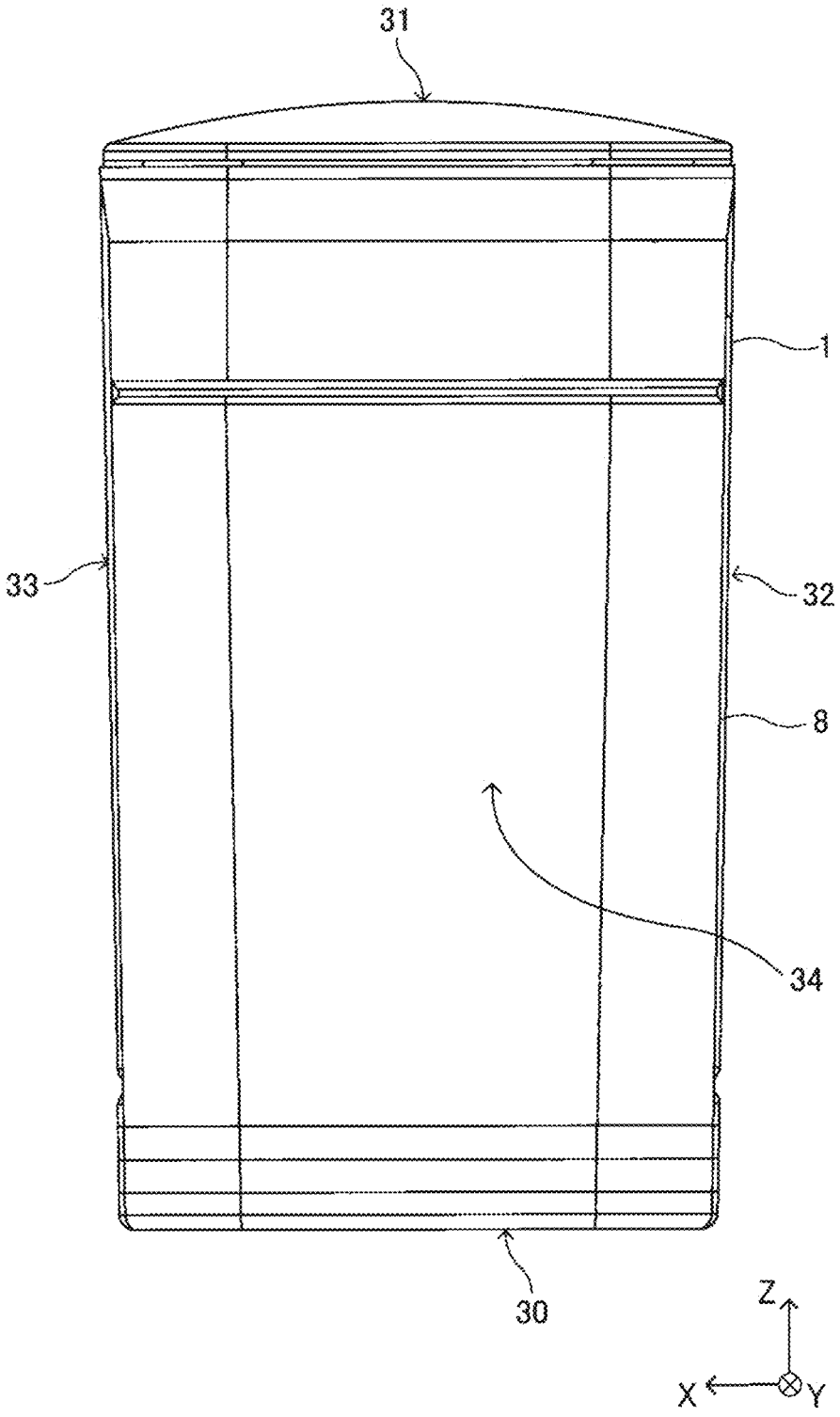
FIG. 40 is a rear view of the handheld printer according to Variation 3, with the capping unit attached.
Figure 41:
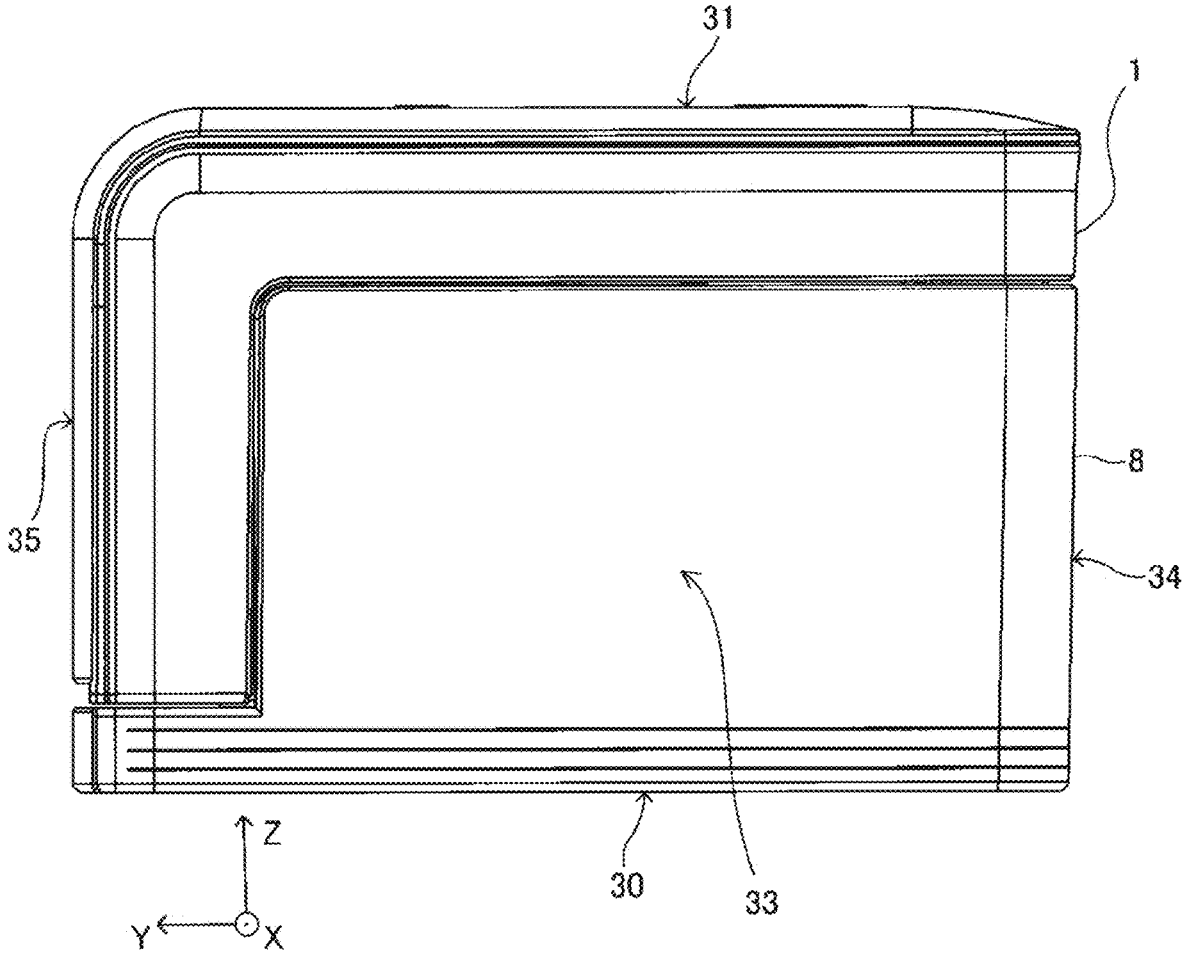
FIG. 41 is a right side view of the handheld printer according to Variation 3, with the capping unit attached.
Figure 42:
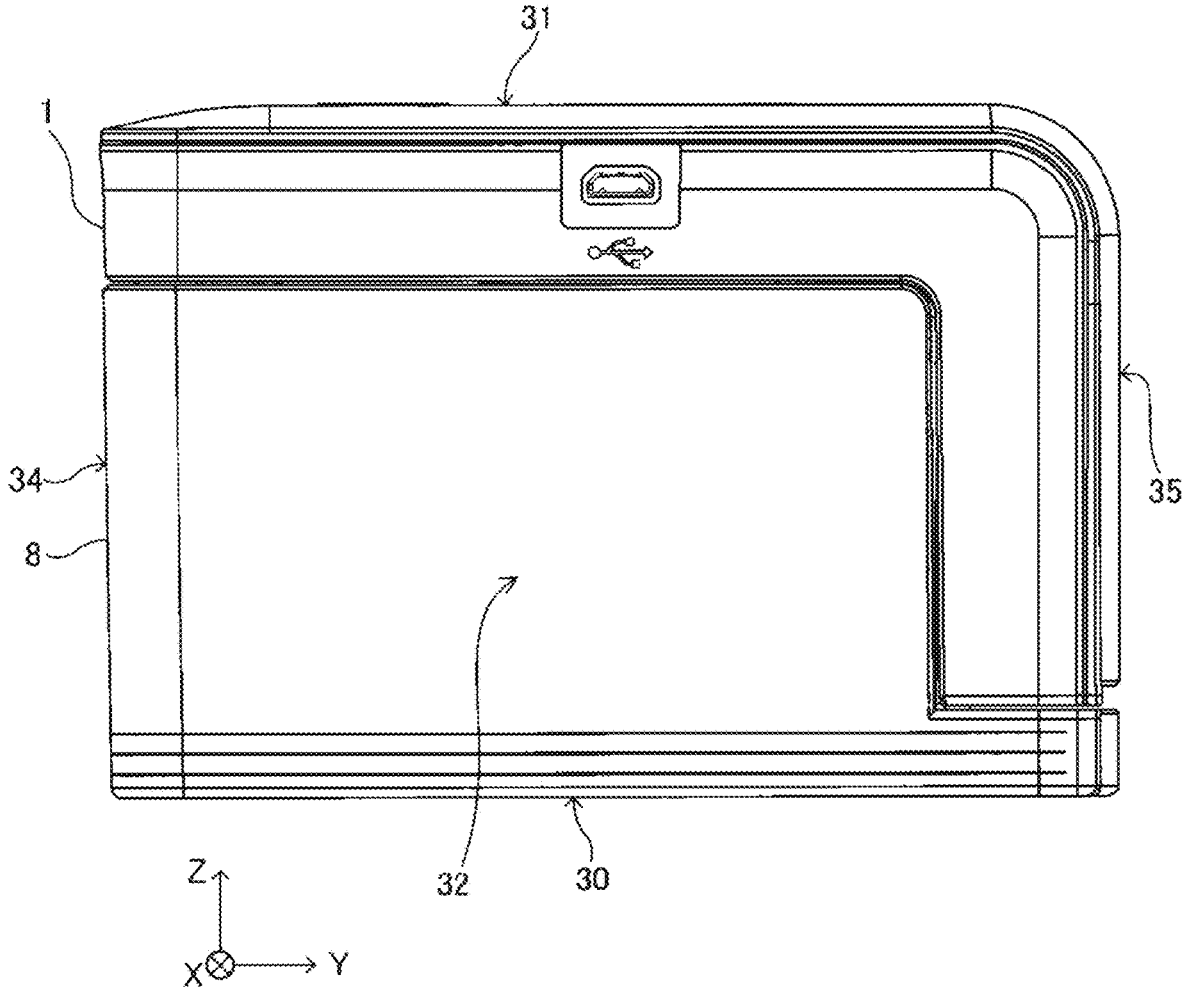
FIG. 42 is a left side view of the handheld printer according to Variation 3, with the capping unit attached thereto.
Figure 43:
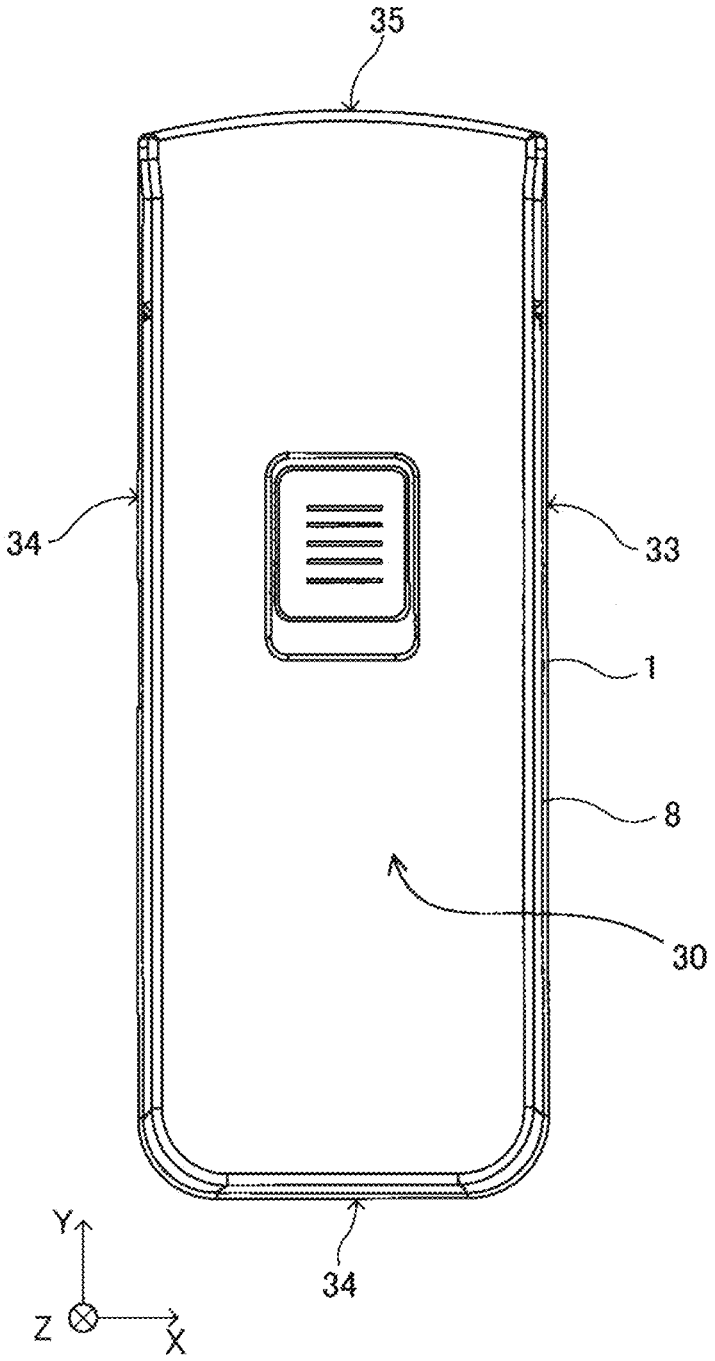
FIG. 43 is a bottom view of the state in which the capping unit is attached to the handheld printer according to Variation 3.

FIGS. 39 to 43 are side views illustrating a state in which the capping unit 8 is attached to the handheld printer 1 according to Variation 3. FIG. 39 is a front view, FIG. 40 is a rear view, FIG. 41 is a right side view, FIG. 42 is a left side view, and FIG. 43 is a bottom view of the handheld printer 1. The top view of the handheld printer 1 according to Variation 3 in the state in which the capping unit 8 is attached is the same as FIG. 32.

Although descriptions have been made above of the examples in which aspects of the present disclosure are applied to the inkjet handheld printer 1, the aspects of the present disclosure can also be applied to other types of image forming apparatuses. The aspects of the present disclosure can be applied to a recording apparatus of, for example, thermal type or thermal-transfer type.

The structures described above are examples, and aspects of the present disclosure provide respective effects as follows.

Aspect 1

An image forming apparatus, such as the handheld printer 1, includes a recording device, such as the recording device 41 (e.g., the inkjet head), that records an image on a recording medium, such a paper sheet, and a main body, such as a lower unit 3, that houses the recording device therein. The main body includes a recording face, such as the recording face 30, to be disposed opposite the recording medium, a first face, such as the upper face 31, positioned opposite the recording face, and a plurality of second faces (e.g., the left face 32, the right face 33, the rear face 34, and the front face 35) other than the recording face and the first face. For example the second faces are positioned between the recording face and the first face. The image forming apparatus further includes a cover, such as the upper unit 2, that is rotatably attached to the main body. The cover includes a first cover portion, such as the horizontal portion 2*a*, configured to cover the first face of the main body and a second cover portion, such as a vertical portion 2*b*, configured to cover at least a portion of the second faces. The second cover portion houses a battery, such as the battery 15.

According to this aspect, the gravitational center of the entire apparatus can be positioned on the recording face side as compared with a configuration in which a relatively heavy battery is disposed on the opposite side to the recording face. The battery is placed in the second cover portion of the cover including the first cover portion and the second cover portion. The second cover portion a vertically extending portion of the image forming apparatus in a state in which the recording face of the image forming apparatus is faced down. As a result, the relatively heavy battery can be disposed on a lateral side of the main body, not in an upper part of the main body (the lower unit 3), and the gravitational center of the entire apparatus can be lowered. This placement can inhibit the image forming apparatus from falling during printing operation, improving usability of the image forming apparatus. In addition, since the usability is improved, it is possible to prevent the deterioration of the printed image caused by the deterioration of the usability of the image forming apparatus.

Although the battery 15, which is a secondary battery that can be charged, is used in the embodiment described above, the battery is not limited thereto, and a primary battery called a dry battery can be used.

Aspect 2

In Aspect 1, an end of the second cover portion is positioned on the recording face of the main body.

According to this aspect, the gravitational center of the entire apparatus can be made closer to the recording face, and the usability is further improved.

Aspect 3

In Aspect 1 or 2, the first cover portion and the second cover portion of the cover are arranged in an L-shape.

According to this aspect, the extending direction of the second cover portion is orthogonal to the extending direction of the first cover portion, and the ease of operation in opening and closing the cover can be improved.

Aspect 4

The image forming apparatus according to any one of Aspects 1 to 3 further includes a lock release lever, such as the operated portion 11 of the upper unit lock claw 110, to be operated to release the cover locked to the main body in the closed state, and the lock release lever is disposed on the recording face.

According to this aspect, since the lock release lever is disposed on the recording face facing the recording medium at the time of image formation, the access to the lock release lever is prevented when the recording face is disposed opposite the recording medium at the time of image formation or the like. This configuration can prevent release of the closed state of the cover due to an erroneous operation by the user.

Aspect 5

In any one of Aspects 1 to 4, the plurality of second faces includes a pair of opposing faces (for example, the left face 32 and the right face 33) opposite to each other and not covered with the cover, and the main body includes a recess, such as the grip portion 39, disposed on each of the pair of opposing faces.

According to this aspect, the user can place his or her finger in the recess and grip the recess so as to sandwich the image forming apparatus. Thus, the user can stably hold the image forming apparatus.

Aspect 6

In Aspect 5, the recess is disposed in the vicinity of the gravitational center of the image forming apparatus as viewed from the opposing face.

This structure can guide the user to hold the apparatus at a position near the gravitational center of the image forming apparatus. Then, as the user operates the apparatus gripping the apparatus at the position near the gravitational center, the operation becomes stable and usability is improved.

Aspect 7

The image forming apparatus according to any of Aspects 1 to 6 includes an attachment device, such as the ink cartridge 40, configured to be removably attached to the main body. The attachment device (the ink cartridge 40) is electrically connected to the main body in a state in which the cover is closed and is removable from the main body in a state in which the cover is open. The apparatus further includes an open-close detector (the striker 82, the feeler 22, the open-close detection switch 23, and the control board 14) configured to detect an open state and a closed state of the cover.

According to this aspect, in attaching and removal of the attachment device, the open state of the cover can be detected.

Although, in the handheld printer 1 according to the embodiment described above, the attachment device is the ink cartridge 40 in which the recording device 41 and the ink tank are combined, but the attachment device is not limited thereto. For example, one of the ink tank and the recording device can be the attachment device that is removably attachable to the main body.

Aspect 8

In Aspect 7, when the apparatus includes circuitry (for example, the control board 14) configured to prevent a short circuit at an electric connection between the attachment device and the main body due to attachment or removal of the attachment device, in a state in which the open-close detector detects the open state.

This aspect can prevent the occurrence of a failure due to a short circuit when attaching and detaching the attachment device.

Aspect 9

In Aspect 7 or 8, the circuitry is configured to shut off at least a part of the electric connections between the main body and the attachment device in response to a detection of the open state by the open-close detector.

According to this aspect, in a state in which the cover is open, even when the power is turned on, the electric connection to the attachment device can be shut off. Further, in a state in which the power is on, the electric connection to the attachment device can be shut off in conjunction with the moving of the cover from the closed position to the open position. Accordingly, the electric connection is shut off when the cover is opened and the user is about to remove the attachment device. Therefore, this configuration can prevent the occurrence of a short circuit at the electric connection (the contact portion between the FPC contact portion 13 and the cartridge contact portion 40*b*, etc.) between the attachment device and the main body in removing the attachment device. Thereby, when attaching or removing the attachment device to or from the main body, the occurrence of a failure due to a short circuit can be prevented.

Aspect 10

In Aspect 8 or 9, the image forming apparatus further includes a detaching mechanism, such as a cartridge attaching and detaching mechanism 12, configured to remove the attachment device from the main body.

According to this aspect, the removal of the attachment device becomes easy.

Aspect 11

In Aspect 10, a lever (such as the operated portion 12*a*) of the detaching mechanism is disposed in a vicinity of a joint between the first face and the second face (for example, the corner between the upper face 31 and the front face 35 of the lower unit 3) of the main body.

According to this aspect, the operation of the operated portion of the detaching mechanism becomes easy, and the removal of the attachment device becomes easy.

Aspect 12

In Aspect 10 or 11, in the state in which the open-close detector detects the closed state, the operated portion (such as the operated portion 12*a*) of the detaching mechanism is covered with the cover.

According to this aspect, since it is difficult for the user to visually recognize the operated portion of the detaching mechanism covered with the cover, operation of the operated portion becomes difficult. This configuration can prevent the detaching mechanism from being operated in a state in which the electric connection between the main body and the attachment device is not shut off, and prevent the occurrence of short circuit at the electric connection portion between the attachment device and the main body.

Aspect 13

In any one of Aspects 10 to 12, the cover is supported on the main body rotatably about a shaft, such as the upper unit rotation shaft 3*a*, and the operated portion (for example, the operated portion 12*a*) of the detaching mechanism is disposed in the vicinity of the shaft.

According to this aspect, as described in Variation 1, compared with the arrangement (of the embodiment described above) in which the operated portion of the detaching mechanism is away from the shaft, it becomes difficult to access the operated portion of the detaching mechanism in the state in which the cover is closed. This configuration can prevent the detaching mechanism from being operated in a state in which the electric connection between the main body and the attachment device is not shut off, and prevent the occurrence of short circuit at the electric connection portion between the attachment device and the main body.

Aspect 14

In any one of Aspects 10 to 13, the detaching mechanism is configured to operate in conjunction with the opening of the cover.

As described in Variation 2, this aspect can reduce the number of operation steps performed to make the attachment device removable from the main body and improve the usability.

Aspect 15

The image forming apparatus according to any one of Aspects 10 to 14 includes an access path shield (such as the striker 82 and the feeler 22) to shield at least a portion of an access path to the operated portion of the detaching mechanism in a state in which the open-close detector detects the closed state.

According to this aspect, the access path shield hinders the access to the operated portion of the detaching mechanism. Accordingly, the access path shield can prevent the detaching mechanism from being operated in a state in which the electric connection between the main body and the attachment device is not shut off. Therefore, this configuration can prevent the occurrence of a short circuit at the electric connection between the attachment device and the main body.

Aspect 16

In Aspect 15, the open-close detector includes a pressing portion, such as the striker 82, disposed in one of the main body and the cover, and a displacement portion, such as the feeler 22, disposed on the other of the main body and the cover. The displacement portion moves when pressed by the pressing portion. The open-close detector is configured to detect whether the cover is open or closed, based on the displacement of the displacement portion. Further, at least one of the pressing portion and the displacement portion serves as the access path shield.

According to this aspect, at least one of the pressing portion and the displacement portion inhibits access to the operated portion of the detaching mechanism and prevents the detaching mechanism from being operated in a state in which the electric connection between the main body and the attachment device is not shut off. Therefore, this configuration can prevent the occurrence of a short circuit at the electric connection between the attachment device and the main body. Further, since at least one of the pressing portion and the displacement portion can be used as the access path shield, the number of components can be reduced.

Aspect 17

Aspect 17 concerns a body (for example, the upper unit 2 and the lower unit 3) of an image forming apparatus (for example, the handheld printer 1) to which a recording device, such as the recording device 41, that records an image on a recording medium, such a paper sheet is to be removably attached. The body includes a main body (for example, the lower unit 3) that houses the recording device and a cover (for example, the upper unit 2). The main body includes a recording face, such as the recording face 30, to be disposed opposite the recording medium, a first face, such as the upper face 31, positioned opposite the recording face, and a plurality of second faces (e.g., the left face 32, the right face 33, the rear face 34, and the front face 35) other than the recording face and the first face. For example the second faces are positioned between the recording face and the first face. The cover (e.g., the upper unit 2) is rotatably attached to the main body. The cover includes a first cover portion, such as the horizontal portion 2*a*, configured to cover the first face of the main body and a second cover portion, such as a vertical portion 2*b*, configured to cover at least a portion of the second faces. The second cover portion houses a battery, such as the battery 15.

This placement can inhibit the image forming apparatus from falling during printing operation, improving usability of the image forming apparatus, similar to Aspect 1. In addition, since the usability is improved, it is possible to prevent the deterioration of the printed image caused by the deterioration of the usability of the image forming apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

a recording device configured to record an image on a recording medium;

a main body configured to house the recording device, the main body including:

a recording face to be disposed opposite the recording medium;

a first face positioned opposite the recording face; and a second face positioned between the recording face and the first face; and a cover rotatably attached to the main body, the cover including:

a first cover portion configured to cover the first face of the main body; and a second cover portion configured to cover at least a portion of the second face, the second cover portion configured to house a battery.

2. The image forming apparatus according to claim 1, wherein an end of the second cover portion is positioned on the recording face of the main body.

3. The image forming apparatus according to claim 1, wherein the first cover portion and the second cover portion of the cover are in an L-shaped arrangement.

4. The image forming apparatus according to claim 1, further comprising a lock release lever to be operated to release locking of a closed state of the cover closed with respect to the main body, wherein the lock release lever is disposed on the recording face.

5. The image forming apparatus according to claim 1, wherein the main body includes a plurality of second faces including the second face, the plurality of second faces including a pair of opposing faces positioned opposite to each other and not covered by the cover, and wherein each of the pair of opposing faces includes a recess.

6. The image forming apparatus according to claim 5, wherein the recess is disposed in a vicinity of a gravitational center of the image forming apparatus on each of the pair of opposing faces.

7. The image forming apparatus according to claim 1, further comprising:

an attachment device configured to be removably attached to the main body and electrically connected to the main body in a state in which the cover is closed, the attachment device being removable from the main body in a state in which the cover is open; and an open-close detector configured to detect an open state and a closed state of the cover.

8. The image forming apparatus according to claim 7, further comprising circuitry configured to prevent attachment or removal of the attachment device from causing a short circuit at an electric connection between the attachment device and the main body in a state in which the open-close detector detects the open state.

9. The image forming apparatus according to claim 8, wherein the circuitry is configured to shut off at least a part of an electric connection between the main body and the attachment device in response to a detection of the open state by the open-close detector.

10. The image forming apparatus according to claim 8, further comprising a detaching mechanism configured to remove the attachment device from the main body.

11. The image forming apparatus according to claim 10, wherein the detaching mechanism includes a lever to be operated to remove the attachment device from the main body, the lever disposed in a vicinity of a joint between the first face and the second face of the main body.

12. The image forming apparatus according to claim 10, wherein the detaching mechanism includes a lever to be operated to remove the attachment device from the main body, the lever disposed to be covered with the cover in the state in which the open-close detector detects the closed state.

13. The image forming apparatus according to claim 11, further comprising a shaft configured to rotatably support the cover on the main body, wherein the lever of the detaching mechanism is disposed in a vicinity of the shaft.

14. The image forming apparatus according to claim 10, wherein the detaching mechanism is configured to operate in conjunction with opening of the cover.

15. The image forming apparatus according to claim 11, wherein the detaching mechanism includes a lever to be operated to remove the attachment device from the main body, and wherein the image forming apparatus further comprises an access path shield configured to shield at least a portion of an access path to the lever of the detaching mechanism in a state in which the open-close detector detects the closed state.

16. The image forming apparatus according to claim 11, wherein the open-close detector includes:

a pressing portion disposed in one of the main body and the cover; and a displacement portion disposed on the other of the main body and the cover, the displacement portion configured to move, pressed by the pressing portion, and wherein at least one of the pressing portion and the displacement portion serves as an access path shield configured to shield at least a portion of an access path to the lever of the detaching mechanism in a state in which the open-close detector detects the closed state.

17. An image forming apparatus body comprising:

a main body configured to removably house a recording device configured to record an image on a recording medium, the main body including:

a recording face to be disposed opposite the recording medium;

a first face positioned opposite the recording face; and a second face positioned between the recording face and the first face; and a cover rotatably attached to the main body, the cover including:

a first cover portion configured to cover the first face of the main body; and a second cover portion configured to cover at least a portion of the second face, the second cover portion configured to house a battery.

* * * * *